US010480145B2

(12) United States Patent
Nakano

(10) Patent No.: US 10,480,145 B2
(45) Date of Patent: Nov. 19, 2019

(54) METHOD FOR BURYING PRECAST PILE

(71) Applicant: Takao Nakano, Itami (JP)

(72) Inventor: Takao Nakano, Itami (JP)

( * ) Notice: Subject to any disclaimer, the term of this patent is extended or adjusted under 35 U.S.C. 154(b) by 0 days.

(21) Appl. No.: 15/739,281

(22) PCT Filed: Jul. 27, 2015

(86) PCT No.: PCT/JP2015/071283

§ 371 (c)(1),
(2) Date: Dec. 22, 2017

(87) PCT Pub. No.: WO2017/010016

PCT Pub. Date: Jan. 19, 2017

(65) Prior Publication Data

US 2018/0216305 A1 Aug. 2, 2018

(30) Foreign Application Priority Data

Jul. 15, 2015 (JP) ..... 2015-141220

(51) Int. Cl.
*E02D 5/34* (2006.01)
*E02D 5/44* (2006.01)
(Continued)

(52) U.S. Cl.
CPC ..... *E02D 5/48* (2013.01); *E02D 5/50* (2013.01)

(58) Field of Classification Search
CPC ..... E02B 3/121; E02B 5/02; E02B 17/0008; E02D 3/12; E02D 5/22; E02D 5/30; E02D 5/32; E02D 5/34; E02D 5/38; E02D 5/385; E02D 5/44; E02D 5/62; E02D 7/24; E02D 15/04; E02D 29/0266; E02D 29/0275; E02D 2250/003; E02D 2250/0038;
(Continued)

(56) References Cited

U.S. PATENT DOCUMENTS 1,900,622 A * 3/1933 Tada ..... E02D 5/44 405/237
2,187,316 A * 1/1940 Greulich ..... E02D 5/48 405/256
(Continued)

FOREIGN PATENT DOCUMENTS

JP S63-277319 A 11/1988
JP H02-58634 A 2/1990
(Continued)

OTHER PUBLICATIONS

International Search Report dated Oct. 20, 2015 for PCT/JP2015/071283 and English translation.

*Primary Examiner* — Benjamin F Fiorello
*Assistant Examiner* — Edwin J Toledo-Duran
(74) *Attorney, Agent, or Firm* — Lucas & Mercanti, LLP

(57) ABSTRACT

Provided is a method for burying a precast pile in which a borehole and a buried precast pile are strongly integrated, the end bearing capacity and the circumferential frictional force of the precast pile are increased, and the extraction resistance strength thereof is improved. Provided is a method for burying a precast pile in which a foaming agent having an expanding effect is added to the cement milk or mortar in advance, whereby the soil cement formed around the base of the precast pile in the borehole is caused to expand.

12 Claims, 25 Drawing Sheets

(51) Int. Cl.
*E02D 5/48* (2006.01)
*E02D 5/50* (2006.01)

(58) Field of Classification Search
CPC ..... E02D 27/00; E02D 27/12; E02D 27/14; E02D 27/16; E04B 1/04; E04B 1/16
USPC ..... 405/231, 233–243, 248, 256, 257, 225, 405/266–269, 286, 287; 52/169.9, 52/294–297
See application file for complete search history.

(56) References Cited

U.S. PATENT DOCUMENTS 2,187,318 A * 1/1940 Greulich ..... E02D 5/30 405/256
2,434,301 A * 1/1948 Wertz ..... C09K 17/40 264/31
3,191,390 A * 6/1965 Schutte ..... E02D 5/38 405/238
3,423,944 A * 1/1969 Goodman ..... E02D 5/385 405/237
3,685,302 A * 8/1972 Fuller ..... E02D 5/44 405/237
3,751,931 A * 8/1973 Merjan ..... E02D 5/30 405/253
3,875,752 A * 4/1975 Merjan ..... E02B 7/30 405/253
3,913,337 A * 10/1975 Merjan ..... E02D 5/30 405/232
3,916,635 A * 11/1975 Lynch ..... E02D 5/38 405/253
3,971,227 A * 7/1976 Godley ..... E02D 5/72 405/233
4,116,012 A * 9/1978 Abe ..... E02D 5/44 175/171
4,132,082 A * 1/1979 Merjan ..... E02D 5/44 405/244
4,199,277 A * 4/1980 Merjan ..... E02D 5/30 405/250
4,293,242 A * 10/1981 Merjan ..... E02D 5/44 405/239
4,906,141 A * 3/1990 Massarsch ..... E02D 5/44 405/237
4,909,675 A * 3/1990 Taki ..... E02D 5/20 405/241

FOREIGN PATENT DOCUMENTS

JP H03-115669 A 5/1991
JP H04-185818 A 7/1992
JP 2000080647 A 3/2000
JP 2001355233 A 12/2001
JP 2003227133 A 8/2003
JP 2003277738 A 10/2003
JP 2004316182 A 11/2004
JP 2006283521 A 10/2006

* cited by examiner

FIG. 11

USED MATERIALS IN FORMULATION EXAMPLE 1

| MATERIAL NAME | SPECIFICATION |
|---|---|
| CEMENT | N : NORMAL PORTLAND CEMENT DENSITY:3.16g/cm³ |
| SEPARATION REDUCING AGENT | V : SFCA2000(CELLULOSE TYPE) SHIN-ETSU CHEMICAL CO., LTD. MADE |
| BLOWING AGENT | AL : ALUMINUM POWDER (CELMECP) FLOWRICCO., LTD. MADE |
| ADMIXTURE | SP : FLOWRIC SF500S FLOWRICCO., LTD. MADE<br>HIGH QUALITY AE WATER REDUCING AGENT: POLY-CARBOXYLIC ACID TYPE |
| FINE AGGREGATE | S : MOUNTAIN SAND KURURIOTANI KIMIZU-CITY, CHIBA-PREFECTURE PRODUCTION<br>DENSITY:2.62g/cm³ |
| COARSE AGGREGATE | G : CRUSHED STONE LIME CRUSHED STONE TSUKUMI-CITY, OOITA-PREFECTURE PRODUCTION DENSITY:2.70g/cm³ |
| WATER | W : WATER |

FIG. 12

FORMULATION OF FORMULATION EXAMPLE 1

| W/C (%) | s/a (%) | UNIT AMOUNT (kg/m³) | | | | | | |
|---|---|---|---|---|---|---|---|---|
| | | W | C | S1 | G | V | AL(g) | SP(%) |
| 35.0 | 51.8 | 175 | 500 | 844 | 810 | 0.25 | 15,30,45 | 1.4 |
| | | 175 | 144 | 322 | 300 | – | – | – |

FIG. 13

FRESH TEST AND EXPANSION COEFFICIENT WHEN EXPANDING AGENT OF FORMULATION 1 IS CHANGED

| NO | AL ADDITION AMOUNT (g/m³) | ELAPSED TIME (MINUTE) | SAMPLE TEMPERATURE (°C) | SLUMP FLOW (cm) | | | 50cm FLOW (SECOND) | AIR AMOUNT (%) | U-TYPE FILLING HEIGHT (cm) | EXPANSION COEFFICIENT (%) |
|---|---|---|---|---|---|---|---|---|---|---|
| | | | | VALUE 1 | VALUE 2 | AVERAGE | | | | |
| 1 | 15 | 5 | 22 | 62.0 | 61.0 | 61.5 | 4.2 | 4.1 | 34.4 | 0.2 |
| 2 | 30 | 5 | 23 | 63.0 | 63.0 | 63.0 | 4.5 | 4.0 | | 1.0 |
| 3 | 45 | 5 | 23 | 65.0 | 65.0 | 65.0 | 4.7 | 4.3 | | 2.5 |

FIG. 15

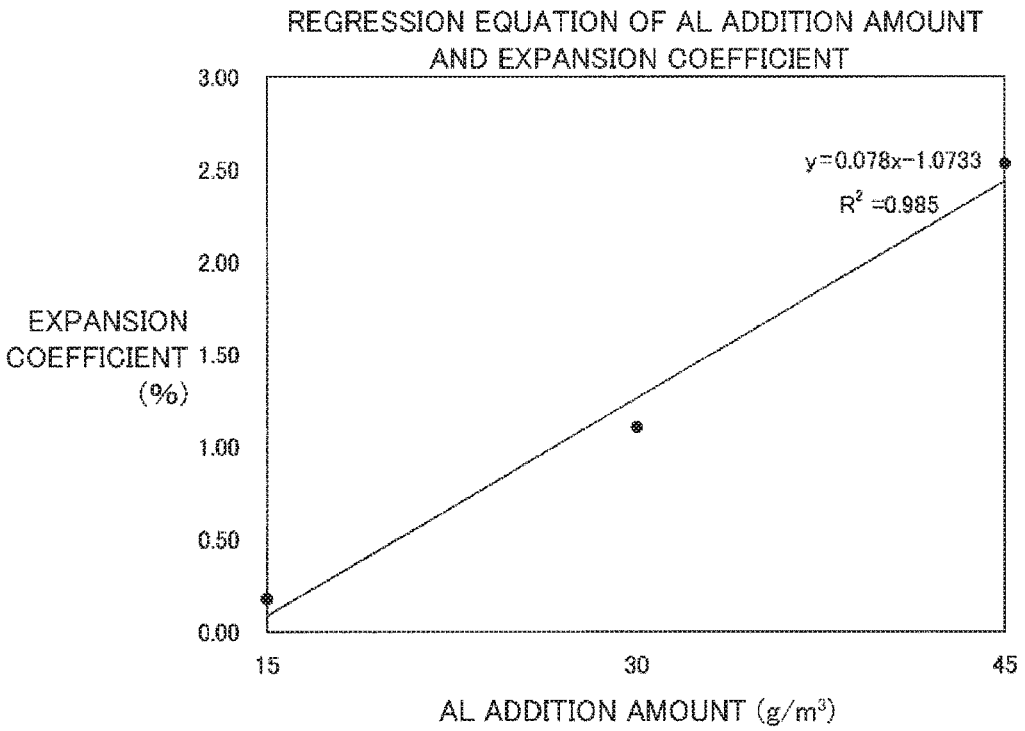

FIG. 16

USED MATERIALS IN FORMULATION EXAMPLE 2

| MATERIAL NAME | SPECIFICATION |
|---|---|
| CEMENT | C : BLAST FURNACE CEMENT B TYPE DENSITY:3.02g/cm³ |
| FINE AGGREGATE | S2 : LAND SAND OKAYAMA-PREFECTURE PRODUCTION DENSITY:2.56g/cm³ FM2.70 |
| COARSE AGGREGATE | G1 : CRUSHED STONE HYOGO-PREFECTURE PRODUCTION DENSITY:2.62g/cm³ ACTUAL RATE57% |
| THICKENER | V : CELLULOSE TYPE THICKENER |
| ADMIXTURE | AD : AE WATER REDUCING AGENT |
| | FLUIDIZING AGENT |
| BLOWING AGENT | AL : ALUMINUM POWDER (CELMEC P) FLOWRIC CO.,LTD. MADE |
| WATER | W : WATER |

FIG. 17

FORMULATION OF FORMULATION EXAMPLE 2

| W/C | s/a | UNIT AMOUNT (kg/m$^3$) | | | | | | | |
|---|---|---|---|---|---|---|---|---|---|
| (%) | (%) | W | C | S1 | G | V | AL(g/m$^3$) | AE | FLUIDIZING AGENT |
| 43.0 | 45.0 | 175 | 407 | 776 | 896 | 0.600 | 0,25,37.5,50 | 1.00% | 1.7% |

FIG. 18

FRESH TEST AND EXPANSION COEFFICIENT WHEN BLOWING AGENT (AL) OF FORMULATION EXAMPLE 2 IS CHANGED

| AL ADDITION AMOUNT (BLOWING AGENT) (g/m$^3$) | ELAPSED TIME (MINUTE) | SLUMP FLOW (cm) | AIR AMOUNT (%) | CONCRETE TEMPERATURE (°C) | EXPANSION COEFFICIENT (%) |
|---|---|---|---|---|---|
| 0 | 5 | 61.0×60.0 | 4.7 | 19 | −0.3 |
| 25 | 5 | 60.0×59.0 | 4.4 | 19 | 0.50 |
| 37.5 | 5 | 63.0×61.0 | 4.4 | 19 | 1.35 |
| 50 | 5 | 60.0×60.0 | 4.8 | 19 | 1.98 |

FIG. 19

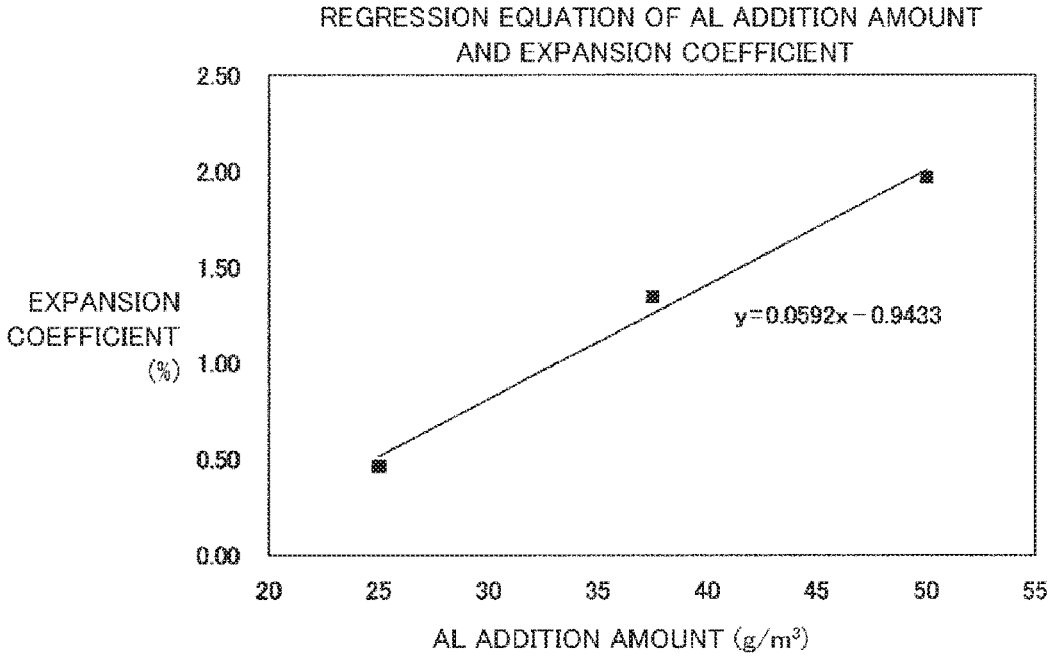

FIG. 20

USED MATERIALS IN FORMULATION EXAMPLE 3

| MATERIAL NAME | SPECIFICATION |
|---|---|
| CEMENT | C : LOW HEAT PORTLAND CEMENT DENSITY:3.22g/cm³ |
| FINE AGGREGATE | S1:S2=65:35(WEIGHT MIXING) MIXED DENSITY2.62 g/cm³ |
| | S1 LAND SAND IBARAGI-PREFECTURE PRODUCTION DENSITY:2.60g/cm³ FM2.25 |
| | S2 : CRUSHED SAND TOCHIGI-PREFECTURE PRODUCTION DENSITY:2.67g/cm³ FM3.40 |
| COARSE AGGREGATE | G1 : CRUSHED STONE 2005 IBARAGI-PREFECTURE PRODUCTION DENSITY:2.70g/cm³ ACTUAL RATE60% |
| THICKENER | V : CELLULOSE TYPE THICKENER |
| ADMIXTURE | AD : HIGH QUALITY AE WATER REDUCING AGENT FLOWRIC SF500H FLOWRIC CO., LTD MADE |
| BLOWING AGENT | AL : ALUMINUM POWDER (CELMEC P) FLOWRICCO.,LTD. MADE |
| WATER | W : WATER |

FIG. 21

FORMULATION OF FORMULATION EXAMPLE 3

| W/C (%) | s/a (%) | UNIT AMOUNT (kg/m³) | | | | | | | |
|---|---|---|---|---|---|---|---|---|---|
| | | W | C | S1 | S2 | G | V | AL(g/m³) | AD |
| 34.0 | 55.6 | 170 | 500 | 596 | 321 | 756 | 0.100 | 0,20,40,60 | 1.55% |

FIG. 22

FRESH TEST OF CONCRETE OF FORMULATION EXAMPLE 3

| ADMIXTURE (AD) | ADMIXTURE ADDITION RATE (%) | ELAPSED TIME (MINUTE) | SLUMP FLOW (cm) | REACHING TO 50cm (SECOND) | FLOW STOPPING (SECOND) | AIR AMOUNT (%) | U-TYPE FILLING HEIGHT (cm) | CONCRETE TEMPERATURE (℃) | BREEDING (%) |
|---|---|---|---|---|---|---|---|---|---|
| SF500H | 1.55 | 5 | 63.0×63.0 | 5.6 | 35.2 | 4.9 | 334 | 19 | 0 |

FIG. 23

FRESH TEST WHEN BLOWING AGENT OF FORMULATION EXAMPLE 3 IS CHANGED

| ADMIXTURE (AD) | ADMIXTURE ADDITION RATE (%) | BLOWING AGENT AL (g/m³) | ELAPSED TIME (MINUTE) | SLUMP FLOW (cm) | REACHING TO 50cm (SECOND) | FLOW STOPPING (SECOND) | AIR AMOUNT (%) | CONCRETE TEMPERATURE (℃) | COMPRESSIVE STRENGTH (N/mm²) | |
|---|---|---|---|---|---|---|---|---|---|---|
| | | | | | | | | | 7 days | 28 days |
| SF500H | 1.55 | 0 | 5 | 63.0×63.0 | 5.6 | 35.2 | 4.9 | 19 | 36.1 | 65.2 |
| SF500H | 1.55 | 20 | 5 | 64.0×64.0 | 4.7 | 41.3 | 4.8 | 19 | 34.1 | 62.3 |
| SF500H | 1.55 | 40 | 5 | 63.0×63.0 | 5.1 | 33.6 | 4.9 | 19 | 33.0 | 60.0 |
| SF500H | 1.55 | 60 | 5 | 65.0×64.0 | 5.1 | 38.0 | 5.0 | 19 | 30.7 | 52.6 |

FIG. 24

EXPANSION COEFFICIENT MEASUREMENT RESULT

| | | AL ADDITION AMOUNT (g/m³) | | |
|---|---|---|---|---|
| | | 20.0 | 40.0 | 60.0 |
| EXPANSION COEFFICIENT (%) | MEASURED VALUE | 0.87 | 3.30 | 4.80 |
| | | 0.95 | 3.13 | 4.59 |
| | | 0.99 | 3.42 | 4.60 |
| | AVERAGE | 0.94 | 3.28 | 4.67 |

FIG. 27

USED MATERIALS OF FORMULATION EXAMPLE 4
AND FORMULATION EXAMPLE 5

| SYMBOL | SPECIFICATION | RATIO | DENSITY ($g/cm^3$) | SIZE RANGE OF GRAIN (mm) | COARSE GRAIN RATIO ACTUAL VALUE | WATER ABSORPTION RATE |
|---|---|---|---|---|---|---|
| C | N TAIHEIYO-UBEMITSUBISHI-TOKUYAMA | EQUAL AMOUNT | 3.16 | – | – | – |
| S1 | LAND SAND 2015 (SHUNAN-CITY, YAMAGUCHI-PREFECTURE) | 70 | 2.64 | 5 | 2.84 | 1.97 |
| S2 | LIME GRAVEL (TSUKUMI-CITY, OOITA-PREFECTURE) | 30 | 2.66 | 5 | 2.77 | 1.28 |
| G1 | CRUSHED STONE 2015 (SHUNAN-CITY, YAMAGUCHI-PREFECTURE) | 60 | 2.72 | 20～15 | 58.0 | 0.36 |
| G2 | CRUSHED STONE 1505 (SHUNAN-CITY, YAMAGUCHI-PREFECTURE) | 40 | 2.73 | 15～5 | 58.0 | 0.70 |
| ad | FLOWRICSV10L (AE WATER REDUCING AGENT STANDARD TYPE) | – | – | – | – | – |
| ad | FLOWRICSF500S (HIGH QUALITY AE WATER REDUCING AGENT STANDARD TYPE ) | – | – | – | – | – |
| AL | ALUMINUM POWDER (CELMECP) | | | | | |

FIG. 28

(a) FORMULATION CONDITION・TEST

| | |
|---|---|
| TARGET SLUMP | 18cm |
| PLANNED AIR AMOUNT | 4.50% |
| UNIT CEMENT AMOUNT | 370kg/$m^3$ |
| EXPANSION COEFFICIENT | CONCRETE IS PACKED IN STEEL FORMWORK Φ 150 X 300mm UP TO HEIGHT 280mm AND IS FREELY EXPANDED<br>UPPER SURFACE HEIGHT OF CONCRETE IS MEASURED BY HIGH SENSITIVE DISPLACEMENT GAUGE AND DIFFERENCE FROM ORIGINAL HEIGHT IS MADE EXPANSION COEFFICIENT |
| COMPRESSIVE STRENGTH | STANDARD CURING MATERIAL AGE 7DAYS, 28DYAS<br>SPECIMEN FOR COMPRESSIVE STRENGTH OF CONCRETE TO WHICH CELMEC P (AL) IS ADDED IS RESTRAINED BY 15kg WEIGHT UNTIL DEMOLISHED NEXT DAY |
| BREEDING TEST | ONLY BASE FORMULATION (AL IS NOT ADDED) IS CARRIED OUT |

(b) USED MIXER・KNEADING METHOD
SPIRAL MIXER (NOMINAL 55L)
30L KNEADING
G+S+C+(AL)+S+G → 10 SECOND → W → 90 SECOND
AIR-KNEADING (ad INCLUDING) KNEADING

CONCRETE FORMULATION OF FORMULATION EXAMPLE 4

| NO | USED ADMIXTURE | W/C (%) | s/a (%) | UNIT AMOUNT (kg/m³) | | | | | | AL(g/m³) |
|---|---|---|---|---|---|---|---|---|---|---|
| | | | | W | C | S1 | S2 | G1 | G2 | |
| 1 | SV10L | 50 | 48 | 185 | 370 | 578 | 250 | 557 | 370 | 0,30,37,44 |

CONCRETE TEST RESULT OF FORMULATION EXAMPLE 4

| NO | AL (g/m³) | ADMIXTURE TYPE | ADMIXTURE C × % | SLUMP (cm) | AIR AMOUNT (%) | CONCRETE TEMPERATURE (℃) | EXPANSION COEFFICIENT (%) | COMPRESSIVE STRENGTH·RESTRAINT (N/mm²) | |
|---|---|---|---|---|---|---|---|---|---|
| | | | | | | | | 7 DAYS | 28 DAYS |
| 1 | – | SV10L | 1.00 | 18.0 | 4.0 | 20 | −0.89 | 35.6 | 48.5 |
| 2 | 30 | SV10L | 1.00 | 18.5 | 4.0 | 20 | −0.52 | 35.6 | 45.4 |
| 3 | 37 | SV10L | 1.00 | 18.0 | 4.1 | 20 | −0.26 | 33.2 | 44.1 |
| 4 | 44 | SV10L | 1.00 | 18.5 | 4.1 | 20 | −0.02 | 31.7 | 42.8 |

CONCRETE FORMULATION OF FORMULATION EXAMPLE 5

| NO | USED ADMIXTURE | W/C (%) | s/a (%) | UNIT AMOUNT (kg/m³) | | | | | | AL (g/m³) |
|---|---|---|---|---|---|---|---|---|---|---|
| | | | | W | C | S1 | S2 | G1 | G2 | |
| 2 | SF500S | 45.9 | 49 | 170 | 370 | 605 | 261 | 560 | 370 | 0,30,37,44 |

CONCRETE TEST RESULT OF FORMULATION EXAMPLE 5

| NO | AL (g/m³) | ADMIXTURE TYPE | ADMIXTURE C×% | SLUMP (cm) | AIR AMOUNT (%) | CONCRETE TEMPERATURE (℃) | EXPANSION COEFFICIENT (%) | COMPRESSIVE STRENGTH·RESTRAINT (N/mm²) | |
|---|---|---|---|---|---|---|---|---|---|
| | | | | | | | | 7 DAYS | 28 DAYS |
| 1 | – | SF500S | 0.80 | 18.5 | 4.7 | 20 | −0.55 | 40.9 | 53.7 |
| 2 | 30 | SF500S | 0.80 | 19.0 | 5.4 | 20 | 0.47 | 38.2 | 50.1 |
| 3 | 37 | SF500S | 0.80 | 19.0 | 5.2 | 20 | 0.90 | 36.2 | 47.1 |
| 4 | 44 | SF500S | 0.80 | 18.5 | 5.0 | 20 | 1.25 | 35.0 | 45.6 |

FIG. 37

CONCRETE FORMULATION (NO AL) OF FORMULATION EXAMPLE 4 AND FORMULATION EXAMPLE 5

| NO | USED ADMIXTURE | SLUMP (cm) | AIR AMOUNT (%) | W/C (%) | s/a (%) | UNIT AMOUNT(kg/m3) | | | | | | AL ($g/m^3$) |
|---|---|---|---|---|---|---|---|---|---|---|---|---|
| | | | | | | W | C | S1 | S2 | G1 | G2 | |
| 1 | SV10L | 18 | 4.5 | 50.0 | 48.0 | 185 | 370 | 578 | 250 | 557 | 370 | NOTHING |
| 2 | SF500S | 18 | 4.5 | 45.9 | 49.0 | 170 | 370 | 605 | 261 | 560 | 370 | NOTHING |

FIG. 38

CONCRETE TEST RESULT OF FORMULATION EXAMPLE 4 AND FORMULATION EXAMPLE 5

| NO | ADMIXTURE TYPE | ADMIXTURE C × % | SLUMP (cm) | AIR AMOUNT (%) | CONCRETE TEMPERATURE (°C) | BREEDING | |
|---|---|---|---|---|---|---|---|
| | | | | | | AMOUNT($cm^3/cm^2$) | RATE(%) |
| 1 | SV10L | 1.00 | 18.0 | 4.3 | 20 | 0.18 | 3.57 |
| 2 | SF500S | 0.80 | 19.0 | 4.7 | 20 | 0.06 | 1.24 |

FIG. 39

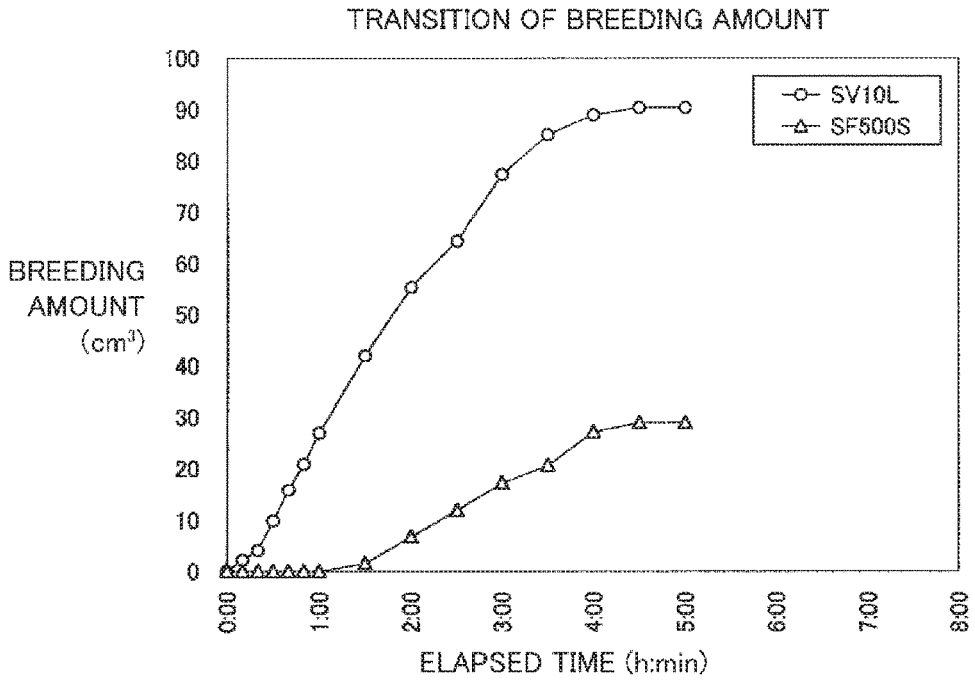

ELATION OF ALUMINUM POWDER ADDITION RATE AND CONCRETE COMPRESSIVE STRENGTH (VALUES OF STRENGTH WITHIN □ AND REDUCTION RATE ARE PREDICTED VALUES)

METHOD FOR BURYING PRECAST PILE

CROSS REFERENCE TO RELATED APPLICATION

This Application is a 371 of PCT/JP2015/071283 filed on Jul. 27, 2015, which, in turn, claimed the priority of Japanese Patent Application No. 2015-141220 filed on Jul. 15, 2015, both applications are incorporated herein by reference.

TECHNICAL FIELD

The present invention relates to a method for burying a precast pile in use of a precast pile.

BACKGROUND ART

Conventionally, as a method for forming a foundation pile of buildings and the like, it is well-known a method for burying a precast pile. Further, as the method for burying a precast pile, it is well-known a pre-boring piling method in which construction is conducted to loosen the ground before burying the precast pile in the underground and a hollow drilling construction method in which the pile is buried while drilling the underground around a top portion of the pile and discharging soil by utilizing a hollow portion of the pile.

First, in the pre-boring piling method, a borehole is constructed at an extent of a predetermined depth while ejecting water for drilling from a top portion of a drill bit in an excavator. Next, the drill bit is repeatedly moved in up and down direction while injecting root consolidation solution in the top portion of the borehole, thereby soil cement is formed by stirring and mixing mud and the root consolidation solution. Further, after the drill bit is pulled out from the borehole, the precast pile is built in the borehole before the soil cement is hardened and the top of the precast pile is settled in the soil cement for root consolidation.

In the other hollow drilling construction method, drilling operation of the ground by the excavator and sinking of the pile are conducted at the same time and such piling method is almost same as the pre-boring piling method in a construction method of the root consolidation portion in which construction is conducted by injecting the root consolidation solution in the borehole.

Using these two kinds of methods, a root consolidation portion is formed at the top portion of the pile by generally filling the cement milk in which cement and water are mixed in the borehole as the root consolidation solution and hardening the cement milk, thereby it is formed construction hardening the supporting ground. Water cement ratio in the cement milk of the supporting pile generally used is usually from 55% to 65% and strength of age for 28 days is controlled to an extent of from 11 to 20 N/mm$^2$.

In the pre-boring piling method, based on an object to integrate a surrounding of the precast pile built in the borehole and a surrounding wall surface of the borehole, the cement milk which has the water cement ratio equal to or greater than that of the root consolidation solution is made into the soil cement obtained by stirring with the drilled soil and the pile surrounding consolidation solution controlled so that the strength of age for 28 days becomes more than 0.5 N/mm$^2$ is filled.

Further, concerning the pile consolidation solution as the root consolidation solution or the pile surrounding consolidation solution, it is well-known various kinds of solutions such as solution in which expanding material is added to the injected cement milk or in which blast furnace slag mixed cement is utilized in the cement milk or in which blast furnace slag cement class B is made main material in the cement milk or in which plaster is utilized. It is disclosed in the following patent literatures a method to increase tip support force of the precast pile by utilizing above solutions.

In the Patent Literature 1, it is disclosed a technology that the root consolidation solution prepared so that expanding agent 4.5~11% of calcium sulfoaluminate type is added to cement paste and water cement ratio against total of cement and expanding agent is made lower than 65%, is expanded in a bulb hardening process, thereby the bulb is pressurized to contact with the ground. According to the technology disclosed in the Patent Literature 1, uniaxial constraint expansion coefficient becomes $45\times10^{-4}$ ($4500\times10^{-6}$) at maximum, thus maximum expansion coefficient becomes to an extent of 4.5%.

Further, in the Patent Literature 2, it is disclosed a technology that the pile surrounding consolidation solution composed of cement in which blast furnace slag fine powder is mixed, water, fine aggregate, anhydrous plaster, thickener, water reducing agent, is filled in pile surrounding of the borehole, thereby adhesion between the pile and the ground is improved. According to the technology disclosed in the Patent Literature 2, since change in length of expansion is made valid until $6000\times10^{-6}$, the maximum expansion coefficient becomes 0.6%.

Furthermore, in the Patent Literature 3, it is disclosed a pile surrounding filling solution mainly composed of blast furnace cement class B and binder including anhydrous plaster and water. According to the technology disclosed in the Patent Literature 3, since expansion amount is made to the extent of 2500 μm ($2500\times10^{-6}$) more than 1200 μm ($1200\times10^{-6}$), the maximum expansion coefficient becomes 0.25%.

CITATION LIST

Patent Literature

PTL1: Japanese Patent Application laid open No. 2000-080647

PTL2: Japanese Patent Application laid open No. 2003-277738

PTL3: Japanese Patent Application laid open No. 2006-283521

SUMMARY OF INVENTION

Technical Problem

In a case that general cement milk and the like is injected in the borehole, when the cement milk is hardened, the soil cement mixed with soil is contracted, thereby slack or clearance will occur between outer surface of the soil cement in the root consolidation portion of the precast pile and inner surface of the borehole.

This slack or clearance leads to decrease of tip support force at the tip side of the precast pile, decrease of circumferential surface frictional force at outer surface of the soil cement in the root consolidation portion of the precast pile and decrease of extraction resistance strength.

In this way, in the conventional methods for burying precast pile, functional decrease in the overall precast pile is brought.

To solve above defects, in each of the patent literatures, although expanding material or plaster is mixed in cement milk or mortar and clearance between outer surface of the precast pile and inner surface of the borehole is filled with expanding material, the expansion coefficient is small such as 0.25% to 0.6%, therefore there will occur a defect that adhesion to the ground is low and the precast pile cannot be sufficiently integrated with the ground.

The present invention has been made while taking the above situations into consideration and has an object to provide a method for burying a precast pile in which cement milk or mortar to which blowing agent having large expansion action is added is injected in a borehole, thereby soil cement, circumferential surface ground and precast pile are firmly integrated based on expansion property larger than those of the conventional methods, therefore increase of tip support force, circumferential surface frictional force and extraction resistance strength can be realized.

Solution to Problem

According to the first embodiment of the invention, it is provided a method for burying a precast pile in which cement milk or mortar is injected in a borehole drilled in ground, soil cement is produced by stirring and mixing the cement milk or the mortar with drilled soil and a precast pile is inserted in the soil cement within the borehole, wherein blowing agent having expanding action is added beforehand to the cement milk or the mortar, wherein the soil cement formed around a base portion of the precast pile in the borehole is expanded and wherein the soil cement is formed in a reverse taper shape or occurs expanding pressure corresponding to the reverse taper shape.

According to the second embodiment of the invention, it is provided the method for burying a precast pile according to the first embodiment, wherein the blowing agent having expanding action foams gas by chemical reaction in cement composition and is composed of one or more selected at least from a group consisting of aluminum powder, powder of amphoteric metal such as zinc and the like, carbon material, peroxide material, sulphonyl hydrazide compound, azo compound, nitroso compound, hydrazine derivatives.

According to the third embodiment of the invention, it is provided the method for burying a precast pile according to the second embodiment, wherein the blowing agent is added so that the expansion coefficient of the cement milk or the mortar becomes in a range of 3% to 16%.

According to the fourth embodiment of the invention, it is provided the method for burying a precast pile according to the third embodiment, wherein addition amount of the aluminum powder as the blowing agent lies in a range of 0.002% to 0.02% against cement mass so that the expansion coefficient of the cement milk becomes in a range of 3% to 16%, or the addition amount of the aluminum powder as the blowing agent lies in a range of 0.007% to 0.04% against the cement mass so that the expansion coefficient of the mortar becomes in a range of 3% to 16%.

According to the fifth embodiment of the invention, it is provided the method for burying a precast pile according to the third embodiment, wherein when drilling depth is deep, addition amount of the aluminum powder as the blowing agent lies in a range of 0.002% to 0.4% against the cement mass so that the expansion coefficient of the cement milk becomes in a range of 3% to 16%, or the addition amount of the aluminum powder as the blowing agent lies in a range of 0.007% to 0.8% against the cement mass so that the expansion coefficient of the mortar becomes in a range of 3% to 16%.

According to the sixth embodiment of the invention, it is provided the method for burying a precast pile according to any one of the first to fifth embodiments, wherein the soil cement includes fiber material.

Advantageous Effects of Invention

According to the first embodiment of the invention, it is provided the method for burying a precast pile in which the cement milk or the mortar is injected in the borehole drilled in the ground and is stirred and mixed with the drilled soil, thereby the soil cement is produced, the precast pile is inserted in the soil cement within the borehole. Further, the blowing agent having expanding action is added beforehand to the cement milk or the mortar and the soil cement formed around the base portion of the precast pile in the borehole is expanded. Thereby, the blowing agent has a large expansion coefficient, thus it can be conducted strong burying of the precast pile. In comparison with the prior soil cement in which expanding material or plaster and the like is mixed, the expanding material in the prior art only having the expansion coefficient less than 0.6% according to which length change of expansion is less than $6000\times10^{-6}$.

That is, in the present invention, the blowing agent is added and expanded, thereby volume of the soil cement is increased and expanding pressure of the soil cement is exerted to the inner wall surface of the borehole. Further, pressure is exerted to the soil cement from the inner wall surface (hole wall ground) of the borehole as reaction force. Further, expanding pressure of the soil cement is exerted to the outer circumferential surface of the precast pile and the reaction force from the precast pile is exerted to the soil cement.

Thereby, slack or clearance existing on a border between the inner wall surface of the borehole and the soil cement is densely filled with the expanding soil cement and slack or clearance existing on a border between the outer circumferential surface of the precast pile and the soil cement is densely filled with the expanding soil cement, thereby adhesion between the soil cement and the precast pile is raised. In addition, there is an effect that these can be integrated while exerting expanding pressure to the hole wall ground of the borehole and it can be constructed strong burying of the precast pile in which the tip support force of the precast pile and the like are raised. Further, since the soil cement is greatly foamed and expanded within the borehole, there is an effect that the tip support force, the circumferential surface frictional force and the extraction resistance force can be increased in comparison with a prior case that the pile consolidation solution of the prior art is injected.

Further, since the soil cement is formed in a reverse taper shape within a range of casting height, the pile with this reverse taper shape produces an effect to push out the ground, therefore there is an effect that the tip support force and the circumferential surface frictional force can be improved. Or in a case that the ground of inner surface of the borehole is hard, based on that the soil cement is hardened while producing expanding pressure of the reverse taper shape, there is an effect that the tip support force, the circumferential surface frictional force and the extraction resistance force can be improved.

According to the second embodiment of the invention, as the blowing agent having expanding action, it is added at least one or more selected from a group consisting of the aluminum powder, powder of amphoteric metal such as zinc and the like, carbon material, peroxide material, sulphonyl hydrazide compound, azo compound, nitroso compound, hydrazine derivatives, which foams gas by chemical reaction in cement composition. In this way, the added cement composition promotes diffusion of the cement by utilizing gas floating force when foaming gas through chemical reaction in the cement composition and occurs sufficient foaming function given to the soil cement, thereby it can be exerted precise and uniform expanding and hardening over whole composition of the soil cement.

Thereby, slack or clearance existing on the border between the inner wall surface of the borehole and the soil cement is densely filled with the soil cement and clearance existing on the border between the outer circumferential surface of the precast pile and the soil cement is densely filled with the soil cement. Further, adhesion of the soil cement and the precast pile can be raised. In addition, there is an effect that these can be integrated while exerting expanding pressure to the hole wall ground of the borehole and it can be constructed the strong burying of the precast pile in which the tip support force of the precast pile. Further, the soil cement is greatly foamed and expanded within the borehole, there is an effect that the tip support force, the circumferential surface frictional force and the extraction resistance force can be increased in comparison with a prior case that the pile consolidation solution of the prior art is injected.

According to the third embodiment of the invention, the blowing agent is added so that the expansion coefficient of the cement milk or the mortar becomes in a range of 3% to 16%. Thereby, it can be produced the soil cement having the expansion coefficient in a range of 1% to 8%

The expansion coefficient 1% set to minimum is more than 1.66 times of the maximum expansion coefficient less than 0.6% disclosed in Patent Literatures 1, 2, 3. Further, since the expansion coefficient of the produced soil cement lies in a range of 1% to 8%, the expanding pressure is further increased corresponding to that expansion of the soil cement is restrained by the hole wall ground of the borehole and expansion is suppressed and the soil cement is firmly integrated with the hole wall ground of the borehole while the expanding pressure is exerted. In the present invention, there is an effect that the tip support force, the circumferential surface frictional force and the extraction resistance force can be increased in comparison with the prior art.

In a case that the expansion coefficient of the cement milk or the mortar to which the blowing agent is added is less than 3%, adhesion among the soil cement within the borehole, the surrounding surface ground and the precast pile becomes weak.

In a case that the expansion coefficient of the cement milk or the mortar to which the blowing agent is added is more than 16%, although adhesion among the soil cement within the borehole, the surrounding surface ground and the precast pile becomes good, the compressive strength decreases.

According to the fourth embodiment of the invention, the addition amount of the aluminum powder as the blowing agent lies in a range of 0.002% to 0.02% against the cement mass so that the expansion coefficient of the cement milk becomes in a range of 3% to 16%, or the addition amount of the aluminum powder as the blowing agent lies in a range of 0.007% to 0.04% against the cement mass so that the expansion coefficient of the mortar becomes in a range of 3% to 16%.

Since there exists a correlation that the expansion coefficient of the cement milk or the mortar almost linearly increases against the cement mass corresponding to addition amount of the aluminum powder, the expansion coefficient of the cement milk or the mortar can be appropriately prepared by addition amount of the aluminum powder.

Therefore, in a case that it is necessary larger expansion coefficient for the cement milk or the mortar, addition amount of the aluminum powder is predictively increased against the cement mass, thereby a predetermined expansion coefficient can be produced.

In this way, based on that the expansion coefficient of the cement milk or the mortar is set to a large value, it can be set the expansion coefficient of the soil cement produced by stirring and mixing with the drilled soil. Thereby, expanding pressure of the soil cement to the hole wall ground of the borehole become larger, therefore there is an effect that the expanding soil cement can be firmly integrated with the hole wall ground of the borehole while exerting expanding pressure.

In a case that addition amount of the aluminum powder is less than 0.02% against the cement mass, the expansion coefficient of the cement milk to which the aluminum powder is added becomes less than 3% and the expansion coefficient of the produced soil cement becomes less than 1%, therefore the expanding soil cement cannot give sufficient expanding pressure to the wall surface of the borehole.

Further, in a case that addition amount of the aluminum powder exceeds 0.02% against the cement mass, the expansion coefficient of the cement milk to which the aluminum powder is added becomes more than 16% and the expansion coefficient of the produced soil cement becomes more than 8%, therefore although adhesion with the circumferential surface ground is raised, decrease in strength becomes large. Thus, it is necessary to increase cement amount to raise strength, therefore material cost becomes high and economy becomes bad.

In a case that the expansion coefficient of the mortar to which the aluminum powder is added is less than 0.007% against the cement mass, the expansion coefficient of the mortar becomes less than 3% and the expansion coefficient of the produced soil cement becomes less than 1%, therefore the expanding soil cement cannot give sufficient expanding pressure to the wall surface of the borehole.

Further, in a case that addition amount of the aluminum powder exceeds 0.04%, the expansion coefficient of the mortar becomes more than 16% and the expansion coefficient of the produced soil cement becomes more than 8%, therefore although adhesion with the circumferential surface ground raises, on the other hand, decrease in strength becomes larger. Thus, it is necessary to increase cement amount to raise strength, therefore material cost becomes high and economy becomes bad.

According to the fifth embodiment of the invention, when drilling depth is deep, addition amount of the aluminum powder as the blowing agent lies in a range of 0.002% to 0.4% against the cement mass so that the expansion coefficient of the cement milk becomes in a range of 3% to 16%, or the addition amount of the aluminum powder as the blowing agent lies in a range of 0.007% to 0.8% against the cement mass so that the expansion coefficient of the mortar becomes in a range of 3% to 16%.

In this way, in a case that the drilling depth is deep and the expansion coefficient of the cement milk in the borehole under high water pressure is set to a range of 3% to 16%, the expansion coefficient of the expanding soil cement by stirring and mixing with the drilled soil can be made in a range of 1% to 8%, therefore the expanding soil cement of the root consolidation portion exerts expanding pressure thereof to the hole wall ground of the borehole, and contrarily receives reaction force from the hoe wall ground, there is an effect that the expanding soil cement can be firmly integrated with the hole wall ground of the borehole while exerting expanding pressure.

In a case that addition amount of the aluminum powder is less than 0.002% against the cement mass, the expansion coefficient of the cement milk to which the aluminum powder is added becomes less than 3% and the expansion coefficient of the produced soil cement becomes less than 1%, therefore the expanding soil cement cannot give sufficient expanding pressure to the wall surface of the borehole.

Further, in a case that addition amount of the aluminum powder exceeds 0.4% against the cement mass, the expansion coefficient of the cement milk becomes larger than 8%, therefore although adhesion with circumferential surface ground raises, on the other hand, decrease in strength becomes large. Thus, it is necessary to increase cement amount to raise strength, therefore material cost becomes high and economy becomes bad.

In a case that addition amount of the aluminum powder is less than 0.007% against the cement mass, the expansion coefficient of the mortar becomes less than 3%, therefore the expansion coefficient of the expanding soil cement becomes less than 1% and the expanding soil cement cannot give expanding pressure to the wall surface of the borehole.

Further, in a case that addition amount of the aluminum powder exceeds 0.8% against the cement mass, the expansion coefficient of the mortar becomes larger than 16%, therefore although adhesion with the circumferential surface ground raises, on the other hand, decrease in strength becomes large. Thus, it is necessary to increase cement amount to raise strength, therefore material cost becomes high and economy becomes bad.

According to the sixth embodiment of the invention, the fiber material is included in the expanding soil cement, therefore there is an effect that the expanding soil cement can improve crack resistance, toughness and strength.

BRIEF DESCRIPTION OF DRAWINGS

FIG. 11 is a list representing materials used in a formulation example 1.

FIG. 12 is a table representing formulation amount of the used materials in the formulation example 1.

FIG. 13 is a list representing fresh test and the expansion coefficient when AL (aluminum powder) addition amount in the formulation example 1 is changed.

FIG. 15 is a graph showing a regression equation of AL addition amount and the expansion coefficient in the formulation example 1.

FIG. 16 is a list representing materials used in a formulation example 2.

FIG. 17 is a table representing ingredients of used materials of the formulation example 2

FIG. 18 is a list representing fresh test and the expansion coefficient when AL addition amount in the formulation example 2 is changed.

FIG. 19 is a graph showing a regression equation of AL addition amount and the expansion coefficient in the formulation example 2.

FIG. 20 is a list representing materials used in a formulation example 3.

FIG. 21 is a table representing ingredients of used materials of the formulation example 3.

FIG. 22 is a list representing results of fresh test of concrete.

FIG. 23 is a list representing fresh test and the expansion coefficient when AL addition amount in the formulation example 3 is changed.

FIG. 24 is a list representing measurement results of AL addition amount and the expansion coefficient.

FIG. 27 is a list representing materials used in a formulation example 4 and 5.

FIG. 28 is a list representing (a) formulation condition/test, (b) used mixer/mixing method.

FIG. 37 is a list representing formulation amount (without AL) of the used materials of formulation example 4 and formulation example 5.

FIG. 38 is a list representing concrete test results in formulation 4 and formulation 5

FIG. 39 is a graph representing breeding amount ($cm^3$) per elapsed time in the formulation example 4 and the formulation example 5.

DESCRIPTION OF EMBODIMENTS

The present method for burying a precast pile is a method for burying a precast pile in which cement milk or mortar is injected in a borehole drilled in the ground and is stirred and mixed with drilled soil, thereby soil cement is produced, thereafter a precast pile is inserted in the soil cement within the borehole. Here, in the cement milk or mortar, blowing agent having expansion action is added beforehand, thereby the soil cement formed around a base portion of the precast pile in the borehole is expanded and the soil cement is formed into a reverse tapered shape or expanding pressure of the reverse tapered shape is produced.

As the blowing agent having expansion action, it is used materials foaming gas by chemical reaction in cement composition, at least it is used one or more selected from aluminum powder, powder of amphoteric metal such as zinc and the like, carbon material, peroxide material, sulphonyl hydrazide compound, azo compound, nitroso compound, hydrazine derivatives.

The blowing agent is added so that the expansion coefficient of the cement milk or mortar becomes in a range of 3% to 16%.

Addition amount of the aluminum powder as the blowing agent is prepared from 0.002% to 0.02% against the cement mass so that the expansion coefficient of the cement milk becomes from 3% to 16%. Further, addition amount of the aluminum powder as the blowing agent is prepared from 0.007 to 0.04% against the cement mass so that the expansion coefficient of the mortar becomes from 3% to 16%.

In a case that drilling depth of the borehole is deep, addition amount of the aluminum powder as the blowing agent is prepared from 0.002% to 0.4% against the cement mass so that the expansion coefficient of the cement milk becomes from 3% to 16%. Further, addition amount of the aluminum powder as the blowing agent is prepared from 0.007 to 0.8% against the cement mass so that the expansion coefficient of the mortar becomes from 3% to 16%.

Fiber material is included in the expansive soil cement.

[Method for Burying Precast Pile]

The embodiment of the present invention will be described in detail with reference to the drawings. As the method for drilling, it will be explained while raising a pre-boring method as one example. Here, as for the precast pile, it will be explained by using a precast concrete pile.

In the following process, although a case of mortar will be described, as for explanation of a case of cement milk, overlapping explanation will be omitted since the similar method is utilized in case of cement milk. Further, in the following explanation, it will be explained a case that the aluminum powder is utilized as the blowing agent.

Figure 1:
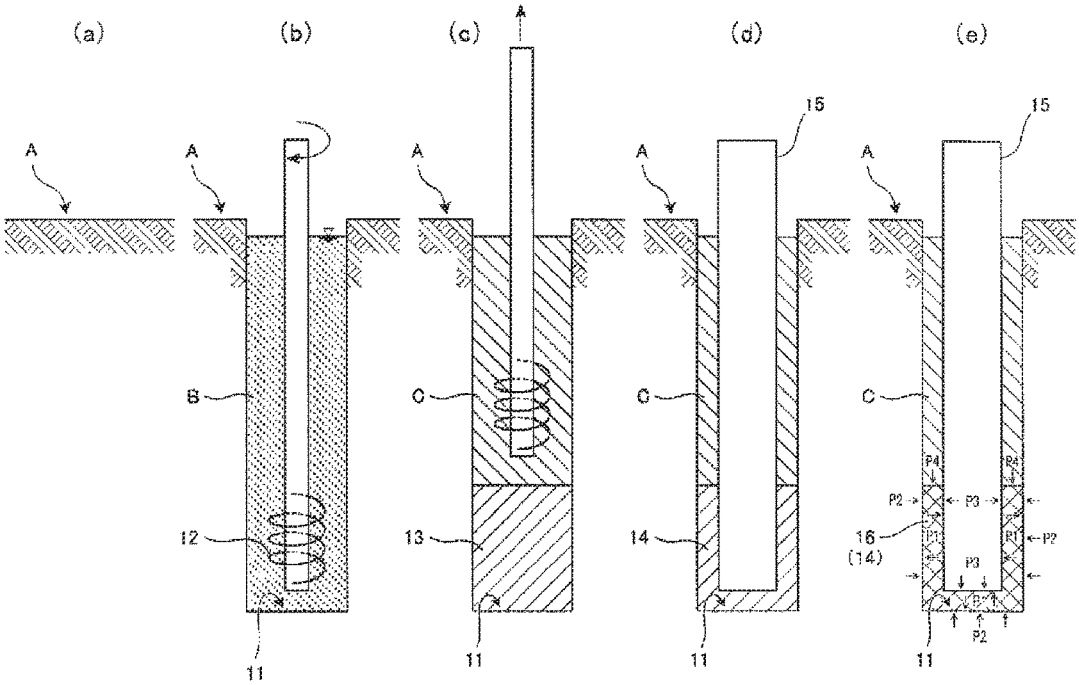
FIG. 1 is a process chart showing a method for burying a precast pile.

As shown in FIG. 1(*a*) and FIG. 1(*b*), an excavator is fixed on the ground surface in which a buried pile is constructed and a borehole 11 is drilled by digging down underground A while injecting drilling fluid such as water and the like from a drill bit 12 of the excavator. In the borehole 11, it is remained drilled soil B which is drilled with the drilling fluid such as water and the like, that is, which becomes muddy and fluidizes by ejecting water and mixing with water.

As shown in FIG. 1(*c*), after the borehole 11 is drilled to a predetermined depth, cement milk or mortar 13 (formed by kneading water to cement (cement milk) or kneading sands as fine aggregate and water to cement (mortar); hereinafter, collectively referred to as mortar 13) to which predetermined aluminum powder as blowing agent having expansion action is injected to a top portion of the borehole 11 (injection means pressurized injection, pressurized ejection or pressurized injection) and filled out. During that time, the drill bit 12 is moved while repeatedly rotating in the up and down direction, thereby soil cement 14 is formed by stirring and mixing the excavated soil with the mortar 13. Further, the drill bit 12 is pulled up while stirring and mixing pile surrounding consolidation solution C within the borehole 11. Here, although the pile surrounding consolidation solution C is injected and filled out in the borehole 11, it may be conceivable that the mortar 13 to which the aluminum powder is added is injected and filled in the injection portion of the pile surrounding consolidation solution C and stirred and mixed, thereby the soil cement is formed and hardened.

As shown in FIG. 1(*d*), the drill bit 12 of the excavator is pulled up from the borehole 11 and a precast concrete pile 15 is inserted in the borehole 11. Further, a tip portion of the precast concrete pile 15 is inserted near the top portion (base portion) of the borehole 11, thereby construction is finished. Here, it may be conceivable that the tip portion of the precast concrete pile 15 is put down to the top portion of the borehole 11 or is separate from the top portion of the borehole 11.

In the borehole 11, soil made muddy and fluidized by drilling and stirring through the drill bit 12 and the mortar 13 to which the aluminum powder of blowing agent are stirred and mixed, thereby become the soil cement 14. Further, the aluminum powder of blowing agent blended in the soil cement, reaction start time of the aluminum powder being appropriately prepared, and the mortar 13 are reacted, thereby hydrogen gas is foamed and volume of the soil cement increases by foaming and expansion. Further, diffusion of cement is promoted by utilizing floating force of hydrogen gas and sufficient foaming function occurs in the soil cement, therefore precise and uniform expansion hardening can be exerted over wholly composition of the soil cement.

Further, the soil cement 14 before hardening relaxes sinking contraction action of cement material by breeding function of cement and prevents clearance from occurring under the lower surface of aggregate such as sands, gravel, thereby there is an effect that adhesion between sands, gravel and the injected mortar can be raised by expanding pressure. Furthermore, there is an effect that it can be prevented slack or clearance tending to be formed near the inner wall surface within the borehole due to self-contraction of the cement from being formed and adhesion of the precast pile 15 and the soil cement 14 can be raised by expanding pressure, further the soil cement can be firmly integrated with surrounding ground while exerting expanding pressure. Here, instead of the mortar, it will occur the similar operational effects in a case of cement milk.

Further, as shown in FIG. 1(*e*), based on that volume of the soil cement is expanded and increased by the action of the blowing agent occurring hydrogen gas foaming of the blowing agent, expanding pressure P1 of the soil cement 14 is added to the inner wall surface of the borehole 11, reaction force P2 is exerted from the inner wall surface of the borehole 11, that is, hole wall ground to the soil cement 14, the expanding pressure P1 of the soil cement 14 is exerted to the precast pile 15 and reaction force P3 from the precast pile 15 is exerted to the soil cement 14. Reference sign P4 is reaction force of the soil cement for the pile surrounding consolidation portion mixed and stirred by the pile surrounding consolidation solution C.

Thereby, clearance existing in a border between the inner wall surface of the borehole 11 and the soil cement 14 is thickly filled with the expanding soil cement 14 and slack or clearance existing in a border between the outer surface of the precast pile 15 and the soil cement 14 is thickly filled with the expanding soil cement 14, thereby adhesion between the soil cement 14 and the precast pile 15 is raised. Further, the soil cement 14 and the precast pile 15 can be integrated while exerting the expanding pressure on the hole wall ground of the borehole, thereby there is an effect that the precast pile burying in which the tip support force of the precast pile and the like is raised can be firmly constructed.

In the soil cement within the borehole, since hydrogen gas of the blowing agent is greatly foamed and expanded, in a root consolidation portion 16 integrated with the precast pile 15 the tip support force, the circumferential surface frictional force and the extraction resistance strength can be increased in comparison with a case that the pile consolidation solution disclosed in the Patent Literature 1 to 3 is injected.

When addition amount of the aluminum powder in the blowing agent is made large amount, the expansion coefficient becomes large. However, generation amount of hydrogen gas becomes large and many fine voids are dispersed with a pore-like state in the soil cement, thereby decrease in strength occurs. Therefore, amount to use of the aluminum powder of the blowing agent is ruled so that a predetermined expansion coefficient is obtained, so the aluminum powder is added so that the expansion coefficient of the blowing agent becomes in a range from 3% to 16%.

Further, addition amount of the aluminum powder as the blowing agent is made from 0.002% to 0.02% against the cement mass so that the expansion coefficient of the cement milk becomes from 3% to 16%. Or addition amount of the aluminum powder as the blowing agent is made from 0.007% to 0.04% against the cement mass so that the expansion coefficient of the mortar becomes from 3% to 16%.

As mentioned, based on that addition amount of the aluminum powder is ruled against the cement mass, the expansion coefficient of the soil cement produced by stirring and mixing with the drilled soil can be made from 1% to 8%, thereby the hole wall ground of the borehole and the soil cement can be firmly integrated while exerting expanding pressure of the soil cement to the hole wall ground of the borehole.

As mentioned in the above, in the method for burying a precast pile, the borehole is formed by drilling the ground while ejecting the drill fluid such as water from the drill bit 12. Inside of the borehole is filled with the drill fluid such as water and the like and the inside of the borehole becomes a saturation state by fluidized soil which is made muddy and the drill fluid. A predetermined position of the drill depth within the bore hole becomes a pressurized state by water pressure corresponding to water depth.

In a case that the drill depth is shallow, pressure force by water pressure becomes small and there is little influence for production of the expanding soil cement. However, in a case that the drill depth is deep, the pressure force by the water pressure becomes large corresponding to the depth. The water pressure of the drill depth is exerted by approximate 1 kg/cm2 per 10 m of the water depth.

For example, 2 atm is exerted under 10 m of the water depth, 3 atm is exerted under 20 m of the water depth, 6 atm is exerted under 50 m of the water depth and 11 atm is exerted under 100 m of the water depth.

Further, according to Boyle's law, when temperature is constant, volume of gas is inversely proportional against magnitude of pressure, thereby the more pressure is applied the smaller volume of gas itself becomes.

Here, although the aluminum powder in the soil cement reacts with cement and produces hydrogen gas, however under high water pressure in the borehole, the deeper drill depth becomes the larger water pressure is exerted. Thereby, volume of hydrogen gas becomes smaller and the expansion coefficient of the soil cement becomes smaller.

Further, in the borehole, since the drill fluid such as water and the like is filled, drilling and stirring are conducted by the drill bit and the inside of the borehole is made in the saturation state with fluidized soil which is made muddy and the drilled fluid, in a case that the specific gravity of the fluidized soil is supposed to 1.8, the pressure corresponding to the drill depth becomes 1.8 times of the water pressure.

Therefore, even in a state that the drill depth becomes deep under high water pressure, to make the expansion coefficient of the cement milk or mortar the same as that under normal pressure, addition amount of the aluminum powder in the blowing agent is determined so that the expansion coefficient of the cement milk or mortar becomes in a range of 3% to 16%.

That is, when the drill depth is deep, addition amount of the aluminum powder under high water pressure may be 2 times of normal pressure under water pressure of drill depth 10 m of the borehole, 6 times of normal pressure under water pressure of drill depth 50 m, about 11 times of normal pressure under water pressure of drill depth 100 m. Further, in a case that the specific gravity of the fluidized soil which is made muddy in the borehole is set to 1.8, based on multiplying 1.8 to each of them, 2 times (of normal pressure)×1.8 (specific gravity of fluidized soil)=3.6 times under the drill depth 10 m, 6 times (of normal pressure)×1.8=10.8 times under the drill depth 50 m, 11 times (of normal pressure)×1.8=19.8 times under the drill depth 100 m. Further, even if addition amount of the aluminum powder is increased, restraint pressure in the borehole proportionally becomes high, thereby it will be considered that uniaxial compressive strength will not be lowered.

Since the drill depth of the method for burying a precast pile is set to the extent of GL-80 m at most, the maximum value of addition amount of the aluminum powder is determined under a condition that the maximum drill depth is supposed to the extent of 100 m.

Therefore, the upper limit value of addition amount of the aluminum powder is set to 0.4% addition rate against the cement mass since addition amount of the aluminum powder becomes from 0.0396 (=0.002%×19.8) to 0.396 (=0.02%×19.8) against the cement mass in a case that the maximum drill depth is made 100 m, so that the expansion coefficient of the cement milk to which the aluminum powder is added becomes from 3% to 16% under the deep depth.

Thus, in a case that the drill depth of the borehole is deep to 100 m, addition amount of the aluminum powder as the blowing agent is set from 0.002% to 0.4% against the cement mass so that the expansion coefficient of the cement milk becomes from 3% to 16%.

Further, the upper limit value of addition amount of the aluminum powder is set to 0.8% addition rate against the cement mass since addition amount of the aluminum powder becomes from 0.1386 (=0.007%×19.8) to 0.792 (=0.04%×19.8) against the cement mass in a case that the maximum drill depth is made 100 m, so that the expansion coefficient of the cement milk to which the aluminum powder is added becomes from 3% to 16% under the deep depth.

Therefore, in a case that the drill depth of the borehole is deep to 100 m, addition amount of the aluminum powder as the blowing agent is set from 0.007% to 0.8% against the cement mass so that the expansion coefficient of the mortar becomes from 3% to 16%.

In this way, when the drill depth is deep, based on that the expansion coefficient of the cement milk or the mortar in the borehole under high water pressure is set to from 3% to 16%, since the expansion coefficient of the produced soil cement is made from 1% to 8%, the expanding soil cement in the root consolidation portion exerts expanding pressure to the hole wall ground and reversely receives reaction force from the hole wall ground, thereby it can be obtained an effect that the expanding soil cement is firmly integrated with the hole wall ground of the borehole while exerting expanding pressure.

In a case that addition amount of the aluminum powder is less than 0.002% against the cement mass, the expansion coefficient of the cement milk to which the aluminum powder is added is less than 3% and the expansion coefficient of the produced soil cement is less than 1%, thus the expanding soil cement cannot sufficiently give expanding pressure to the wall surface of the borehole.

Further, in a case that addition rate of the aluminum powder exceeds 0.4% against the cement mass, the expansion coefficient of the cement milk becomes more than 16%, the expansion coefficient of the produced soil cement becomes more than 8%. Although adhesion with the surrounding surface ground becomes high, on the other hand, decrease in strength becomes large. Thus, to raise strength, it is necessary to increase cement amount, thereby material cost increases and economy becomes bad.

In a case that addition amount of the aluminum powder is less than 0.007% against the cement mass, the expansion coefficient of the mortar to which the aluminum powder is added is less than 3% and the expansion coefficient of the expanding soil cement is less than 1%, thus the produced soil cement cannot sufficiently give expanding pressure to the wall surface of the borehole.

Further, in a case that addition rate of the aluminum powder exceeds 0.8% against the cement mass, the expansion coefficient of the mortar becomes more than 16%, the expansion coefficient of the produced soil cement becomes more than 8%. Although adhesion with the surrounding surface ground becomes high, on the other hand, decrease in strength becomes large. Thus, to raise strength, it is necessary to increase cement amount, thereby material cost increases and economy becomes bad.

Here, when the drill depth is deep and the borehole is under high water pressure, the cement milk or mortar to which the predetermined aluminum powder mentioned above is added can be adopted for methods or various root consolidation portions described hereinafter.

[Another Example of Root Consolidation Portion]

Figure 2:
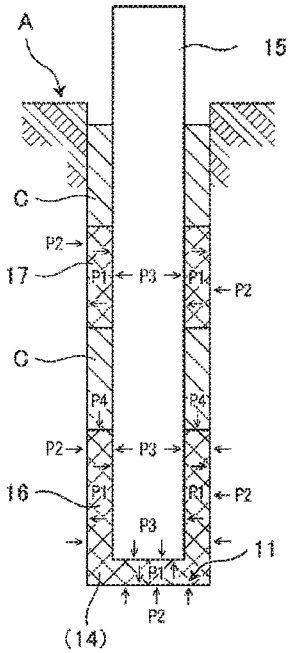
FIG. 2 is a sectional view showing an enlarged pile constructed according to the method for burying a precast pile.

In the pile shown in FIG. 2, the mortar to which the aluminum powder of the blowing agent is added is injected and filled in the top portion of the borehole 11 and the middle portion of the borehole 11 and is stirred and mixed with the drilled soil, thereby the soil cement is formed, the precast pile 15 is inserted in the borehole 11 and the top root consolidation portion 16 and the middle root consolidation portion 17 are constructed. Although not shown, it may be conceivable that the top root consolidation portion and the middle root consolidation portion are formed into one body and the soil cement is formed in this area. Difference between the pile shown in FIG. 2 and the pile shown in FIG. 1(*e*) lies in that process for forming the middle root consolidation portion is added and the other processes excepting the process for forming the middle root consolidation portion are as same as those shown in FIG. 1, thus overlapping explanation will be omitted.

By conducting these processes, further, since the middle root consolidation portion in which the soil cement increasing volume is hardened is also constructed in the middle portion of the borehole, there is further an effect that the support force, the circumferential surface frictional force and the extraction resistance force of the buried pile can be raised, in comparison with the effect of processes shown in FIG. 1(*e*).

Example 1 of Widened Root Consolidation Portion

Figure 3:
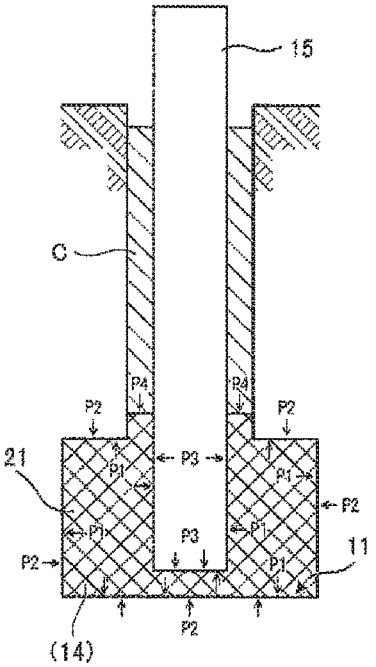
FIG. 3 is a sectional view showing an enlarged pile constructed according to the method for burying a precast pile.
Figure 4:
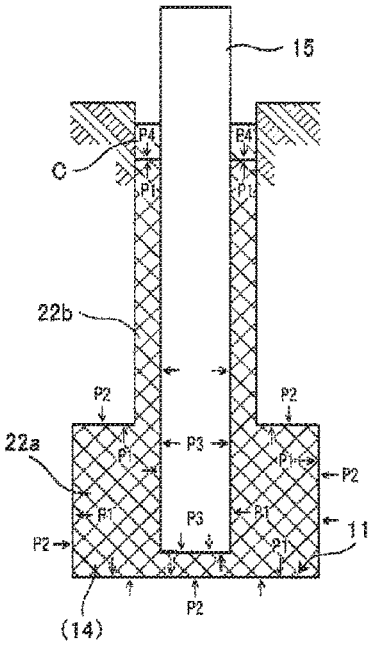
FIG. 4 is a sectional view showing the other example of an enlarged pile constructed according to the method for burying a precast pile.
Figure 5:
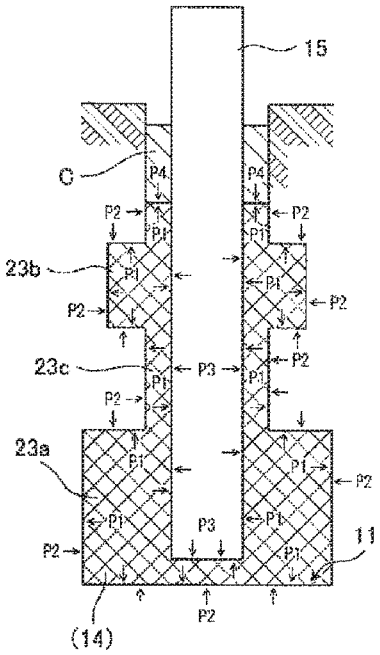
FIG. 5 is a sectional view showing a modification of an enlarged pile constructed according to the method for burying a precast pile.

With reference to FIGS. 3 to 5, it will be described a method for constructing the root consolidation portion integrated with the precast pile by adding the aluminum powder of the blowing agent in the mortar, in an widened portion formed in the top portion of the borehole 11 or the middle portion of the borehole 11.

As shown in FIG. 3, the mortar to which the aluminum powder of the blowing agent is added is injected and filled in the widened portion formed in the top portion of the borehole 11 and stirred and mixed with the drilled soil, thereby the soil cement is formed, the precast pile 15 is inserted in the top portion of the borehole 11 and the widened root consolidation portion 21 is constructed.

That is, a method for forming the widened root consolidation portion will be described.

As the drilling method forming the widened portion (top widened portion) in which the top portion of the borehole 11 is widened, it will be utilized an excavator (not shown) having a drilling expansion bit.

That is, an expansion bit in the pre-boring method forms the widened portion within the borehole 11 by widening the expansion wing.

The top widened portion which is widened than a shaft portion is formed in the top portion of the borehole 11 by the excavator.

Further, the mortar to which the predetermined aluminum powder of the blowing agent is added is injected and filled in the top widened portion of the borehole 11 and stirred and mixed with the drilled soil, thereby the soil cement is formed.

The expansion wing of the excavator is closed and is extracted while injecting and filling the pile consolidation solution in the borehole 11 and the top portion of the precast pile 15 is inserted near the top portion of the borehole 11.

In this way, the mortar to which a predetermined amount of the aluminum powder of the blowing agent is added is injected and filled in the top widened portion, and based on that these are expanded and increased, the expanding pressure P1 of the soil cement is exerted to the inner wall surface of the borehole 11, the reaction force P2 from the hole wall ground of the borehole 11 is exerted to the soil cement, the expanding pressure P1 of the soil cement is exerted to the precast pile 15 and the reaction force P3 from the precast pile 15 is exerted to the soil cement.

Thereby, slack or clearance existing in a border between the outer surface of the precast pile 15 and the soil cement 14 is thickly filled with the expanding soil cement 14, thereby adhesion between the soil cement 14 and the precast pile 15 is raised. Further, slack or clearance existing in a border between the inner wall surface of the borehole 11 and the soil cement 14 is thickly filled with the expanding soil cement 14 and the soil cement 14 and the precast pile 15 can be integrated while exerting the expanding pressure on the hole wall ground of the borehole, thereby the tip support force of the precast pile 15 and the like is increased.

Therefore, the soil cement 14 itself moves to every corner of inner surfaces in the borehole 11 while dispersing bubbles within the bore hole 11, expanding pressure of the soil cement 14 presses the hole wall ground of the bore hole 11, the reaction force thereof exerts pressure to the soil cement 14 and the soil cement 14 is hardened retaining above state. Thereby, the widened root consolidation portion 21 is formed, that is, the soil cement 14 increasing its volume is hardened while exerting large expanding pressure to the hole wall ground of the borehole 11 and the top portion of the precast pile and firmly integrated, therefore the tip support force of the buried pile, the circumferential surface frictional force and the extraction resistance force can be raised.

Example 2 of Widened Root Consolidation Portion

Here, in the buried pile shown in FIG. 3, although the widened portion is formed in the top of the borehole 11, as shown in FIG. 4, it may be conceivable that the soil cement to which the blowing agent is added is further formed from the top end of the widened portion toward the opening direction of the borehole 11 and a widened root consolidation portion 22*a* and a middle root consolidation portion 22*b* are constructed.

By conducting this method, since it is constructed the middle root consolidation portion formed in the middle of the borehole by hardening the soil cement increasing its volume, the support force, the circumferential surface frictional force and the extraction resistance force of the buried pile are further raised in comparison with the effect of the method shown in FIG. 3.

Example 3 of Widened Root Consolidation Portion

As shown in FIG. 5, drilling is conducted through expansion bit in the midway portion of the borehole 11, thereby it is formed the midway widened portion having a large diameter than a diameter of the borehole 11. A plurality of the midway widened portions can be constructed.

Further, as shown in FIG. 5, the mortar 13 to which the predetermined aluminum powder of the blowing agent is added is injected and filled in the top portion, the middle portion and the midway portion in the borehole 11, the soil cement 14 is formed by stirring and mixing with drilled soil, the precast pile 15 is inserted in the borehole 11, thereby the widened root consolidation portion 23*a*, the middle root consolidation portion 23*c* and the midway widened root consolidation portion 23*b* are constructed.

In this way, the mortar to which a predetermined amount of the aluminum powder of the blowing agent is injected and filled in the top widened portion and the midway widened portion, and based on that these are expanded and increased, the expanding pressure P1 of the soil cement is exerted to the inner wall surface of the borehole 11 and the midway widened portion, the reaction force P2 from the hole wall ground of the borehole 11 and the hole wall ground of the midway widened portion is exerted to the soil cement, the expanding pressure P1 of the soil cement is exerted to the outer surface of precast pile 15 and the reaction force P3 from the precast pile 15 is exerted to the soil cement.

Thereby, slack or clearance existing in a border between the outer surface of the precast pile 15 and the soil cement 14 is thickly filled with the expanding soil cement 14, thereby adhesion between the soil cement 14 and the precast pile 15 is raised. Further, slack or clearance existing in a border among the top portion of the borehole 11, the midway portion and the soil cement 14 is thickly filled with the expanding soil cement 14 and the soil cement 14 and the precast pile 15 can be integrated while exerting the expanding pressure, thereby the tip support force of the precast pile 15 and the like is increased.

Therefore, the soil cement 14 itself moves to every corner of inner surfaces in the borehole while dispersing bubbles within the bore hole 11, expanding pressure of the soil cement 14 presses the hole wall ground of the bore hole 11, the reaction force thereof exerts pressure to the soil cement 14 and the soil cement 14 is hardened retaining above state. Thereby, the widened root consolidation portion 23*a*, the middle root consolidation portion 22*c* and the midway root consolidation portion 23*b* are constructed, that is, the soil cement 14 increasing its volume is hardened while exerting large expanding pressure to the hole wall ground of the borehole 11, the top portion of the precast pile, the middle portion and the midway portion are firmly integrated, therefore the tip support force of the buried pile, the circumferential surface frictional force and the extraction resistance force can be raised. Here, in each layer of the widened root consolidation portion 23*a*, the middle root consolidation portion 23*c* and the midway root consolidation portion 23*b*, the blowing agent can be added so that the expansion coefficient becomes different.

[Hollow Drilling Construction Method]

As the drilling method mentioned in the above, although explanation is conducted while raising the pre-boring method as one example, the method as same as the present method for burying a precast pile can be adopted for the hollow drilling construction method.

Figure 6:
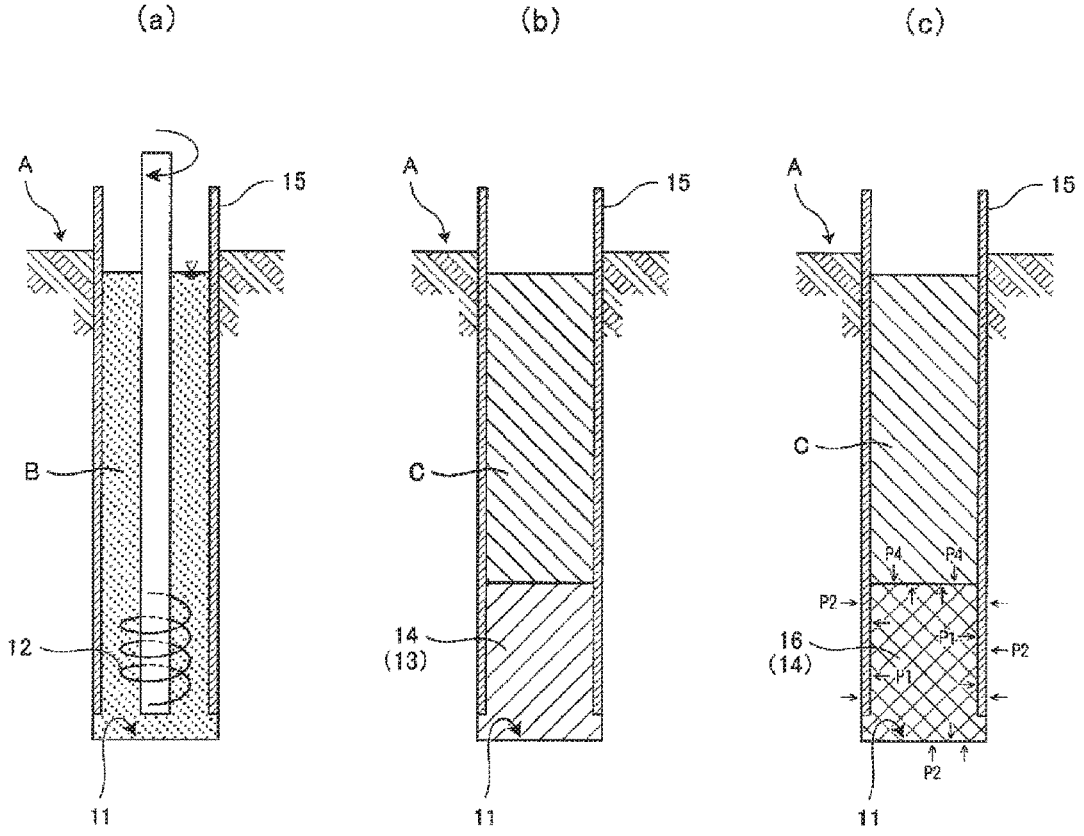
FIG. 6 is a sectional view showing a method for burying a precast pile (hollow drilling construction method).

In the hollow drilling construction method, as shown in FIG. 6(*a*), the excavator is set on the ground surface on which the buried pile is constructed and the precast pile 15 a cross section of which is formed in a cylindrical shape and the drill bit 12 are dug down in the ground A while ejecting drilling fluid such as water, thereby the borehole 11 is drilled.

As shown in FIG. 6(*b*), within the borehole 11, the dilled soil by the drill bit 12 and the mortar 13 to which the aluminum powder of the blowing agent is added are stirred and mixed, thereby the soil cement 14 is formed. The aluminum powder of the blowing agent and the mortar 13 blended in the soil cement mutually react and hydrogen gas is produced, thereby the soil cement foams and volume thereof expands and increases.

As shown in FIG. 6(*c*), volume of the soil cement 14 is increased, the expanding pressure P1 of the soil cement 14 is exerted to the inner wall surface of the borehole 11, the reaction force P2 from the hole wall ground of the borehole 11 is exerted to the soil cement 14, the expanding pressure P1 of the soil cement 14 is exerted to the inner surface of the precast pile 15 and the reaction force P2 from the outer ground of the precast pile 15 is exerted to the soil cement 14.

Thereby, slack or clearance existing in a border between the inner surface of the precast pile 15 and the soil cement 14 is thickly filled with the expanding soil cement 14, thereby adhesion between the soil cement 14 and the precast pile 15 is raised. Further, slack or clearance existing in a border between the inner surface of the borehole 11 and the soil cement 14 is thickly filled with the expanding soil cement 14 and the soil cement 14 and the precast pile 15 can be integrated while exerting the expanding pressure, thereby the tip support force of the precast pile 15 and the like is increased. In this way, in the hollow drilling construction method, it can be obtained the effect as same as that of the pre-boring method.

Here, even in the hollow drilling construction method, it may be utilized a method that after the top portion of the borehole is drilled and widened by the expansion bit and the widened portion is formed, the mortar to which the aluminum powder is added is injected and stirred and mixed, thereby the soil cement is formed, hardened, thus the widened portion is formed Further, although explanation is conducted while raising the mortar as one example in the above embodiment, instead of the mortar, it may be conceivable a mixture that the aluminum powder is added to the cement milk.

Here, in the above method, the precast pile is a steel pile or precast concrete pile. As the steel pile, it can be raised steel pipe pile, H type steel pile, horizontal column pillar and the like. Or as the precast concrete pile, it can be raised PHC pile (Pre-tensioned Spun High Strength Concrete Piles), ST pile (Step Tapered Piles), Joint pile (Nodular Piles), SC pile (Steel Composite Concrete Piles), PRC pile (Pre-tensioned & Reinforced Spun High Strength Concrete Piles), SL pile (Slip Layer Compound Piles) and the like, therefore a predetermined root consolidation portion can be constructed even in the above precast piles other than the precast concrete pile.

In a case that addition amount of the aluminum powder of the blowing agent mentioned above is made large amount, the expansion coefficient becomes large. However, gas generation amount becomes large and many fine voids are dispersed in a pore-like state in the soil cement, thereby decrease in strength occurs. Therefore, amount to use of the aluminum powder of the blowing agent is ruled so that a predetermined expansion coefficient can be obtained.

Thus, the aluminum powder of the blowing agent is added so that the expansion coefficient of the cement milk or mortar becomes in a range from 3% to 16%. In the above embodiment, although only aluminum powder is utilized as the blowing agent, it may be utilized blowing agent composed one or more selected at least from the aluminum powder, amphoteric metal powder such as zinc and the like, carbon material, peroxide substance, sulfonyl hydrazide compound, azo compound, nitroso compound, hydrazine derivatives, as the other blowing agent having expansion action.

In results of following verification test, as for the aluminum powder (celmec P made by Flowric Co. Ltd.) of the blowing agent having expansion action, addition rate of addition amount of the aluminum powder lies in a range of 0.002% to 0.02%. Since correlation of the expansion coefficient of the cement milk almost linearly increases according to that addition amount of the aluminum powder increases, planned expansion coefficient of the cement milk can be obtained on the basis of the predetermined addition amount of the aluminum powder.

Further, to obtain the expansion coefficient of the mortar in a range of 3% to 16%, addition amount of the aluminum powder is set to a range of 0.007% to 0.04% of addition rate against the cement mass. Since correlation of the expansion coefficient of the mortar almost linearly increases according to that addition amount of the aluminum powder increases, planned expansion coefficient of the mortar can be obtained on the basis of the predetermined addition amount of the aluminum powder.

Further, as for strength of the cement milk or mortar to which the aluminum powder of the blowing agent is added, compressive strength is decreased according to amount to use of the aluminum powder of the blowing agent is increased. On the other hand, in correlation between the expansion coefficient and the compressive strength, since compressive strength almost linearly decreases on the basis of increase of the expansion coefficient, decrease in strength can be predicted. Further, strength of the soil cement, which is formed by stirring and mixing the cement milk or mortar to which the aluminum powder of the blowing agent is added and the drilled soil (sand layer, sand gravel layer, gravel layer) and such soil cement is foamed and expanded, can be predicted through binder water ratio (cement/water) similarly to the general concrete.

It is preferable that the aluminum powder of the blowing agent is scaly, has purity more than 99%, has fineness more than 180 mesh and is coated by stearic acid. Further, it is preferable that the aluminum powder is generally compatible with JIS K5906 (aluminum powder for paint), the second standard sieve 88μ, residue less than 2% and chemical reaction time with the cement is appropriately prepared.

The injected cement milk is composed of cement, water and the aluminum powder of the blowing agent. Further, as necessary, it may be mixed fly ash, blast furnace slag fine powder, silica fine powder, bentonite, expanding material, admixture, carbon fiber, metallic wire and the like.

The injected mortar is composed of cement, water, the aluminum powder of the blowing agent and sand as fine aggregate. It may be mixed fly ash, blast furnace slag fine powder, silica fine powder, bentonite, expanding material, admixture, carbon fiber, metallic wire and the like.

Here, as fiber material, for example, it may be utilized steel fiber, binon fiber, carbon fiber, wollastonite fiber and the like, and when such fiber substance is used, it can be improved resistance for crack, toughness, strength of the soil cement.

Although sand is used as fine aggregate, for example, instead of sand, it may be used molten slag including aluminum, metal production origin slag (steel slag, non-ferrous metal slag) and the like.

Cement is normal Portland cement or blast furnace cement and the like and is not especially limited.

Fly ash is mainly constituted from silica or alumina and is ash of byproduct produced when coals are burned in thermal power plant. Further, fly ash is used as admixture or fly ash cement. When good quality fly ash is used, it can be obtained effects of: reduction of unit water amount, improvement of workability, decrease of hydration calorific value, enhancement of strength for long time and durability, improvement of water tightness, improvement of chemical resistance and the like.

Admixture is water reducing agent, high performance water reducing agent, condensation retarder, expansion agent, water retention agent, thickener and the like. Based on that admixture is added to the mortar or cement milk, it can be obtained the following effects.

(1) fluidity becomes good and decrease of fluidity is scarce according to time lapse.

(2) material separation is scarce.

(3) suitable condensation retardation can be obtained.

(4) suitable expansion property is obtained and good adhesion with aggregate can be obtained.

(5) after hardened in restraint (within borehole), required strength, durability and watertightness can be obtained and circumferential surface ground in borehole and precast pile can be integrated.

The aluminum powder of the blowing agent may be used with expanding material. Since expanding material has function to compensate contraction (makes contraction to zero) by hydration or drying of cement composition (soil cement) after hardening, that is, expanding material conducts volume increase beyond compensation of initial contraction till cement composition is hardened by the aluminum powder and compensates contraction of cement composition after hardened by expanding material. Thereby, it can be guaranteed contraction of cement composition over the whole use period.

As the expanding material, not especially limited, it is used material including calcium.sulfone.aluminate mineral which hydrates with cement, water and produces ettringite ($3Cao.Al_2O_3.3CaSO_4.32H_2O$) and expands, and material including lime producing calcium hydroxide ($Ca(OH)_2$) and expanding.

In the present method mentioned above, although explanation is conducted while raising the aluminum powder as one example of the blowing agent, as compound foaming nitrogen gas by chemical reaction in the cement composition as the blowing agent, it can be exemplified sulfonyl hydrazide compound, azo compound, nitroso compound, hydrazine compound. Concretely, it can be exemplified p-toluene sulfonyl hydrazide and benzene sulfonyl hydrazide and the like.

Further, as gas foaming material by chemical reaction in the cement composition, it can be exemplified peroxide substance such as percarbonate, persulfate, perborate, permanganate, hydrogen peroxide and the like and carbon substance and the like.

By using these blowing agents having expanding function, when nitrogen gas or oxygen gas is foamed by chemical reaction in the cement composition, diffusion of cement is promoted by utilizing floating force of gas, sufficient foaming function is given to the soil cement, it can be performed precise expansion hardening over the whole composition of the soil cement.

Further, although blowing agent has sufficient foaming/expansion effect with single material, a plurality of blowing agents may be used in combination.

Hereinafter, while showing one example of formulation, it will be described the expansion coefficient and addition amount of the aluminum powder of the blowing agent.

Formulation Example A

Figure 7:
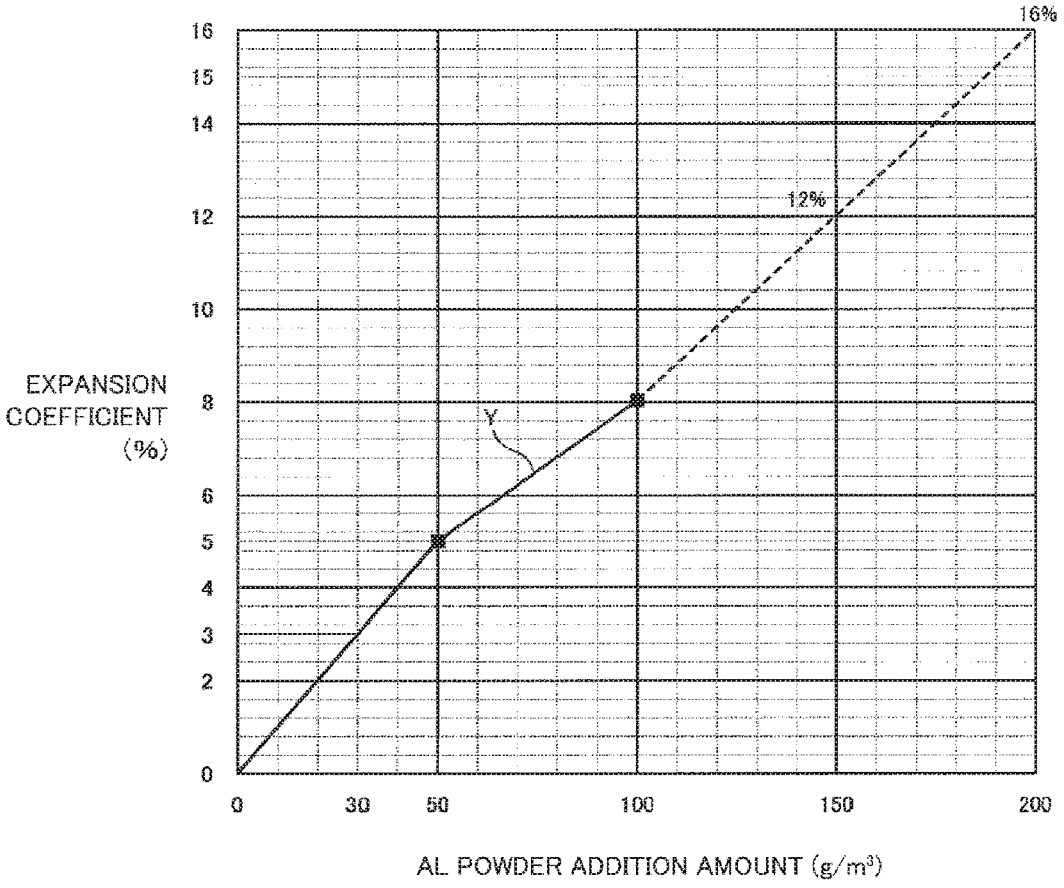
FIG. 7 is a graph showing a relation between blowing agent and the cement milk.

FIG. 7 shows a graph of the expansion coefficient in case that the aluminum powder is added while changing amount thereof to cement paste (water, normal Portland cement, high quality AE water reducing agent standard type) as the cement milk. Formulation example of cement paste and the aluminum powder is shown in table 1.

TABLE 1

| MATERIAL NAME | SPECIFICATION |
|---|---|
| WATER | 7.5 kg (W/C = 30%) |
| NORMAL PORTLAND CEMENT | 25 kg |
| FLOWRIC SF 500S (HIGH QUALITY AE WATER REDUCING AGENT STANDARD TYPE) | 0.2 kg (C × 0.8%) |
| ALUMINUM POWDER (CELMEC P) | 0.8 g (50 g/m$^3$), 1.5 g (100 g/m$^3$) |

Roth flowing time is 25 seconds and addition amount of aluminum powder (Celmec P) is shown in table 2.

TABLE 2

| | | | |
|---|---|---|---|
| ADDITION AMOUNT OF AL POWDER (g/m$^3$) | 0 | 50 | 100 |
| ADDITION AMOUNT OF AL POWDER (g) | 0 | 0.8 | 1.5 |
| EXPANSION COEFFICIENT (%) | 0 | 5 | 8 |

Expansion coefficient test is measured according to expansion coefficient test method (polyethylene bag method) of injected mortar in Japan Society of Civil Engineering (JSCE-F 522) prepacked concrete.

That is, the graph of FIG. 7 shows a relation between addition amount of the aluminum powder of the blowing agent and the expansion coefficient of the cement milk. It is shown the expansion coefficient of the cement milk in each of addition amount of the aluminum powder of the blowing agent 0 g/m$^3$, 50 g/m$^3$, 100 g/m$^3$, 150 g/m$^3$, 200 g/m$^3$. Expansion coefficients in a range of 100 g/m3 to 200 g/m3 of addition amount of the aluminum powder can be obtained from the predictive approximate straight line shown by dotted line.

Since the expansion coefficient of the cement milk has a correlation in which the expansion coefficient almost linearly increases according to increase of addition amount of the aluminum powder against the cement mass, the expansion coefficient becomes 0%, 5%, 8% in each case of 0 g/m$^3$, 50 g/m$^3$, 100 g/m$^3$ of addition amount of the aluminum powder in tale 2. The expansion coefficient in case of 150 g/m$^3$ of addition amount of the aluminum powder becomes 12% from the predictive approximate straight line. The expansion coefficient in case of 200 g/m$^3$ of addition amount of the aluminum powder becomes 16% from the predictive approximate straight line.

When a range of the expansion coefficient of the injected cement milk is set to 3% to 16%, addition amount 30 g/m$^3$ (0.465 g) in case of the expansion coefficient 3% can be predicted from table 2 and FIG. 7 and addition amount 200 g/m$^3$ (3.1 g) in case of the expansion coefficient 16% can be predicted from FIG. 7 and table 2.

Addition amount 0.465 g of the aluminum powder corresponds to addition rate 0.00186% against the cement mass 25 kg. Further, Addition amount 3.1 g of the aluminum powder corresponds to addition rate 0.0124% against the cement mass 25 kg.

Therefore, addition rate of the aluminum powder, according to which the expansion coefficient of the cement milk to which the blowing agent is added becomes 3% to 16%, becomes in a range of 0.00186% to 0.0124% against the cement mass. Addition rate of the aluminum powder in the cement milk is controlled in a range of 0.002% to 0.02% since it exists a property that the lower temperature becomes the slower reaction rate becomes even in the same addition rate and the expansion coefficient becomes small.

In a case that the expansion coefficient of the cement milk or mortar to which the blowing agent is added lies in a range of 3% to 16%, compressive strength due to the expansion coefficient almost linearly decreases, therefore compressive strength is predictable. Since expansion of 1% to 8% is produced according to the expansion coefficient of the produced soil cement, expansion of the soil cement is restricted by the hole wall ground of the borehole. Thus, expanding pressure further increases due to that expansion is suppressed and the soil cement is firmly integrated with the hole wall ground within the borehole while exerting expanding pressure to the hole wall ground and precast pile. Therefore, the tip support force, the circumferential surface frictional force and the extraction resistance force can be increased in comparison with the conventional technology.

In a case that addition rate of the aluminum powder of the cement milk is less than 0.002%, the expansion coefficient of the cement milk to which the aluminum powder is added becomes less than 3%. This cement milk having the expansion coefficient less than 3% is injected in the borehole and the soil cement is produced by stirring and mixing with the drilled soil. The expansion coefficient of this soil cement becomes less than 1%, thus the soil cement cannot give sufficient expanding pressure to the hole wall surface of the borehole. That is, adhesion among the precast pile, the soil cement and the ground becomes weak.

In a case that addition rate of the aluminum powder in the cement milk exceeds 0.02%, the expansion coefficient of the cement milk to which the aluminum powder is added becomes larger than 16%. This cement milk having the expansion coefficient larger than 16% is injected in the borehole and the soil cement is produced by stirring and mixing with the drilled soil. The expansion coefficient of this soil cement becomes larger than 8%, thus the soil cement gives sufficient expanding pressure to the hole wall surface of the borehole. On the contrary, there will be a case that compressive strength of the soil cement greatly decreases. That is, although adhesion among the precast pile, the soil cement and the ground is good, compressive strength decreases.

Formulation Example B

Formulation example B is an example in which the aluminum powder of the blowing agent and the mortar (cement+fine aggregate: sand and the like). In table 3, compounded materials are shown. In table 4, ingredients of compounded materials are shown. In table 5, it is shown expansion coefficients of the mortar in which the aluminum powder of the blowing agent is blended according to table 4.

TABLE 3

| MATERIAL NAME | SPECIFICATION |
|---|---|
| CEMENT | C: NORMAL PORTLAND CEMENT DENSITY: 3.16 g/cm$^3$ |
| EXPANSION MATERIAL | EX: TAIHEIYO HYPER EXSPAN TAIHEIYO MATERIAL |
| THICKENER | V: NONPREACE SHIN-ETSU CHEMICAL CO., LTD. MADE |
| FINE AGGREGATE | S: SAND |
| ADMIXTURE | AD1: AE WATER REDUCING AGENT STANDARD TYPE (FLOWRIC SV10L) AD2: HIGH QUALITY AE WATER REDUCING AGENT STANDARD TYPE (FLOWRIC SF500S) |
| BLOWING AGENT | AL: ALUMINUM POWDER (CELMEC P) FLOWRIC CO., LTD. MADE |
| WATER | W: WATER |

TABLE 4

| FORMULATION NO. | W/(C + EX) (%) | S/(C + EX) | UNIT AMOUNT (kg/m$^3$) W | C | EX | S | V | AD1 | AD2 | AL |
|---|---|---|---|---|---|---|---|---|---|---|
| 1 | 45 | 1.56 | 320 | 681 | 30 | 1113 | 0.6 | 7.11 | 7.11 | 0 |
| 2 | 45 | 1.56 | 320 | 681 | 30 | 1113 | 0.6 | 7.11 | 7.11 | 0.02 |
| 3 | 45 | 1.56 | 320 | 681 | 30 | 1113 | 0.6 | 7.11 | 7.11 | 0.04 |

TABLE 5

| FORMULATION NO. | AL ADDITION AMOUNT (g/m$^3$) | EXPANSION COEFFICIENT (%) | MINI SLUMP FLOW (mm) | MORTAR VOLUME RIGHT AFTER COLLECTION (cc) | MORTAR VOLUME AFTER HARDENED (cc) |
|---|---|---|---|---|---|
| 1 | 0 | 0 | 305 | 445 | 445 |
| 2 | 20 | 1.09 | — | 460 | 465 |
| 3 | 40 | 2.53 | — | 434 | 445 |

Expansion coefficient test is measured according to mortar breeding rate and expansion coefficient test method (polyethylene bag method) of injected mortar in japan society of civil engineering (jsce-f 522) prepacked concrete.

Figure 8:
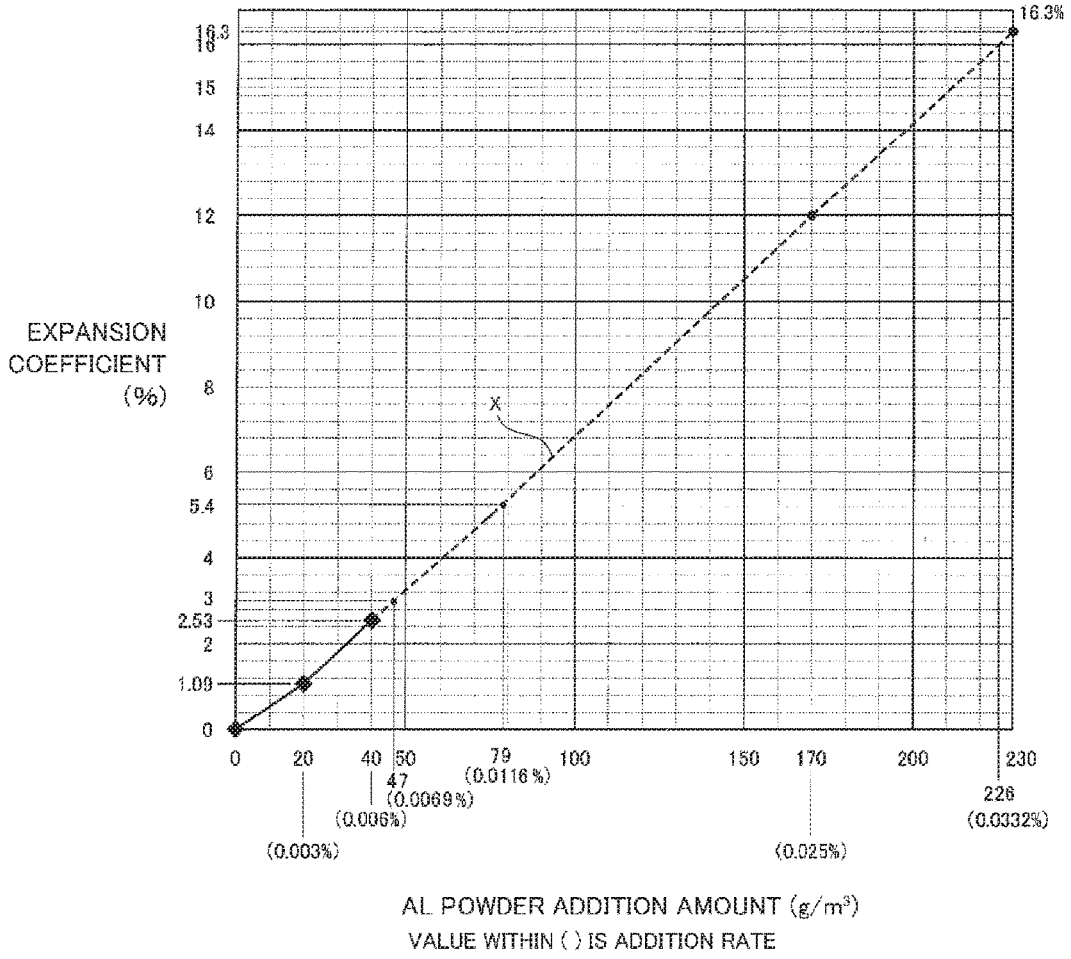
FIG. 8 is a graph showing a relation between the blowing agent and the mortar.

That is, the graph shown in FIG. 8 indicates a relation between addition amount of the aluminum powder of the blowing agent and the expansion coefficient of mortar.

The expansion coefficient of mortar has a correlation in which the expansion coefficient almost linearly increases corresponding increase of addition amount of the aluminum powder against the cement mass.

From table 5, the expansion coefficient in each case of aluminum powder addition amount 0 g/m$^3$, 20 g/m$^3$, 40 g/m$^3$ is 0%, 1.09%, 2.53% and the expansion coefficient in case of aluminum powder addition amount 230 g/m$^3$ is indicated as 16.3% by assuming the predictive approximate straight line. From the predictive approximate straight line, in case of the expansion coefficient 3%, aluminum powder addition amount becomes 47 g/m$^3$ against the cement mass 681 kg/m$^3$ and addition rate becomes 0.0069%.

From the predictive approximate straight line, in case of the expansion coefficient 16%, aluminum powder addition amount becomes 226 g/m$^3$ against the cement mass 681 kg/m$^3$ and addition rate becomes 0.0332%.

When the expansion coefficient of the injected mortar is set to a range of 3% to 16%, aluminum powder addition rate is 0.0069% against the cement mass in case of the expansion coefficient 3% and the aluminum powder addition rate can be predicted to 0.0332% against the cement mass in case of the expansion coefficient 16%.

Therefore, aluminum powder addition rate necessary to obtain the expansion coefficient 3% to 16% of the mortar to which the blowing agent is added lies in a range of 0.0069% to 0.0332% against the cement mass. Thus, since, similar to the cement milk, there exists a property that the slower reaction rate becomes the lower temperature becomes even in the same addition rate and the expansion coefficient becomes small, aluminum powder addition rate of the mortar is controlled as a range of 0.007% to 0.04% against the cement mass.

Here, in a case that aluminum powder addition rate of the mortar is less than 0.007%, the expansion coefficient of the mortar to which the aluminum powder is added becomes less than 3%. Therefore, this mortar having the expansion coefficient less than 3% is injected in the borehole and the soil cement is produced by stirring and mixing with the drilled soil. The expansion coefficient of this soil cement becomes less than 1%, thus the soil cement cannot give sufficient expanding pressure to the hole wall surface of the borehole.

In a case that aluminum powder addition rate of the mortar is larger than 0.04%, the expansion coefficient of the mortar to which the aluminum powder is added becomes larger than 16%. Therefore, this mortar having the expansion coefficient larger than 16% is injected in the borehole and the soil cement is produced by stirring and mixing with the drilled soil. The expansion coefficient of this soil cement becomes larger than 8%, thus the soil cement gives sufficient expanding pressure to the hole wall surface of the borehole. On the contrary, there will be a case that compressive strength of the soil cement greatly decreases.

The method for burying a precast pile of the embodiment according to the present invention will be embodied by the formulation example A or formulation example B mentioned in the above. That is, the cement milk or the mortar with the expansion coefficient in a range of 3% to 16% is injected in the borehole, or the drilled soil, which becomes support layer of sand layer, sand gravel layer or gravel layer forming the root consolidation portion in the borehole, is stirred and mixed with the cement milk or the mortar by the drill bit while injecting the cement milk or the mortar, and the soil cement consolidation portion is formed by the produced soil cement with the expansion coefficient in a range of 1% to 8%. Thereby, the expansion coefficient of expanding soil cement becomes a predetermined expansion coefficient equal to 1% or more and the soil cement is hardened while retaining expanding state.

The hardened soil cement with the expansion coefficient in a range of 1% to 8% exerts expanding pressure to the circumferential surface ground and the base portion surface of the precast pile and the soil cement is filled in slack or clearance between the soil cement and the wall surface of the borehole or base portion surface of the precast pile by expanding pressure and the soil cement is hardened while exerting surplus expanding pressure. Thereby, there is an effect that the circumferential surface frictional force can be improved and the tip support force and the extraction resistance force can be increased.

Figure 43:
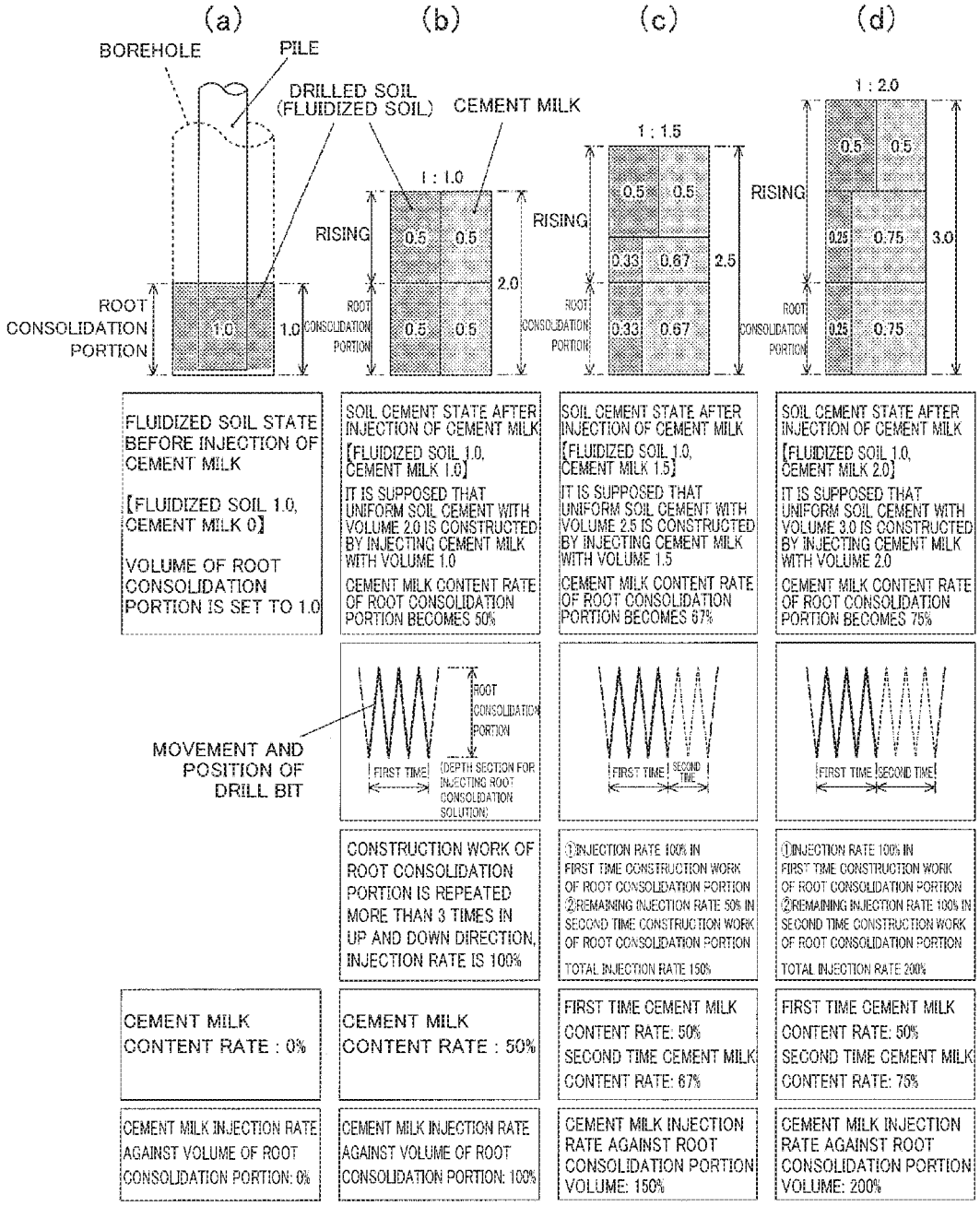
FIG. 43 is an image diagram in which fluidized soil and the cement milk or the mortar are stirred and mixed.

It will be described stirring and mixing of the drilled soil becoming the root consolidation portion and the injected cement milk or the mortar. FIG. 43 is an image view that the fluidized soil and the cement milk or the mortar are stirred and mixed. This view shows an image of the soil cement by stirring and mixing the root consolidation portion based on injection of the cement milk or the mortar and this is a case that soil quality of the top portion is sand, sand gravel (in figure, although actually stirred and mixed, injection ratio is indicated).

For example, as shown in FIG. 43(*b*), as for injection amount of the cement milk or the mortar, to which the aluminum powder of the blowing agent having expansion action is added and which is injected (injection is pressure injection, pressure ejection), against height 1.0 of the root consolidation portion of volume 1.0 of the fluidized soil of the root consolidation portion stirred and fluidized by the drill bit, volume 1.0 of the cement milk or the mortar is injected with injection rate 100%. Next, the soil cement produced by stirring and mixing within height 1.0 of the root consolidation portion is restrained by the wall surface of the borehole and is risen upward of the drilled borehole, thereby the soil cement forms volume 2.0, height 2.0. In the soil cement of volume 2.0, height 2.0 in the root consolidation portion, content ratio of the cement milk or the mortar becomes 50%.

Further, as shown in FIG. 43(*c*), in a case that the injection rate of the cement milk or the mortar is 150%, at first, the cement milk or the mortar corresponding to height 1.0 of injection rate 100% is injected against the fluidized soil with a range of height 1.0 of the root consolidation portion in case of the root consolidation portion volume 1.0. Next, the cement milk or the mortar and the fluidized soil are stirred and mixed within a range of the height 1.0 of the root consolidation portion, thereby the soil cement is formed with volume 2.0 and height 2.0. In the soil cement becoming the root consolidation portion of volume 1.0, height 1.0, content ratio of the cement milk or the mortar becomes 50%.

Continuously, remaining 50% of the cement milk or the mortar forming volume 0.5 is injected within a range of volume 1.0, height 1.0 of the pile top portion forming the root consolidation portion of volume 2.0, height 2.0 of the soil cement already produced and stirred and mixed. Thereby the soil cement is produced. Thus, the soil cement injected with 150% is produced and the soil cement is produced and formed with volume 1.5, height 1.5 and 67% content ratio.

In this way, the produced soil cement of volume 2.5, height 2.5 is formed and a range of the soil cement of volume 1.0, height 1.0 forming the root consolidation portion of the pile top portion is formed with volume 1.5, height 1.5. At that time, content ratio of the cement milk or the mortar becomes 67%.

Further, as shown in FIG. 43(*d*), in a case that injection rate of the cement milk or the mortar is 200%, similar to the case of injection rate 150%, at first, the cement milk or the mortar corresponding to height 1.0 of injection rate 100% is injected with a range of height 1.0 of the root consolidation portion in case of the root consolidation portion volume 1.0. Next, the cement milk or the mortar and the fluidized soil are stirred and mixed, thereby the soil cement is formed with volume 2.0 and height 2.0. In the soil cement becoming the root consolidation portion formed with volume 1.0, height 1.0, content ratio of the cement milk or the mortar becomes 50%.

Continuously, the cement milk of the mortar of volume 1.0 of remaining 100% is injected in a range of volume 1.0, height 1.0 of the pile top portion forming the root consolidation portion of volume 2.0, height 2.0 of the soil cement previously produced and stirred and mixed, thereby the soil cement is formed. Thus. The soil cement injected with 200% is produced and content ratio of the soil cement becomes 75% with volume 2.0, height 2.0 of the soil cement.

In this way, the produced soil cement is formed with volume 3.0, height 3.0 and the range of the soil cement with volume 1.0, height 1.0 forming the root consolidation portion of the pile top portion is formed with volume 2.0, height 2.0, thereby content ratio of the cement milk or the mortar becomes 75%.

The expansion coefficient of the cement milk or the mortar to which the aluminum powder of the blowing agent is added is almost linearly increased corresponding to addition amount of the aluminum powder of the blowing agent, therefore the expansion coefficient can be predicted. Thus, when the cement milk or the mortar to which the aluminum powder of the blowing agent is added is stirred and mixed with the drilled soil, the expansion coefficient of the produced soil cement is also almost linearly increased.

According to this, in a case that the expansion coefficient of the injected cement milk or the mortar is 3%, content ratio of the cement milk or the mortar and content ratio of the aluminum powder becomes 50% under a condition that injection rate of the injected cement milk or the mortar is 100%. Therefore, the expansion coefficient of the soil cement forming the root consolidation portion becomes 3×0.5=1.5% by calculating from the mentioned content ratio 50%.

Further, content ratio of the cement milk or the mortar and content ration of the aluminum powder become 67% under a condition that injection rate of the injected cement milk or the mortal is 150%. Therefore, the expansion coefficient of the soil cement forming the root consolidation portion becomes 3×0.67=2.01% by calculating from the mentioned content ratio 67%.

Further, content ratio of the cement milk or the mortar and the aluminum powder become 75% under a condition that injection rate of the injected cement milk or the mortal is 200%. Therefore, the expansion coefficient of the soil cement forming the root consolidation portion becomes 3×0.75=2.25% by calculating from the mentioned content ratio 75%.

Similarly, in a case that the expansion coefficient of the injected cement milk or the mortar is 16%, content ratio of the cement milk or the mortar and content ratio of the aluminum powder becomes 50% under a condition that injection rate of the injected cement milk or the mortar is 100%. Therefore, the expansion coefficient of the soil cement forming the root consolidation portion becomes 16×0.5=8% by calculating from the mentioned content ratio 50%.

Further, under a condition that the expansion coefficient of the injected cement milk or the mortar is 16% and injection rate is 150%, the expansion coefficient of the soil cement forming the root consolidation portion becomes 16×0.67=10.72% by calculating from the mentioned content ratio 67%.

Further, under a condition that the expansion coefficient of the injected cement milk or the mortar is 16% and injection rate is 200%, the expansion coefficient of the soil cement forming the root consolidation portion becomes 16×0.75=12% by calculating from the mentioned content ratio 75%.

Furthermore, considering on-site construction, safety ratio of the expansion coefficient of the produced soil cement is set to "1.5".

Since the expansion coefficient of the injected cement milk or the mortar is set to a range of 3% to 16%, when injection is conducted with the minimum expansion coefficient 3%, the expansion coefficient of the produced soil cement becomes 1.5% with injection rate 100%. Therefore, it becomes 1.5% (expansion coefficient)÷1.5% (safety ratio) =1%.

Since the expansion coefficient of the produced soil cement becomes 2.01% with injection rate 150%, it becomes 2.01%÷1.5=1.34%.

Since the expansion coefficient of the produced soil cement becomes 2.25% with injection rate 200%, it becomes 2.25%÷1.5=1.5%.

Therefore, the expansion coefficient of the produced soil cement becomes in a range of 1% to 1.5% under a condition that the expansion coefficient of the injected cement milk or the mortar is the minimum 3% and injection rate is 100% to 200%. Therefore, the maximum expansion coefficient of the produced soil cement is set to 1%.

When injection is conducted with the maximum expansion coefficient 16%, the expansion coefficient of the produced soil cement becomes 8% with injection rate 100%. Therefore, it becomes 8%÷1.5=5.33%.

Since the expansion coefficient of the produced soil cement becomes 10.72% with injection rate 150%, it becomes 10.72%÷1.5=7.15%.

Since the expansion coefficient of the produced soil cement becomes 12% with injection rate 200%, it becomes 12%÷1.5=8%.

Therefore, the expansion coefficient of the produced soil cement becomes in a range of 5.33% to 8% under a condition that the expansion coefficient of the injected cement milk or the mortar is the maximum 16% and injection rate is 100% to 200%. Therefore, the maximum expansion coefficient of the produced soil cement is set to 8%.

Therefore, the expansion coefficient of the produced soil cement becomes in a range of 1% to 8% and the soil cement is expanded and formed under a condition that the expansion coefficient of the injected cement milk or the mortar lies in a range of 3% to 16%.

The expansion coefficient of the cement milk or the mortar to which the aluminum powder of the blowing agent is added is almost linearly increased corresponding to addition amount of the aluminum powder of the blowing agent, therefore the expansion coefficient can be predicted and controlled. On the other hand, although when the expansion coefficient becomes large, compressive strength of the hardened cement composition (soil cement) decreases, compressive strength does not greatly decrease in case of restraint condition (wall of borehole). Therefore, decrease in strength can be predicted and controlled.

Formulation Example C

Figure 9:
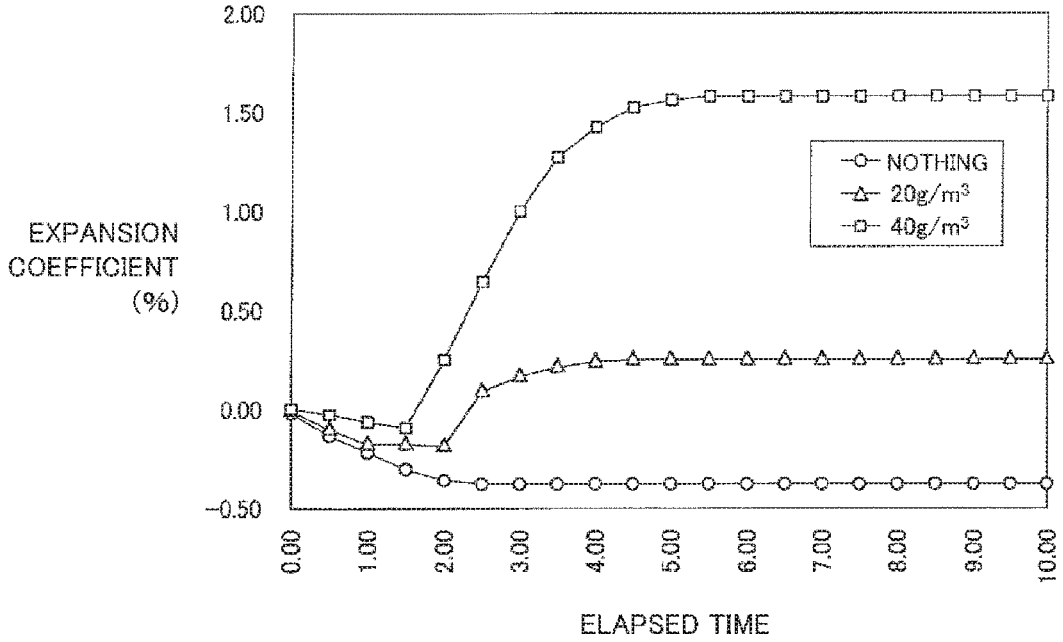
FIG. 9 is a graph showing transition of expansion amount.
Figure 10:
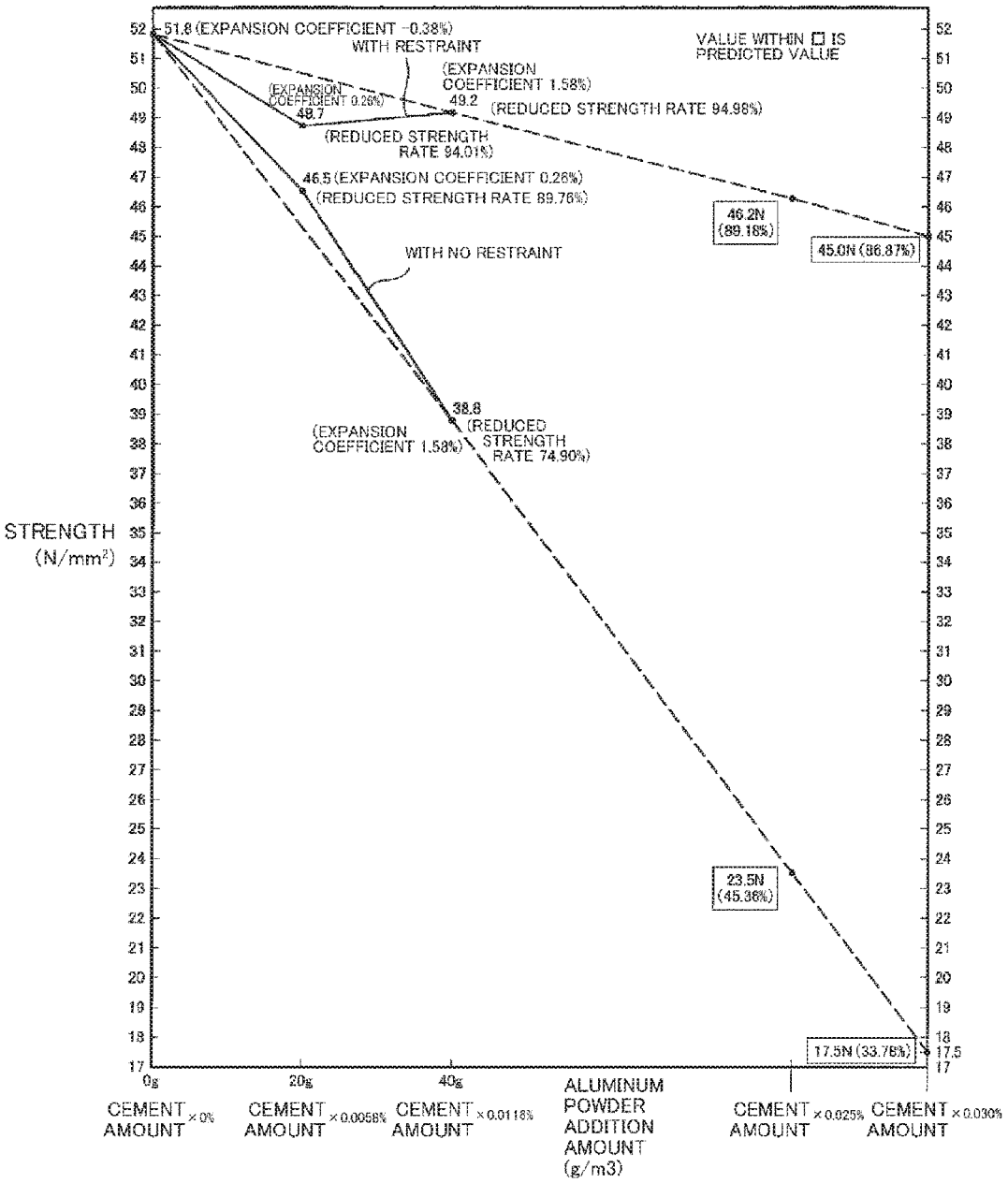
FIG. 10 is a graph showing a relation between aluminum addition amount and strength in both a case without restraint and a case under restraint.

Here, in expansive concrete (slump blend) using normal Portland cement, based on table 6 (used material table), table 7 (concrete formulation table), table 8 (concrete test results), it was conducted verification test of expansive property of concrete and compressive strength in both a case of no restraint and a case of restraint. FIG. 9 is a graph sowing transition of addition rate of the aluminum powder and expansion amount, FIG. 10 is a graph showing a relation between addition amount of the aluminum powder in horizontal axis and strength in vertical axis in both cases of no restraint and restraint.

Cement ratio in cases of aluminum powder addition amount 0 g, 20 g, 40 g against the cement mass 344 kg is calculated as 0%, 0.0058%, 0.0116%. Further, each expansion coefficient corresponding to aluminum powder addition amount becomes −0.38%, 0.26%, 1.58%. Here, water cement ratio is 45%.

Figure 40:
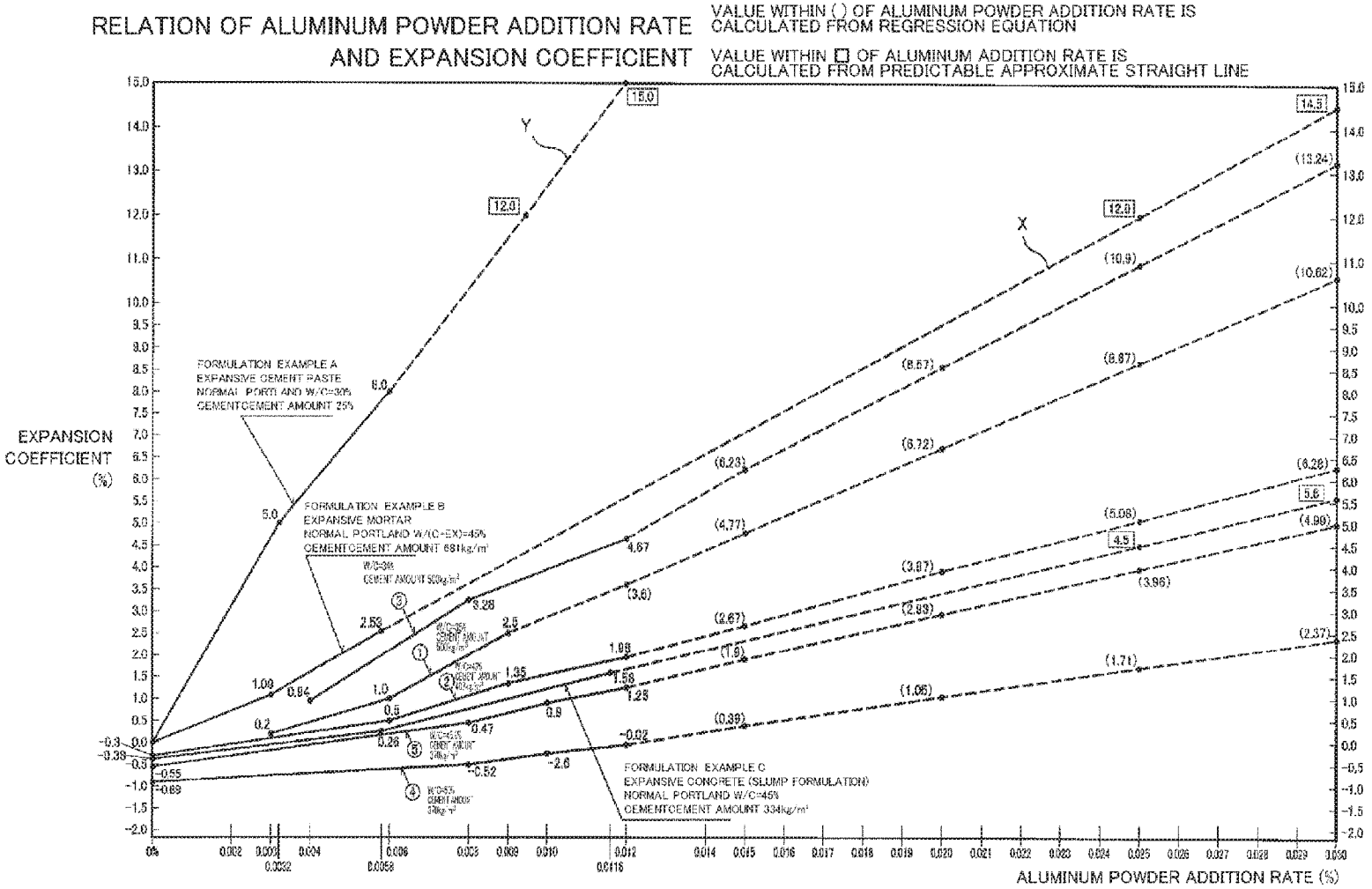
FIG. 40 is a graph representing a relation between the aluminum powder addition amount and the expansion coefficient in formulation examples A, B, C, 1 to 5.

As shown in formulation example C in FIG. 40, the expansion coefficient of concrete to which the aluminum powder is added almost linearly increases corresponding to addition amount of the aluminum powder, therefore when it is desired to obtain a predetermined expansion coefficient, an approximate straight line is predictably drawn, thereby addition amount of the aluminum powder can be calculated.

Therefore, in a case that the aluminum powder is added with addition rate 0.025%, the expansion coefficient of concrete can be predicted as approximate 4.5% from predictable approximate straight line. The expansion coefficient is 5.6% with addition rate 0.030%. Therefore, the expansion coefficient of concrete can be appropriately prepared by addition amount of the aluminum powder.

Considering the graph of FIG. 10, under no restraint, when addition rate of the aluminum powder becomes large, strength almost linearly decreases. It can be predicted: in a case that addition rate of the aluminum powder of the blowing agent is 0.0058%, reduced strength rate becomes 89.76%, and in a case that addition rate of the aluminum powder is 0.0116%, reduced strength rate becomes 74.9%, and in a case that addition rate is 0.025%, reduced strength rate predictably becomes 45.36% and in a case that addition rate is 0.030%, reduced strength rate becomes 33.78%.

Under restraint, it can be predicted: in a case that addition rate of the aluminum powder is 0.0058%, reduced strength rate becomes 94%, and in a case that addition rate of the aluminum powder 0.0116%, reduced strength rate becomes 94.98%, and in a case that addition rate is 0.025%, reduced strength rate predictably becomes 89.18% and in a case that addition rate is 0.030%, reduced strength rate becomes 86.87%.

From this graph, under restraint, it is clear that compressive strength does not greatly decrease.

TABLE 6

USED MATERIALS

| MATERIAL NAME | ORIGIN BRAND NAME | |
|---|---|---|
| CEMENT | C: TAIHEIYO-SUMITOMO-OSAKA-UBE-MISTUBISHI N THREE EQUIVALENTS | DENSITY: 3.16 g/cm$^3$ |
| FINE AGGREGATE | S1: KIMIZU-CITY, CHIBA-PREFECTURE PRODUCTION: MOUNTAIN SAND | DENSITY: 2.63 g/cm$^3$ |
| | S2: KAMISATOMACHI, SAITAMA-PREFECTURE PRODUCTION: LAND SAND | DENSITY: 2.64 g/cm$^3$ |
| COARSE AGGREGATE | G: OUME PRODUCTION: CRUSHED STONE | DENSITY: 2.69 g/cm$^3$ |
| ADMIXTURE | Ad: HIGH QUALITY WATER REDUCING AGENT (FLOWRIC VP 7000) | |
| BLOWING AGENT | ALUMINUM POWDER (CELMEC P) | |

TABLE 7

CONCRETE FORMULATION

| FORMULATION NO. | W/C (%) | S/a (%) | UNIT AMOUNT(kg/m$^3$) W | C | S1 | S2 | G | BLOWING AGENT (AL) |
|---|---|---|---|---|---|---|---|---|
| 45%-12-20N | 45 | 45.4 | 155 | 344 | 413 | 414 | 1014 | 0<br>0.02<br>0.04 |

TABLE 8

CONCRETE TEST RESULTS

| BLOWING AGENT AMOUNT (AL) (g/m$^3$) | SLUMP (cm) | SLUMP FLOW (mm) | AIR AMOUNT (%) | CONCRETE TEMPERATURE (° C.) | EXPANSION COEFFICIENT (%) | RELATIVE DYNAMIC ELASTIC COEFFICIENT | STRENGTH (N/mm$^2$) 7 DAYS | 28 DAYS | 28 DAYS NO RESTRAINT |
|---|---|---|---|---|---|---|---|---|---|
| 0 | 10.7 | 220 × 220 | 4.5 | 20.5 | −0.38 | 65 | 38.8 | — | 51.8 |
| 20 | 12.7 | 235 × 235 | 4.9 | 21 | 0.26 | 90 | 37.9 | 48.7 | 46.5 |
| 40 | 11.5 | 230 × 220 | 5 | 20.5 | 1.58 | — | 36.5 | 49.2 | 38.8 |

COMPRESSION SPECIMEN IS RESTRAINED BY 15 KG WEIGHT UNTIL DEMOLDED NEXT DAY

Expansion is started in about 2 hours and terminated in about 4 to 5 hours (see FIG. 9).

Decrease in strength of specimen in case of no restraint decreases by 25% with the expansion coefficient 1.5%.

Decrease in strength can be suppressed by restraining specimen.

Further, to increase scrutiny, verification test was conducted for transition of the expansion coefficient of expansive concrete and strength corresponding to addition amount of the aluminum powder.

The soil cement of the root consolidation portion is the soil cement, which uniformly expands and is produced by injecting the cement milk or the mortar to which the aluminum powder of the blowing agent is added in the borehole and operating iteratively in up and down direction while injecting and stirring and mixing with sand layer, sand gravel layer, gravel layer through the drill bit. Therefore, this soil cement becomes cement composition close to the mortar and concrete, and thereafter such soil cement is hardened and becomes the root consolidation portion.

Therefore, strength of the soil cement to which the aluminum powder of the blowing agent is added depends upon cement water ratio C/W. Naturally, although strength of the produced soil cement increases when cement content ratio or unit cement amount increases, on the contrary, decrease in strength decrease occurs when the expansion coefficient of the soil cement becomes large. Thus, in the present method, the aluminum powder of the blowing agent is predicted and added so that the expansion coefficient of the injected cement milk or the mortar becomes a range of 3% to 16%, thereby the expansion coefficient and compressive strength of the produced soil cement can be appropriately prepared.

[Verification Test of Expanding Concrete]

Hereinafter, various verification tests of expanding concrete are done and it will be described in detail verification test of expansive concrete to which the aluminum powder of the blowing agent is added. In conducting verification test, five kinds of formulation examples are made and it will be serially explained each formulation example, thereafter consideration will be done.

Formulation Example 1

Figure 14:
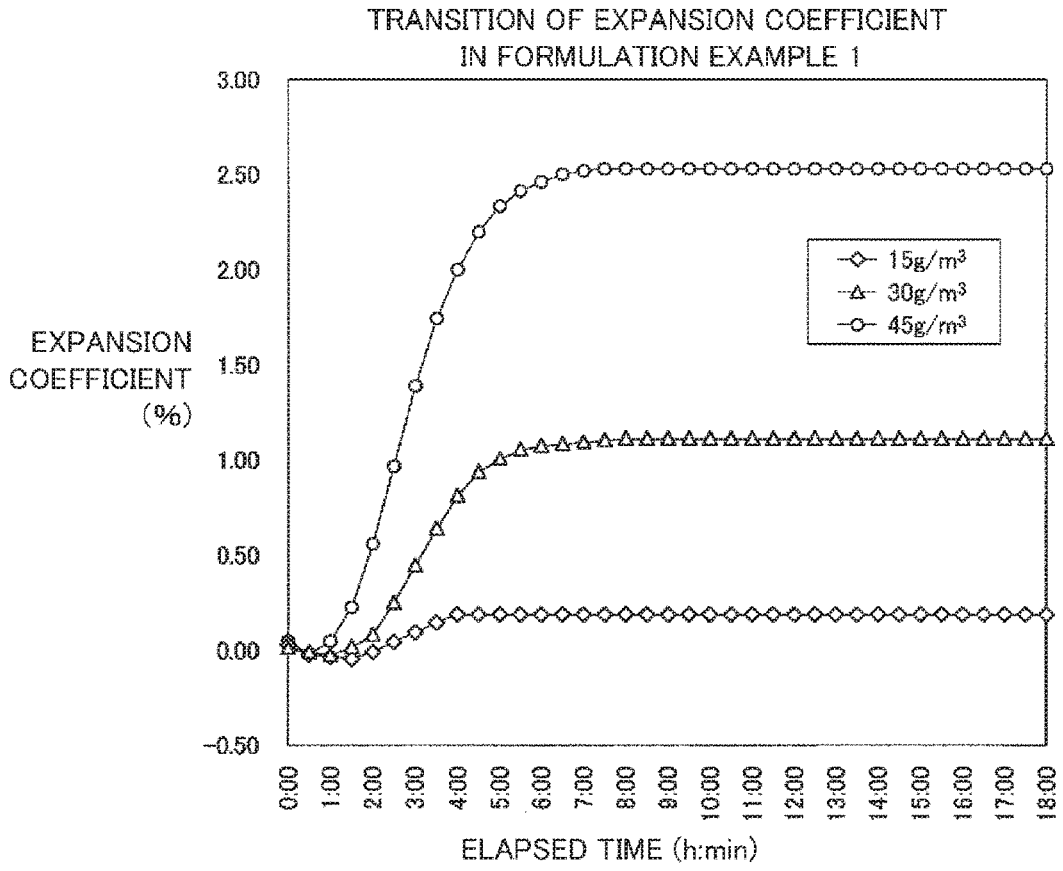
FIG. 14 is a graph showing a relation between the expansion coefficient of the formulation example 1 and elapsed time.

FIG. 11 is a list representing materials used in the formulation example 1, FIG. 12 represents ingredients of materials used in the formulation example 1, FIG. 13 is a list of fresh test, the expansion coefficient when AL (aluminum powder) addition amount is changed in the formulation example 1, FIG. 14 is a graph showing a relation between the expansion coefficient of the formulation example 1 and elapsed time and FIG. 15 is a graph showing a regression equation of AL addition amount and the expansion coefficient in the formulation example 1.

In the formulation example 1, it is shown expansive concrete with high liquidity using normal Portland cement.

As shown in FIG. 13, as for addition rate (cement mass ratio) of the aluminum powder of the blowing agent, when the aluminum powder is added by 15 g, 30 g, 45 g against cement amount 500 kg, cement ratio is respectively calculated as 0.003%, 0.006%, 0.009%. Further, the expansion coefficient corresponding to addition amount of the aluminum powder respectively becomes 0.2%, 1.0%, 2.5%. Here, water cement ratio is 35%.

As shown in FIG. 15, since the expansion coefficient of concrete to which the aluminum powder is added almost linearly increases corresponding to addition amount of the aluminum powder, when it is desired to obtain a predetermined expansion coefficient, addition amount of the aluminum powder can be calculated based on regression equation of addition amount of the aluminum powder and the expansion coefficient $y=0.078x-1.0733$ or approximate straight line predictively drawn.

Therefore, as shown in FIG. 40, it can be predicted from the regression equation: in a case that the aluminum powder is added with addition rate 0.012%, the expansion coefficient of concrete thereof approximately becomes 3.6%, in a case that the aluminum powder is added with addition rate 0.015%, the expansion coefficient of concrete thereof approximately becomes 4.77%, in a case that the aluminum powder is added with addition rate 0.020%, the expansion coefficient of concrete thereof approximately become 6.72%, and in a case that the aluminum powder is added with addition rate 0.025%, the expansion coefficient of concrete thereof approximately becomes 8.67%. When the aluminum powder is added with addition rate 0.030%, the expansion coefficient approximately becomes 10.62%.

Therefore, the expansion coefficient of concrete can be appropriately prepared by addition amount of the aluminum powder.

Formulation Example 2

FIG. 16 is a list representing materials used in formulation example 2, FIG. 17 represents ingredients of materials used in the formulation example 2, FIG. 18 is a list representing fresh test and the expansion coefficient when AL addition amount in the formulation example 2 is changed and FIG. 19 is a graph indicating regression equation of AL addition amount in the formulation example 2 and regression equation of the expansion coefficient.

The formulation example 2 corresponds to expansive concrete with high liquidity using blast furnace cement class B. As shown in FIG. 18, as for addition rate (cement mass ratio) of the aluminum powder of the blowing agent, when the aluminum powder is added by 0 g, 25 g, 37.5 g, 50 g against cement amount 407 kg, cement ratio is respectively calculated as 0%, 0.006%, 0.009%, 0.012%. Further, the expansion coefficient corresponding to addition amount of the aluminum powder respectively becomes −0.3%, 0.5%, 1.35%, 1.98%. Here, water cement ratio is 43%.

As shown in FIG. 19, since the expansion coefficient of concrete to which the aluminum powder is added almost linearly increases corresponding to addition amount of the aluminum powder, when it is desired to obtain a predetermined expansion coefficient, addition amount of the aluminum powder can be calculated based on regression equation of addition amount of the aluminum powder and the expansion coefficient $y=0.0592x-0.9433$ or approximate straight line predictively drawn.

Therefore, as shown in FIG. 40, it can be predicted from the regression equation: in a case that the aluminum powder is added with addition rate 0.015%, the expansion coefficient of concrete thereof approximately becomes 2.67%, in a case that the aluminum powder is added with addition rate 0.020%, the expansion coefficient of concrete thereof approximately becomes 3.87%, and in a case that the aluminum powder is added with addition rate 0.025%, the expansion coefficient of concrete thereof approximately become 5.08%. When the aluminum powder is added with addition rate 0.030%, the expansion coefficient approximately becomes 6.28%.

Concerning this expansion coefficient, real expansion coefficient is (0.3+6.28=) 6.58% since the expansion coefficient is −0.3% with addition amount 0% of the aluminum powder.

Therefore, the expansion coefficient of concrete can be appropriately prepared by addition amount of the aluminum powder.

Formulation Example 3

Figure 25:
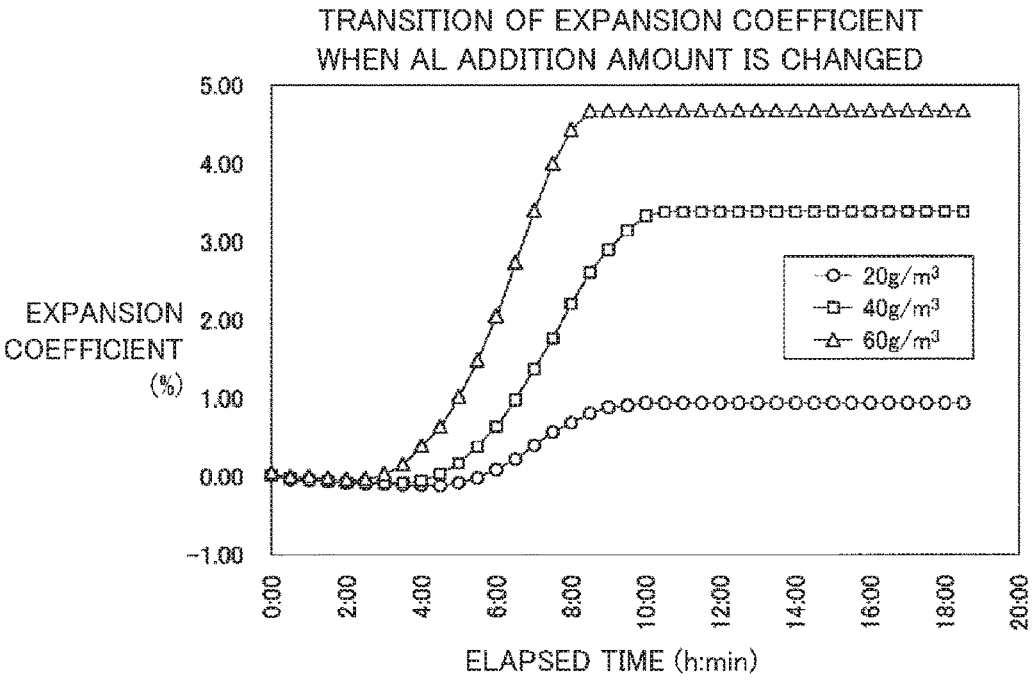
FIG. 25 is a graph showing a relation between the expansion coefficient of the formulation example 3 and elapsed time.
Figure 26:
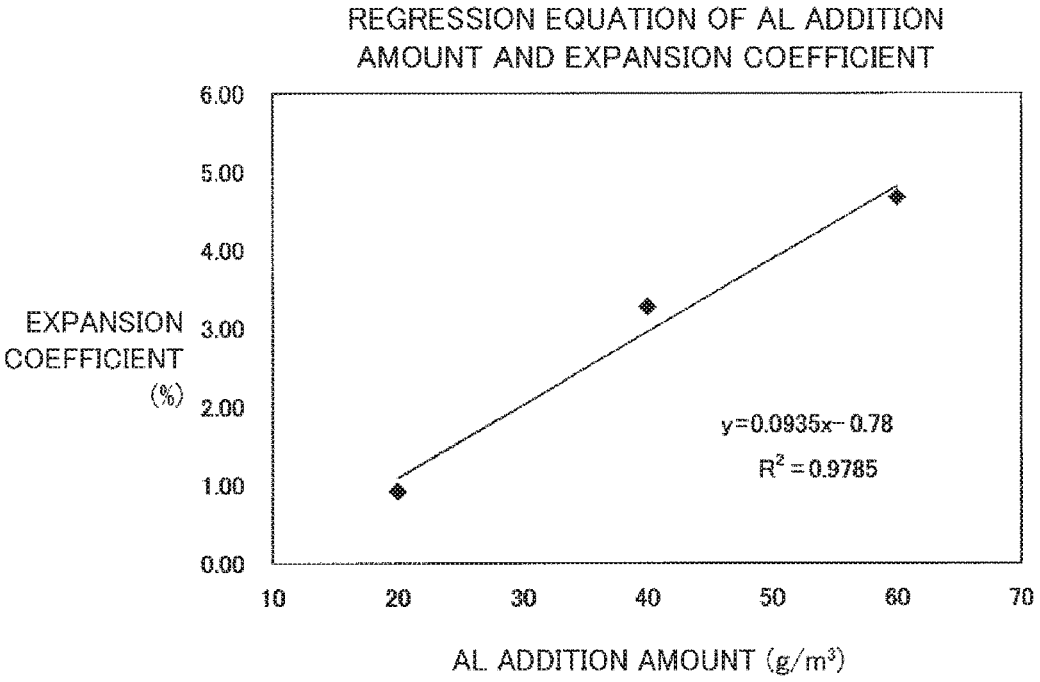
FIG. 26 is a graph showing a regression equation of AL addition amount and the expansion coefficient in the formulation example 3.

FIG. 20 is a list representing materials used in the formulation example 3, FIG. 21 represents ingredients of materials used in the formulation example 3, FIG. 22 is a list representing refresh test results of concrete, FIG. 23 is a list representing refresh test and the expansion coefficient when AL addition amount in the formulation example 3 is changed, FIG. 24 is a list representing AL addition amount and expansion coefficient measurement results, FIG. 25 is a graph showing a relation between the expansion coefficient in the formulation example 3 and elapsed time and FIG. 26 is a graph showing regression equation of AL addition amount in the formulation example 3 and the expansion coefficient.

The formulation example 3 is expansive concrete with high liquidity using low heat Portland cement.

As shown in FIG. 23, as for addition rate (cement mass ratio) of the aluminum powder of the blowing agent, when the aluminum powder is added by 20 g, 40 g, 60 g against cement amount 500 kg, cement ratio is respectively calculated as 0.004%, 0.008%, 0.012%. Further, the expansion coefficient corresponding to addition amount of the aluminum powder respectively becomes 0.94%, 3.28%, 4.67%. Here, water cement ratio is 34%.

As shown in FIG. 26, since the expansion coefficient of concrete to which the aluminum powder is added almost linearly increases corresponding to addition amount of the aluminum powder, when it is desired to obtain a predetermined expansion coefficient, addition amount of the aluminum powder can be calculated based on regression equation of addition amount of the aluminum powder and the expansion coefficient $y=0.0935x-0.78$ or approximate straight line predictively drawn.

Therefore, as shown in FIG. 40, it can be predicted from the regression equation: in a case that the aluminum powder is added with addition rate 0.015%, the expansion coefficient of concrete thereof approximately becomes 6.23%, in a case that the aluminum powder is added with addition rate 0.020%, the expansion coefficient of concrete thereof approximately becomes 8.57%, and in a case that the aluminum powder is added with addition rate 0.025%, the expansion coefficient of concrete thereof approximately become 10.9%. When the aluminum powder is added with addition rate 0.030%, the expansion coefficient approximately becomes 13.24%.

Therefore, the expansion coefficient of concrete can be appropriately prepared by addition amount of the aluminum powder.

Formulation Example 4

Figures 29, 30, 31:
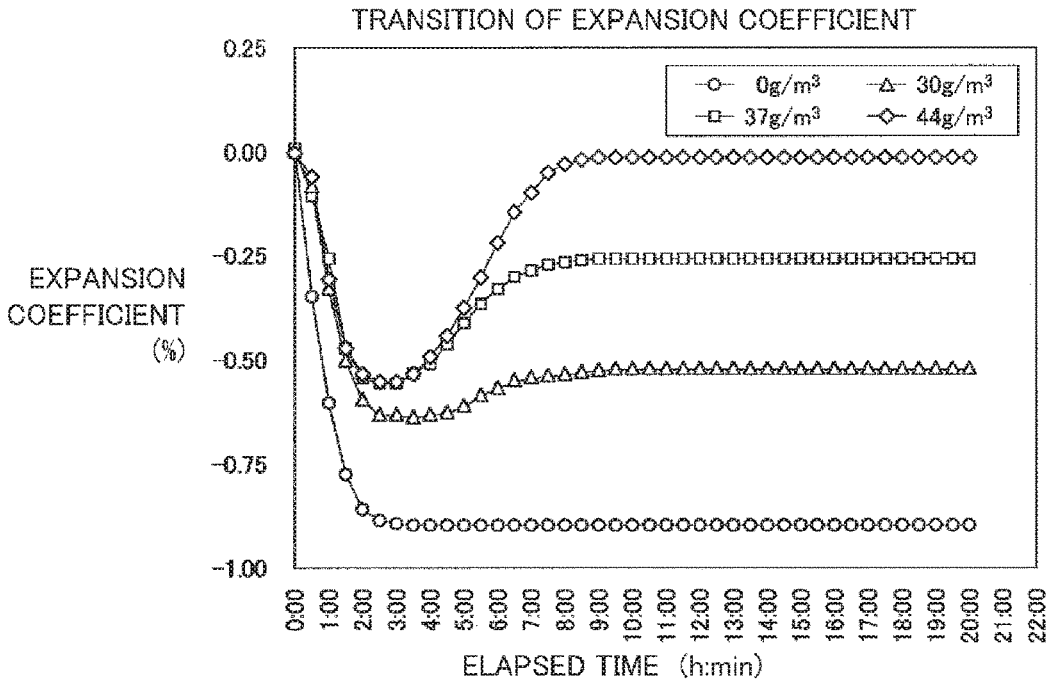
FIG. 29 is a table representing formulation amount of the used materials in the formulation example 4.
FIG. 30 is a list representing fresh test and the expansion coefficient when AL addition amount in the formulation example 4 is changed.
FIG. 31 is a graph showing a relation between the expansion coefficient of the formulation example 4 and elapsed time.
Figures 32, 33, 34:
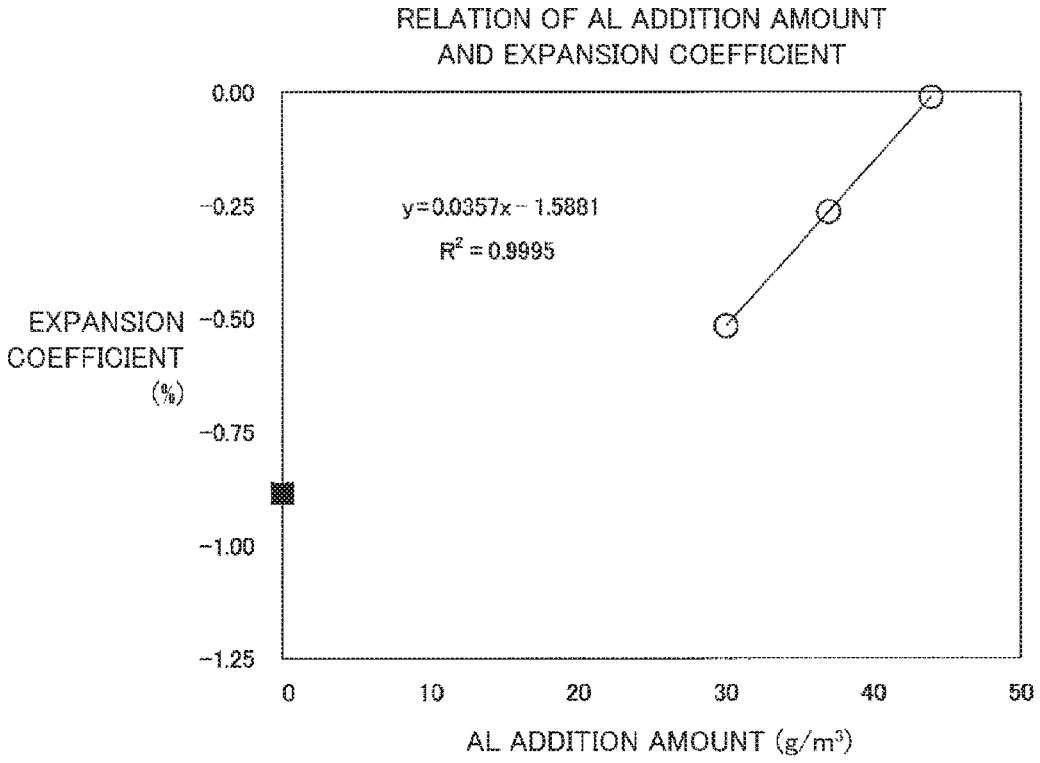
FIG. 32 is a graph showing a regression equation of AL addition amount and the expansion coefficient in the formulation example 4.
FIG. 33 is a list representing formulation amount of the used materials in the formulation example 5.
FIG. 34 is a list representing concrete test results when AL addition amount in the formulation example 5 is changed.

FIG. 27 is a list representing materials used in the formulation examples 4 and 5, FIG. 28 is a list representing (a) formulation condition/test, (b) used mixer/mixing method, FIG. 29 is a list representing ingredients of materials used in the formulation example 4, FIG. 30 is a list representing concrete test results when AL addition amount in the formulation example 4 is changed, FIG. 31 is a graph showing a relation between the expansion coefficient of the formulation example 4 and elapsed time and FIG. 32 is a graph showing regression equation of AL addition amount in the formulation example 4 and the expansion coefficient.

The formulation example 4 is expansive concrete (slump formulation 18 cm) with high liquidity using normal Portland cement. As shown in FIG. 30, as for addition rate (cement mass ratio) of the aluminum powder of the blowing agent, when the aluminum powder is added by 0 g, 30 g, 37 g, 44 g against cement amount 370 kg, cement ratio is respectively calculated as 0%, 0.008%, 0.010%, 0.012%. Further, the expansion coefficient corresponding to addition amount of the aluminum powder respectively becomes −0.89%, −0.52%, −0.26%, −0.02%. Here, water cement ratio is 50%.

As shown in FIG. 32, since the expansion coefficient of concrete to which the aluminum powder is added almost linearly increases corresponding to addition amount of the aluminum powder, when it is desired to obtain a predetermined expansion coefficient, addition amount of the aluminum powder can be calculated based on regression equation of addition amount of the aluminum powder and the expansion coefficient $y=0.0357x-1.5881$ or approximate straight line predictively drawn.

Therefore, as shown in FIG. 40, it can be predicted from the regression equation: in a case that the aluminum powder is added with addition rate 0.015%, the expansion coefficient of concrete thereof approximately becomes 0.39%, in a case that the aluminum powder is added with addition rate 0.020%, the expansion coefficient of concrete thereof approximately becomes 1.05%, and in a case that the aluminum powder is added with addition rate 0.025%, the expansion coefficient of concrete thereof approximately become 1.71%. When the aluminum powder is added with addition rate 0.030%, the expansion coefficient approximately becomes 2.37%.

Since this expansion coefficient is −0.89% with aluminum powder addition rate 0%, real expansive coefficient is (0.89+2.37=) 3.26%.

Therefore, the expansion coefficient of concrete can be appropriately prepared by addition amount of the aluminum powder.

Formulation Example 5

Figure 35:
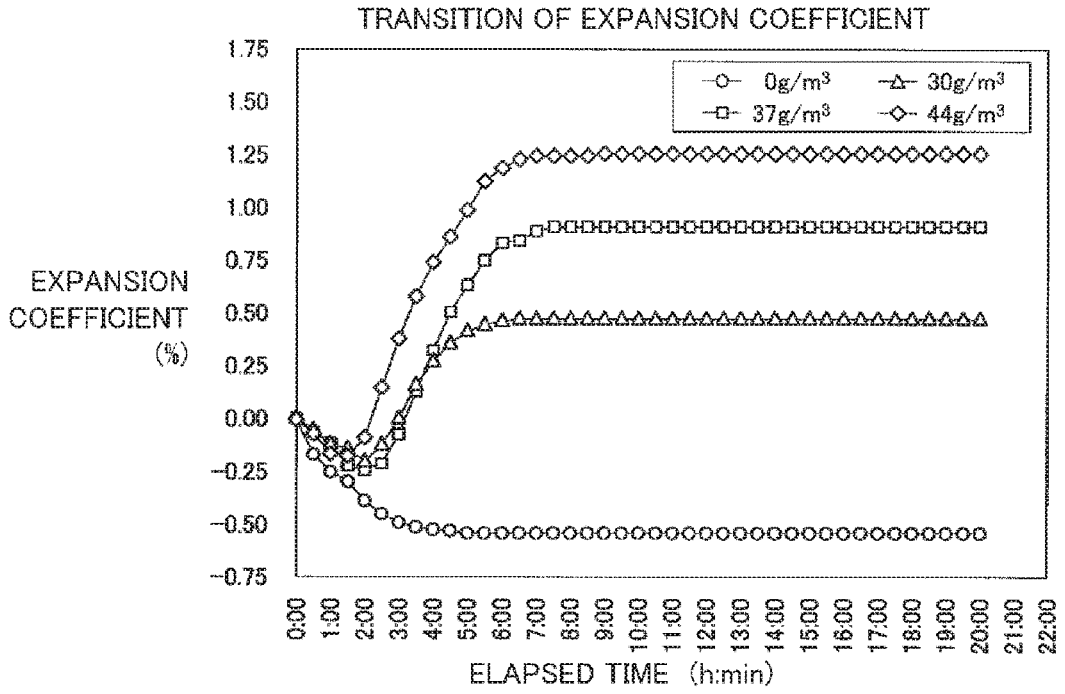
FIG. 35 is a graph showing a relation between the expansion coefficient of the formulation example 5 and elapsed time.
Figure 36:
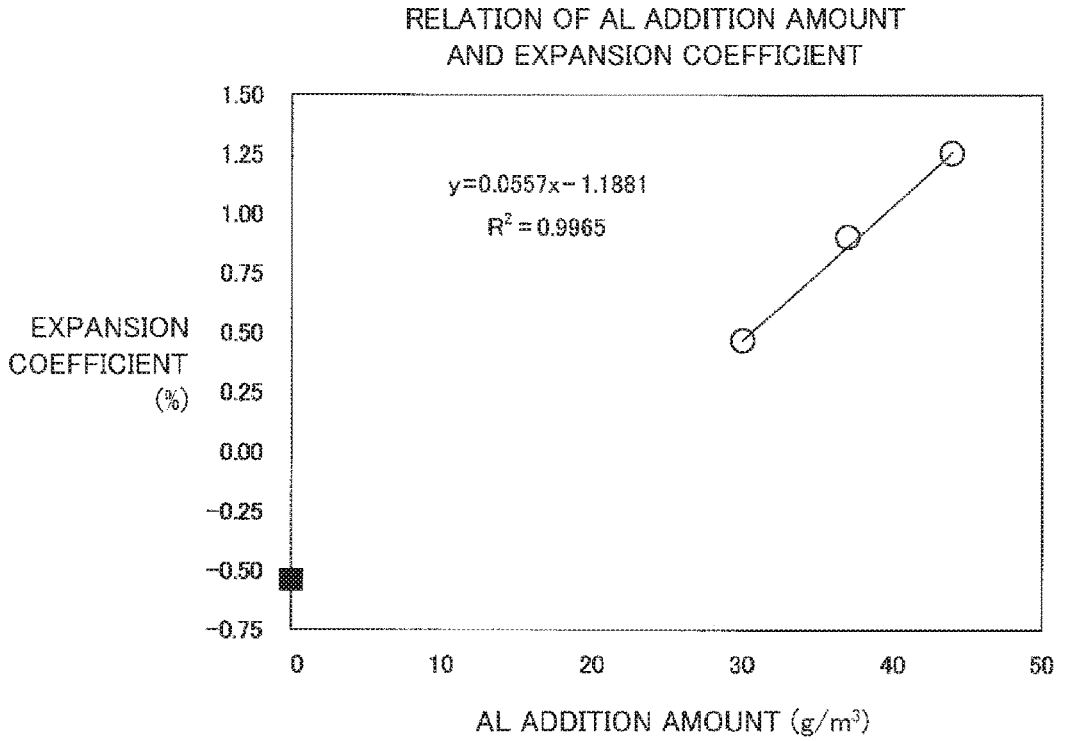
FIG. 36 is a graph showing a regression equation of AL addition amount and the expansion coefficient in the formulation example 5.

FIG. 33 is a list representing materials used in the formulation examples 5, FIG. 34 is a list representing concrete test results when AL addition amount in the formulation example 5 is changed, FIG. 35 is a graph showing a relation between the expansion coefficient of the formulation example 5 and elapsed time and FIG. 36 is a graph showing regression equation of AL addition amount in the formulation example 5 and the expansion coefficient.

The formulation example 5 is expansive concrete (slump formulation 18 cm) with high liquidity using normal Portland cement. As shown in FIG. 34, as for addition rate (cement mass ratio) of the aluminum powder of the blowing agent, when the aluminum powder is added by 0 g, 30 g, 37 g, 44 g against cement amount 370 kg, cement ratio is respectively calculated as 0%, 0.008%, 0.010%, 0.012%.

Further, the expansion coefficient corresponding to addition amount of the aluminum powder respectively becomes −0.55%, 0.47%, 0.90%, 1.25%. Here, water cement ratio is 45.9%.

As shown in FIG. 36, since the expansion coefficient of concrete to which the aluminum powder is added almost linearly increases corresponding to addition amount of the aluminum powder, when it is desired to obtain a predetermined expansion coefficient, addition amount of the aluminum powder can be calculated based on regression equation of addition amount of the aluminum powder and the expansion coefficient y=0.0557x−1.1881 or approximate straight line predictively drawn.

Therefore, as shown in FIG. 40, it can be predicted from the regression equation: in a case that the aluminum powder is added with addition rate 0.015%, the expansion coefficient of concrete thereof approximately becomes 1.9%, in a case that the aluminum powder is added with addition rate 0.020%, the expansion coefficient of concrete thereof approximately becomes 2.93%, and in a case that the aluminum powder is added with addition rate 0.025%, the expansion coefficient of concrete thereof approximately become 3.96%. When the aluminum powder is added with addition rate 0.030%, the expansion coefficient approximately becomes 4.99%.

Since this expansion coefficient is −0.55% with aluminum powder addition rate 0%, real expansive coefficient is (0.55+4.99=) 5.54%.

Therefore, the expansion coefficient of concrete can be appropriately prepared by addition amount of the aluminum powder.

Summary of Formulation Example C, 1 to 5

From verification test from formulation example 1 to 5, the expansion coefficient of concrete expanding based on addition amount of the aluminum powder of the blowing agent can be predicted beforehand and naturally the expansion coefficient can be appropriately prepared by addition amount of the aluminum powder.

Further, in the formulation example 1 and formulation example 3, as shown in FIGS. 14 and 25, initial expansion coefficient is 0% in case of addition rate 0% of the aluminum powder of the blowing agent. As shown in FIG. 12, water cement ratio in the formulation example 1 is 35% and as shown in FIG. 21, water cement ration in the formulation example 3 is 34%.

Therefore, from the formulation examples 1 to 5, water cement ratio against initial expansion coefficient 0% can be speculated from a relation between initial expansion coefficient (when addition rate of the aluminum powder is 0%) and water cement ratio.

Figure 42:
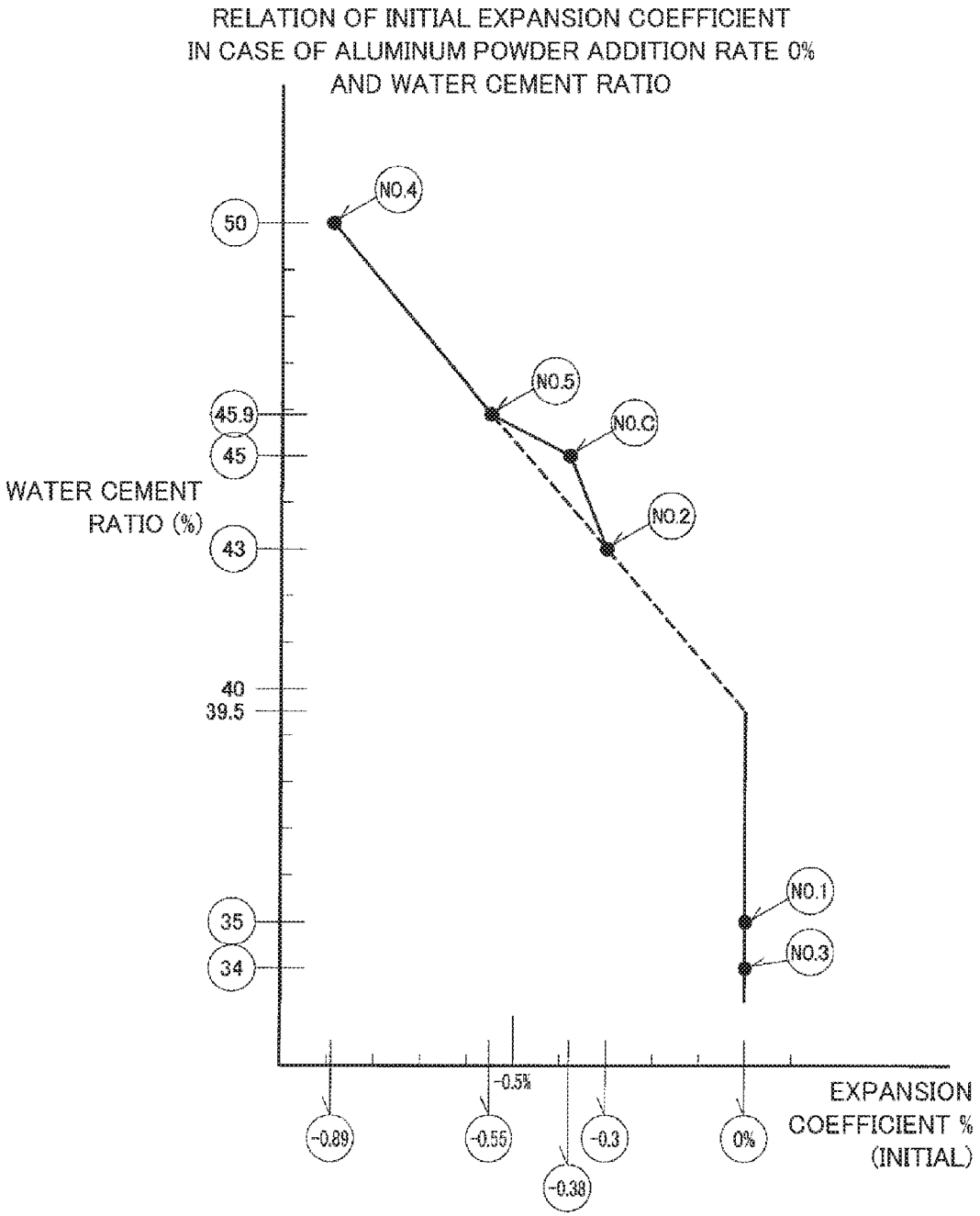
FIG. 42 is a graph representing a relation between initial expansion coefficient in case of 0% of aluminum powder addition amount and water cement ratio in formulation examples C, 1 to 5.

Here, the relation between initial expansion coefficient in case of aluminum powder addition rate 0% and water cement ratio is indicated as a graph in FIG. 42. In FIG. 42, No. 1 indicates a relation of the expansion coefficient 0% of the formulation example 1 and water cement ratio 35%, No. 2 indicates a relation of the expansion coefficient −0.3% of the formulation example 2 and water cement ratio 43%, No. 3 indicates a relation of the expansion coefficient 0% of the formulation example 3 and water cement ratio 34%, No. 4 indicates a relation of the expansion coefficient −0.89% of the formulation example 4 and water cement ratio 50% and No. 5 indicates a relation of the expansion coefficient −0.55 of the formulation example 5 and water cement ratio 45.9%.

As shown in FIG. 42, each plot of initial expansion coefficient of water cement ratio in the formulation examples C, 2, 4, 5 are connected by a straight line and the approximate straight line drawn by dotted line is connected to a point of initial expansion coefficient 0%. Thereby, it can be predictably read out that initial expansion coefficient of concrete (in case of aluminum powder addition rate 0%) is about 39.5% of water cement ratio.

Thereby, as for the formulation examples C, 1 to 5, after blending so that water cement ration becomes 39.5% or less, the aluminum powder of the blowing agent is added, thereby it can be firmly produced the set expansion coefficient of concrete in a state that initial expansion coefficient 0% is made as standard.

Further, breeding test is carried out for formulation examples 4 and 5.

FIG. 37 is a list representing ingredients (no AL) of used materials in both the formulation examples 4 and 5. FIG. 38 is a list representing concrete test results in both the formulation examples 4 and 5 and FIG. 39 is a graph representing breeding amount ($cm^3$) per elapsed time in both the formulation examples 4 and 5.

No. 1 in FIG. 37 is the formulation example 4 using admixture SV10L and No. 2 is the formulation example 5 using admixture SF500S. That is, as shown in FIG. 38, in the formulation example 4 of No. 1, the breeding rate becomes 3.57% in case of the admixture SV10L (AE water reducing agent standard type) C×1.0%, and in the formulation example 5 of No. 2, the breeding rate becomes 1.24% in case of the admixture SF500S (high quality AE reducing agent) C×0.8%.

On the one hand, in a case that the aluminum powder (Celmec P) of the blowing agent is added to the concrete formulation using AE water reducing agent of the admixture, sedimentation amount is cancelled by its expansion since original sedimentation amount is large, therefore expansion amount of concrete becomes finally small.

On the other hand, in a case that the aluminum powder (Celmec P) of the blowing agent is added to concrete formulation using high quality AE water reducing agent of the admixture, unit water amount can be reduced, therefore sedimentation amount becomes small and concrete can be finally expanded by a predetermined amount.

As shown in FIGS. 38 and 39, when the breeding amount of concrete becomes large, sedimentation amount of concrete becomes large. Therefore, expansion amount by the aluminum powder (Celmec P) of the blowing agent becomes small when sedimentation amount of concrete becomes large.

According to the above, based on that amount of high quality AE water reducing agent of the admixture is appropriately determined and used so that the breeding rate of concrete becomes 0%, the expansion coefficient from the initial expansion coefficient 0% can be produced.

Therefore, as for expansion of concrete corresponding to addition amount of the aluminum powder of the blowing agent, it is preferable that amount of the aluminum powder necessary to obtain the set expansion coefficient is appropriately determined so that concrete formulation is conducted base on water cement ratio and initial expansion coefficient 0% suppressing breeding.

Further, to raise the expansion coefficient of concrete, unit cement amount is made large and addition amount of the aluminum powder of the blowing agent is made large, thereby large expansion coefficient can be obtained.

[Verification Test of Concrete Compressive Strength Corresponding to AL Addition Amount]

Figure 41:
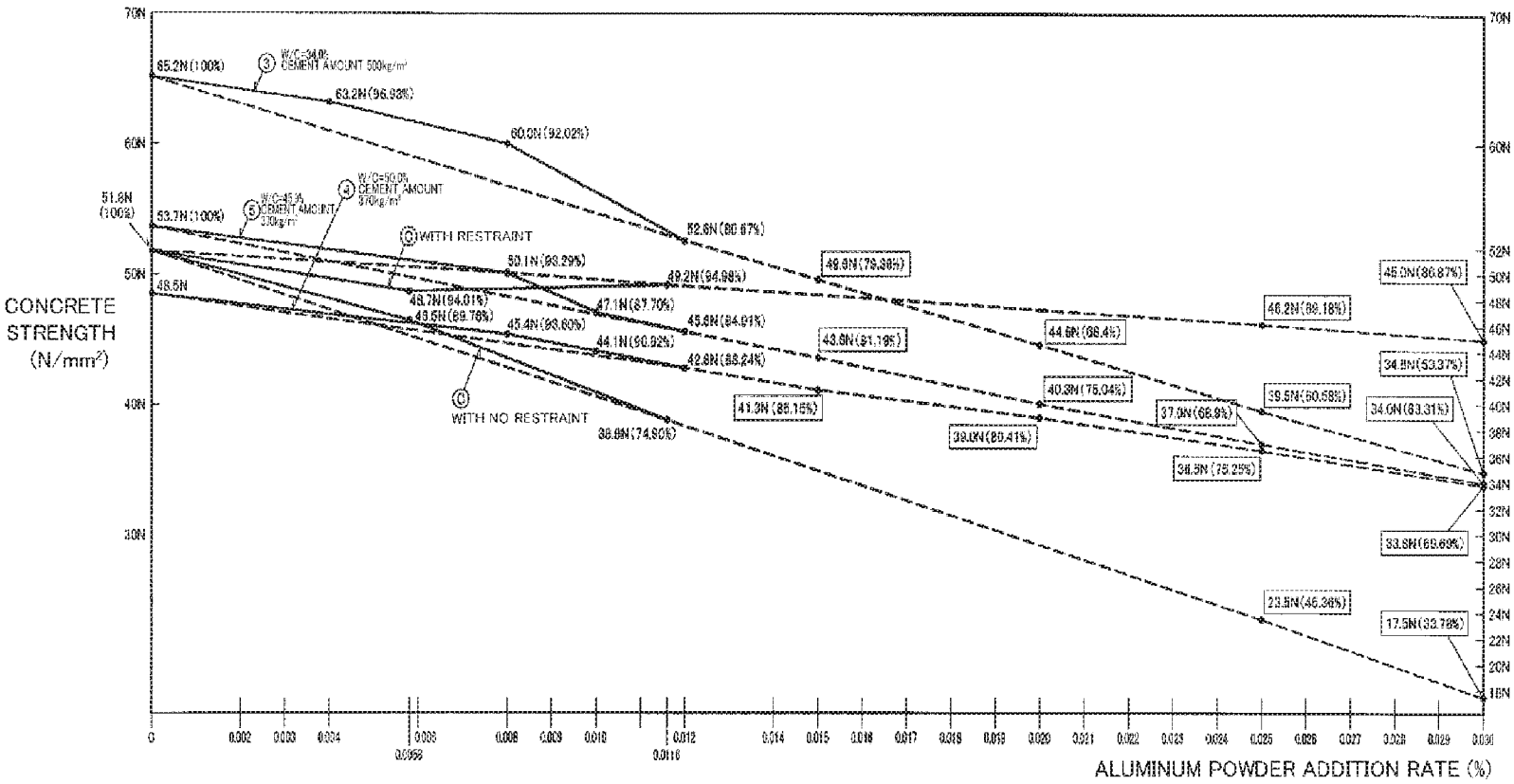
FIG. 41 is a graph representing a relation between the aluminum powder addition amount and concrete compressive strength in formulation examples C, 3, 4, 5.

FIG. 41 is a graph representing a relation of addition rate of the aluminum powder and concrete compressive strength in the formulation examples C, 3, 4, 5.

As shown in FIG. 41, in the formulation examples 3, 4, 5, according to that addition rate of the aluminum powder of the blowing agent increases, reduction of compressive strength almost linearly transits. In a case that addition rate of the aluminum powder is 0.008%, reduction strength rate of the formulation example 3 becomes 92.02%, reduction strength rate of the formulation example 5 becomes 93.29% and reduction strength rate of the formulation example 4 becomes 93.60%. Therefore, in case of aluminum powder addition rate 0.008%, it can be predicted that reduction strength rate becomes about 92% at most.

Further, in a case that aluminum powder addition rate is 0.012%, reduction strength rate of the formulation example 3 becomes 80.67%, reduction strength rate of the formulation example 5 becomes 84.91% and reduction strength rate of the formulation example 4 becomes 88.24%. Therefore, in a case that aluminum powder addition rate is 0.012%, it is predicted that reduction strength rate becomes about 80% and blending plan of aluminum powder addition amount of the blowing agent can be conducted beforehand.

Further, based on that reduction of compressive strength almost linearly transits, in a case that aluminum powder addition rate is predictively 0.015%, it can be presumed that reduction strength rate of the formulation example 3 becomes 79.36%, reduction strength rate of the formulation example 5 becomes 81.19% and reduction strength rate of the formulation example 4 becomes 85.15%. Therefore, in a case that aluminum powder addition rate is 0.015%, it can be predicted that reduction strength rate becomes about 79% at most.

Further, in a case that aluminum powder addition rate is predictively 0.020%, it can be presumed that reduction strength rate of the formulation example 3 becomes 68.40%, reduction strength rate of the formulation example 5 becomes 75.04% and reduction strength rate of the formulation example 4 becomes 80.41%. Therefore, in a case that aluminum powder addition rate is 0.020%, it can be predicted that reduction strength rate becomes about 68% at most.

Further, as shown in the formulation examples 3, 4, 5 of FIG. 41, in a case that aluminum powder addition rate is predictively 0.025%, it can be presumed that reduction strength rate of the formulation example 3 becomes 60.58%, reduction strength rate of the formulation example 5 becomes 68.9% and reduction strength rate of the formulation example 4 becomes 75.25%.

Further, in a case that aluminum powder addition rate is 0.03%, concrete compressive strength and reduction strength rate of the formulation examples 3, 4, 5 can be presumed as follows.

That is, strength of the formulation example 3 becomes 34.8 N/mm$^2$ and reduction strength rate of the formulation example 3 becomes 53.37%. Strength of the formulation example 5 becomes 34.0 N/mm$^2$ and reduction strength rate of the formulation example 5 becomes 63.31%. Strength of the formulation example 4 becomes 33.8 N/mm$^2$ and reduction strength rate of the formulation example 4 becomes 69.69%.

Therefore, in a case that aluminum powder addition rate is 0.025%, it can be predicted from the approximate straight line that reduction strength rate is about 60% at most.

Further, in a case that aluminum powder addition rate is 0.030%, it can be predicted from the approximate straight line that reduction strength rate is about 53% at most.

According to the above, in a case that aluminum powder addition rate is 0.008%, reduction strength rate becomes about 92% at most, in a case that aluminum powder addition rate is 0.012%, reduction strength rate becomes about 80% at most, in a case that aluminum powder addition rate is 0.015%, reduction strength rate becomes about 79% at most, in a case that aluminum powder addition rate is 0.020%, reduction strength rate becomes about 68% at most, in a case that aluminum powder addition rate is 0.025%, reduction strength rate becomes about 60% at most and in a case that aluminum powder addition rate is 0.030%, reduction strength rate becomes about 53% at most. Therefore, in a case that aluminum powder addition rate increases by 0.005%, it can be presumed that concrete strength almost linearly decreases vice versa in a range of about 7% to 11%.

Therefore, correlation exists between aluminum addition amount and cement amount, thus concrete compressive strength corresponding to aluminum powder addition amount can be predicted and compressive strength of the soil cement in cement composition can be also predicted.

It will be described verification test of a case with restraint and a case with no restraint (free expansion) in the formulation example C.

At first, in a case with restraint of the formulation example C, in case of aluminum powder addition rate 0%, concrete strength becomes 51.8 N/mm$^2$. In case of aluminum addition rate 0.0058%, concrete strength becomes 48.7 N/mm$^2$ and strength reduction rate becomes 94.01%. In case of aluminum powder addition rate 0.0116%, concrete strength becomes 49.2 N/mm$^2$ and strength reduction rate becomes 94.98%.

In a case that aluminum addition rate is predictably 0.025%, it can be predicted that concrete strength becomes 46.2 N/mm$^2$ and strength reduction rate becomes 89.18%. In a case that aluminum powder addition rate is predictably 0.030%, it can be predicted that concrete strength becomes 45.0 N/mm$^2$ and strength reduction rate becomes 86.87%.

Based on the above strength relation, in comparison with a case that aluminum powder addition rate is 0.0058%, concrete strength in case of aluminum addition rate 0.116% having addition amount more than the above case slightly increases. Therefore, expansion of concrete due to gas generation is suppressed by existence of formwork, as a result, it is considered that adhesion of aggregate and cement is improved and according to this, strength slightly increases.

However, in a case that aluminum addition rate is predictably 0.025%, it can be predictably presumed that strength reduction rate becomes 89.18% and it can be presumed that strength reduction rate becomes 86.87% in case of aluminum powder addition rate 0.030%. Further, strength reduction becomes flat, as a result, it is considered that restraint state is very sufficiently formed in cases with restraint than the other formulation examples 3, 4 and 5.

As mentioned, in the method for burying a precast pile according to the present invention, decrease in strength of the soil cement can be made at least flat state by setting the expanding soil cement under a restraint state (within borehole). That is, decrease in strength by expansion can be reduced in the soil cement of the root consolidation portion.

Contrarily, in case with no restraint in the formulation example C, concrete strength greatly decreases corresponding increase of aluminum powder addition amount.

Decrease in strength in case with no restraint in the formulation example C indicates a relation of almost straight line and in case of aluminum powder addition rate 0.0058%, strength reduction rate becomes 89.76%. In case of aluminum powder addition rate 0.0116%, strength reduction rate becomes 74.9%. Predictively, in case of aluminum powder addition rate 0.025%, it can be presumed that strength reduction rate becomes 45.36%. Predictively, in case of aluminum powder addition rate 0.030%, it can be presumed that strength reduction rate becomes 33.78% and strength is greatly decreased to 17.5 N/mm$^2$.

Further, in case of aluminum addition rate 0.030%, it will be compared the case with no restraint in the formulation example C with the case with restraint in the formulation example C. The strength reduction rate 33.78% of the case with no restraint in the formulation example C is about 1/2.5 of the strength reduction rate 86.87% (33.78÷86.87×100=) of the case with restraint in the formulation example C and becomes about ½ of the strength reduction rate 69.69% (33.78÷69.69×100=) in the formulation example 4. Therefore, although great compressive strength difference exists between the case with no restraint and the case with restrain, since the soil cement of the root consolidation portion is firmly restrained by wall surface of the borehole, good restraint state can be formed similar to the case with restraint in the formulation example C, therefore the soil cement can be produced while reducing decrease in strength due to expansion.

As a result, based on the relation among aluminum powder addition rate of the blowing agent, the expansion coefficient of the cement milk or the mortar, concrete expansion coefficient and concrete compressive strength, it is preferable that aluminum powder addition amount as the blowing agent lies in a range of 0.002% to 0.02% against the cement mass in the cement milk and aluminum powder addition amount as the blowing agent lies in a range 0.007% to 0.04% against the cement mass in the mortar.

By retaining aluminum addition rate in the above range, it can be produced the expansion coefficient of the cement milk or the mortar with 3% to 16%.

The cement milk or the mortar having the expansion coefficient in a range of 3% to 16% is injected in the borehole and is stirred and mixed with the drilled soil by rotating the drill bit, thereby the expansion coefficient of the produced soil cement can be retained in a range of 1% to 8%. Thereafter, it occurs a state that the soil cement produces expanding pressure within the borehole and exerts pressure to the borehole wall and it becomes a state that reaction force of reaction occurs from the wall ground of the borehole. While this state is retained, the precast pile and the soil cement are hardened within the borehole, thereby the soil cement becoming the root consolidation, surrounding ground of underground and the precast pile are firmly integrated.

According to the present method, there is an effect that the pile tip support force of the precast pile, the circumferential surface frictional force and the extraction resistance force can be greatly improved.

When aluminum powder addition rate is less than 002% in case of the cement milk or is less than 0.007% in case of the mortar, the expansion coefficient of the produced soil cement becomes less than 1%, thereby decrease of compressive strength in the soil cement can be suppressed. On the contrary, since the expansion coefficient is low, expanding pressure exerted to the wall surface of the borehole cannot be sufficiently given.

When aluminum powder addition rate is more than 0.02% in case of the cement milk or is more than 0.04 in case of the mortar, the expansion coefficient of the produced soil cement becomes more than 8%. Thereby, although adhesion with the surrounding surface ground becomes high, decrease in compressive strength of the soil cement becomes large, therefore it is necessary to increase cement amount to raise strength, as a result, material cost becomes higher and economy becomes bad.

Example 1 of Precast Pile

The soil cement of the root consolidation portion for the precast pile is expanded, that is, volume of the soil cement becoming the root consolidation portion is expanded.

For example, the expansion coefficient to expand the root consolidation portion diameter φ 1000 mm by 10 mm and to make the diameter 1010 mm becomes 2.01%. The expansion coefficient to expand the root consolidation portion diameter φ 1200 mm by 10 mm and to make the diameter 1210 mm becomes 1.67%. The expansion coefficient to expand the root consolidation portion diameter φ 1500 mm by 10 mm and to make the diameter 1510 mm becomes 1.33%. The expansion coefficient to expand the root consolidation portion diameter φ 2600 mm by 10 mm and to make the diameter 2610 mm becomes 0.77%.

For example, the expansion coefficient to expand the root consolidation portion diameter φ 1000 mm by 20 mm and to make the diameter 1020 mm becomes 4.04%. The expansion coefficient to expand the root consolidation portion diameter φ 1200 mm by 20 mm and to make the diameter 1220 mm becomes 3.36%. The expansion coefficient to expand the root consolidation portion diameter φ 1500 mm by 20 mm and to make the diameter 1520 mm becomes 2.63%. The expansion coefficient to expand the root consolidation portion diameter φ 2600 mm by 20 mm and to make the diameter 2620 mm becomes 1.54%.

For example, the expansion coefficient to expand the root consolidation portion diameter φ 1000 mm by 30 mm and to make the diameter 1030 mm becomes 6.09%. The expansion coefficient to expand the root consolidation portion diameter φ 1200 mm by 30 mm and to make the diameter 1230 mm becomes 5.06%. The expansion coefficient to expand the root consolidation portion diameter φ 1500 mm by 30 mm and to make the diameter 1530 mm becomes 4.04%. The expansion coefficient to expand the root consolidation portion diameter φ 2600 mm by 30 mm and to make the diameter 2630 mm becomes 2.32%.

In this way, the expansion coefficient 0.77% to 6.09% capable of expanding the diameter of the root consolidation portion of the pile by 10 mm to 30 mm is made the expansion coefficient of the injected cement milk or the mortar in a range of 3% to 16%.

For example, in a case that the cement milk having the expansion coefficient 12% is injected in the borehole and is stirred and mixed with the drilled soil by the drill bit, the cement milk is injected with injection rate 100% and the expansion coefficient of the produced soil cement becomes 6%. Here, in a case that safety rate is set to "1.5", the expansion coefficient of the soil cement becomes 4%.

Further, the expansion coefficient of the soil cement produced by injecting the cement milk with injection rate 150% becomes 8.04%. In a case that safety rate is set to "1.5", the expansion coefficient of the soil cement becomes 5.36%.

Further, the expansion coefficient of the soil cement produced by injecting the cement milk with injection rate 200% becomes 9%. In a case that safety rate is set to "1.5", the expansion coefficient of the soil cement becomes 6%.

Therefore, as mentioned, it can be carried out the soil cement in which diameter of the root consolidation portion is expanded and enlarged by 10 mm to 20 mm. In case of the expansion coefficient 6.09% of the soil cement when pile diameter is expanded by 30 mm, it can be carried out with the expansion coefficient 13% of the injected cement milk or the mortar.

Further, since compressive strength of the soil cement in the root consolidation portion is determined by strength of the injected cement milk or the mortar, a predetermined strength setting can be done by appropriately preparing cement amount.

As mentioned, the diameter of the root consolidation portion can be expanded and enlarged by 10 mm to 30 mm, and larger expansion coefficient can be carried out. Based on larger expansion coefficient, the ground slacked during drilling can be solved by expanding pressure of the soil cement and it can be retained a state that expanding pressure is exerted to the wall of the borehole. Further, it occurs a state that reaction force of reaction occurs from the wall ground of the borehole and while this state, the soil cement is hardened, therefore the soil cement, the surrounding ground and the precast pile are firmly integrated. According to the present method, the tip support force, the circumferential surface frictional force and the extraction resistance force of the precast pile can be greatly improved.

Although expansion amount of the soil cement in the root consolidation portion mentioned above is 10 mm to 30 mm, it is preferable that the diameter of the root consolidation portion having expansion portion more than 10 mm around circumference thereof is expanded more than 20 mm.

In a case that the expansion coefficient of the cement milk or the mortar to which the aluminum powder is added lies in a range of 3% to 16%, the drilled and fluidized soil by the drill bit and the cement milk or the mortar to which the blowing agent appropriately prepared is added are stirred and mixed, the expanding soil cement expansion coefficient of which lies in a range of 1% to 8% is produced, thereafter the soil cement is hardened and the root consolidation portion integrated with the drilled ground can be formed. Thereby, efficiency of the tip support force, the circumferential surface frictional force and the extraction resistance force can be greatly improved.

Further, when expanding material is mixed in the soil cement and contraction of the soil cement after hardened becomes more than contraction compensation (contraction zero), it is conducted volume increase more than compensation of the initial contraction until the soil cement is hardened by action of the aluminum powder of the blowing agent and contraction of the soil cement after hardened by expansion material is compensated. Thereby, contraction of the soil cement can be further compensated over whole usage period.

Further, by mixing fiber material in the soil cement, it can be improved the crack resistance, the toughness and the strength.

Example 2 of Precast Pile

In the formulation example B, using value of predictive expansion coefficient 5.4% of expansive mortar (cement amount 681 kg/m$^3$×aluminum powder addition rate 0.0116%≈79 g/m$^3$, the expansion coefficient 5.4% is picked up in FIG. 8), pre-boring root consolidation method of the precast pile burying method is carried out For example, the above root consolidation method is carried out with shaft portion drilling diameter φ 1000 mm, precast pile diameter φ 800 mm, root consolidation portion diameter φ 1000 mm, root consolidation portion length 10 m, drilling depth of borehole GL-20 m, pile length 20 m.

At first, the borehole with drilling depth GL-20 m is drilled by the drill bit φ 1000 mm and expansive mortar to which aluminum powder chemical reaction time with the cement of which is appropriately prepared is added is injected within a 5 m depth range from the drill top portion GL-15 m in the borehole to GL-20 m. Further, the mortar is stirred and mixed with the drilled soil by the drill bit and the soil cement forming the root consolidation portion is produced.

That is, expansive mortar is injected in a 5 m depth range from drilling depth GL-15 m to GL-20 m with injection rate 200%, the mortar and the drilled soil are stirred and mixed, the soil cement with 10 m length (height) becoming the root consolidation portion with mortar content ratio 75% is produced (see FIG. 43(*d*)).

Therefore, the mortar content ratio of the soil cement with 10 m height becoming the root consolidation portion becomes 75% and the expansion coefficient thereof becomes 75%.

The addition amount of the aluminum powder is determined based on the drill depth and the depth of drill depth GL-10 m (length 10 m of the soil cement becoming the produced root consolidation portion) from height of the soil cement becoming the root consolidation portion.

Since inside of the borehole becomes the saturation state with fluidized soil made muddy and water and the like of the drill solution, aluminum powder addition amount is determined so that the expansion coefficient of the soil cement becoming the root consolidation portion with drill depth 10 m becomes 5.4%.

As for aluminum powder addition amount, to obtain the expansion coefficient as same as that under normal pressure under a condition of water pressure of the drill depth 10 m, it is necessary to consider two times (2 atm=depth 10 m) of aluminum powder addition amount under normal pressure and pressure of muddy soil within the borehole.

Under normal pressure, since aluminum powder addition rate of the expansion coefficient 5.4% is 0.0116% against the cement mass, it is calculated as 0.0116%×2 times (2 atm)=0.0232%. Further, this value is multiplied by 1.8 as density of muddy soil is 1.8, thus aluminum powder is added with addition amount becoming 0.0232%×1.8≈0.04176%.

Therefore, the expansion coefficient of the soil cement becoming the root consolidation portion with depth of GL-10 m becomes 5.4% (expansion coefficient under normal pressure)×75% (mortar content ratio)÷1.5 (safety rate)=2.7%.

This size of the expansion coefficient 2.7% corresponds to expanding pressure expanding the diameter φ 1000 mm of the soil cement becoming the root consolidation portion under drill depth 10 m to the size about φ 1013 mm.

Further, as for expansion of the soil cement becoming the root consolidation portion produced by the injected expansive mortar, since the expansion coefficient 2.7% occurs under drill depth 10 m (2 atm), the expansion coefficient of the soil cement becoming the root consolidation portion produced under GL-20 m at the pile top portion becomes 2.7%×2 (2 atm)=5.4% and 5.4%÷3 (3 atm)=1.8% according to Boyle's law (pressure and volume of gas are inversely proportional under constant temperature).

This expansion coefficient size of 1.8% corresponds to expanding pressure expanding the diameter φ 1000 mm of the soil cement becoming the root consolidation portion under drill depth 20 m to the size about φ 1008 mm.

Figure 44:
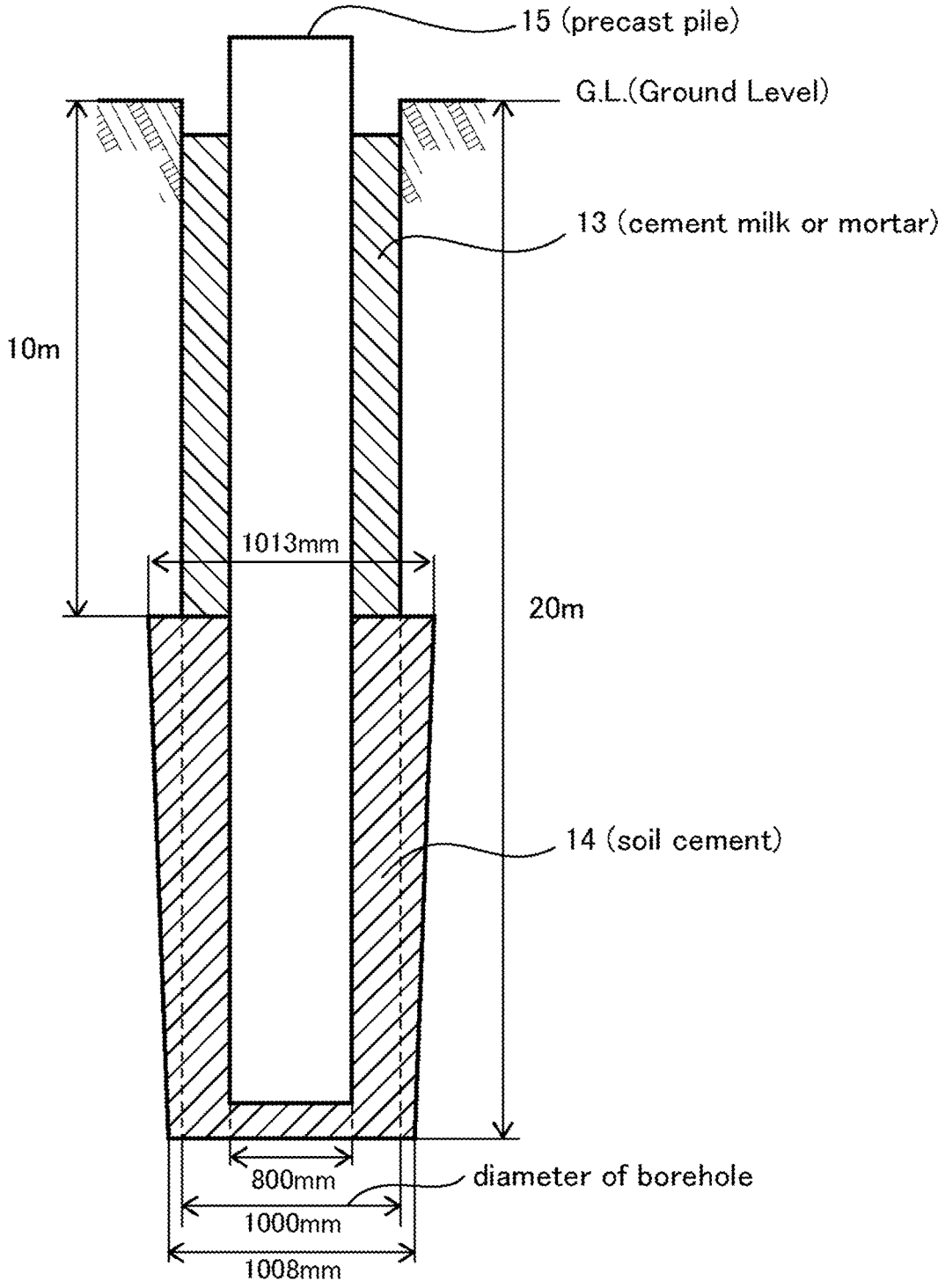
FIG. 44 illustrates one embodiment in which the soil cement is formed into a reverse tapered shape.

Therefore, it is formed the soil cement becoming the expanded root consolidation portion that the diameter φ 1000 mm becomes φ 1013 mm under drill depth GL-10m, expansion of φ 1008 mm at the pile top portion under depth GL-20m occurs, and it is formed expansion of reverse taper 5 mm in which the upper portion of height 10 m becomes 1013 mm and the lower portion (pile top portion) becomes 1008 mm (FIG. 44).

The reverse taper shape means a cylindrical shape having a diameter reducing from the top of the cylindrical shape toward the bottom of the cylindrical shape as shown in FIG. 44.

Or, when expansion of the soil cement is restricted, it is formed the soil cement becoming the root consolidation portion occurring expanding pressure corresponding to the reverse taper shape.

Based on the reverse tape shape with pushing out effect, resistance force for subsidence of the pile can be obtained, and the circumferential surface frictional force and the tip support force can be improved. Further, since the reverse taper shape of the soil cement becoming the root consolidation portion becomes wedge shape, there is an effect that the extraction resistance force of the pile can be greatly improved.

Further, based on expanding pressure expanding the soil cement diameter φ 1000 mm becoming the root consolidation portion to the size of the reverse taper shape in a range from φ 1013 mm to φ 1008 mm, the circumferential surface ground and the soil cement becoming the root consolidation portion can be firmly integrated and performance of the pile can be greatly improved.

Since the soil cement becoming the root consolidation portion is cement composition, it is considered that strength of the soil cement becoming the root consolidation portion is determined cement water ratio (C/W), similar to strength of general concrete.

In a case that expansive mortar (unit cement amount 681 kg/m$^3$, W/C=45%) of the formulation example B is injected with 200%, cement amount of the soil cement becoming the produced root consolidation portion becomes 681 kg/m$^3$ (unit cement amount)×75% (cement content ratio)÷1.5 (safety rate)=340.5 kg/m$^3$.

Therefore, since the soil cement becoming the produced root consolidation portion forms the soil cement expanding with the expansion coefficient 5.4% by cement amount 340.5 kg/m$^3$, it will be predicted that strength of this soil cement is close to a relation of expansive concrete strength in the formulation example C because the formulation thereof is close to the formulation of cement amount 344 kg/m$^3$ of expansive concrete in the formulation example C.

Further, since water cement ratio of the injected mortar is 45% and the soil cement becoming the root consolidation portion is produced by stirring and mixing with the drilled soil made muddy, water cement ratio of this soil cement becomes high, thus decrease in strength occurs. Predicting similarly to the mortar content ratio, it will be predicted that strength of the soil cement becoming the root consolidation portion becomes 50% of the expansive concrete strength in the formulation example C.

Therefore, since the expansive concrete strength with aluminum powder addition rate 0.0116% in the formulation example C is 49.2 N/mm$^2$ with restraint, it can be predicted that the strength of the soil cement becomes 49.2 N/mm$^2$×50%=24.6 N/mm$^2$. Strength of the soil cement becoming the root consolidation portion is good.

Next, the expansion coefficient of the injected expansive mortar is carried out with 12%.

The expansive mortar in the formulation example B with predictable expansion coefficient 12% (cement amount 681 kg/m$^3$×aluminum powder addition amount 0.025% 170 g/m$^3$ and expansion coefficient 12% is picked up from FIG. 8) is injected with 200%.

The above root consolidation method is carried out with shaft portion drilling diameter φ 1000 mm, precast pile diameter φ 800 mm, root consolidation portion diameter φ 1000 mm, root consolidation portion length 10 m, drilling depth of borehole GL-20 m, pile length 20 m.

Expansive mortar is injected in a 5 m depth range from drilling depth GL-15 m to GL-20 m with injection rate 200%, the soil cement with 10 m height becoming the root consolidation portion with cement content ratio 75% is produced. The expansion coefficient of the soil cement becoming the root consolidation portion becomes 75%.

The addition amount of the aluminum powder is determined under water pressure of GL-10 m depth according to which height of the soil cement becoming the root consolidation portion becomes 10 m. To obtain the expansion coefficient as same as that under normal pressure under a condition of water pressure of the drill depth 10 m, it is necessary to consider two times (2 atm=10 m) of aluminum powder addition amount under normal pressure and pressure of muddy soil within the borehole.

Under normal pressure, since aluminum powder addition rate of the expansion coefficient 12% is 0.025% against the cement mass, it is calculated as 0.025%×2 times (2 atm) =0.05%. Thus, Further, the aluminum powder is added with addition amount becoming 0.025×1.8 (muddy soil density)=0.09%

Therefore, the expansion coefficient of the soil cement becoming the root consolidation portion with depth of GL-10 m becomes 12% (expansion coefficient under normal pressure)×75% (mortar content ratio)÷1.5 (safety rate)=6%.

This size of the expansion coefficient 6% corresponds to expanding pressure expanding the diameter φ 1000 mm of the soil cement becoming the root consolidation portion under drill depth 10 m to the size about φ 1029 mm.

Further, as for expansion of the soil cement becoming the root consolidation portion produced by the injected expansive mortar, since the expansion coefficient 6% occurs under drill depth 10 m (2 atm), the expansion coefficient of the soil cement becoming the root consolidation portion produced under GL-20 m at the pile top portion becomes 6%×2 (2 atm)=12% and 12%÷3 (3 atm=depth 20 m)=4% according to Boyle's law.

This expansion coefficient size of 4% corresponds to expanding pressure expanding the diameter φ 1000 mm of the soil cement becoming the root consolidation portion under drill depth 20 m to the size about φ 1019 mm.

Therefore, it is formed the soil cement becoming the expanded root consolidation portion that the diameter φ 1000 mm becomes φ 1029 mm under drill depth GL-10 m, expansion of φ 1019 mm at the pile top portion under depth GL-20 m occurs, and it is formed expansion of reverse taper 10 mm in which the upper portion of height 10 m becomes 1029 mm and the lower portion (pile top portion) becomes 1019 mm.

Or it is formed the soil cement becoming the root consolidation portion occurring expanding pressure of the above shape.

Further, as for strength of the soil cement becoming the root consolidation portion, since predictive value of aluminum addition rate 0.025% is 46.2 N/mm2 from concrete strength with restraint of the expansive concrete in the formulation example C similar to the above, strength of the soil cement becoming the root consolidation portion can be predicted as 46.2 N/mm$^2$×50%=23.1 N/mm$^2$.

Strength of the soil cement becoming the root consolidation portion is good.

Further, based on expanding pressure expanding the soil cement diameter φ 1000 mm becoming the root consolidation portion to a size of the reverse taper shape in a range from φ 1029 mm to φ 1019 mm, the circumferential surface ground and the soil cement becoming the root consolidation portion can be firmly integrated and performance of the pile can be greatly improved.

Therefore, in a case that the expansion coefficient of the injected expansive mortar is enlarged from 5.4% to 12% and the expansion coefficient of the soil cement becoming the produced root consolidation portion is enlarged from 2.7% to 6%, reverse taper is enlarged from 5 mm to 10 mm with the length (height) 10 m of the soil cement becoming the root consolidation portion, thereby resistance force against subsidence of the pile can be greatly improved by reverse taper and subsidence of the pile can be suppressed.

In this way, based on that the expansion coefficient of the soil cement becoming the produced root consolidation portion is enlarged, the pile tip support force, the circumferential surface frictional force and the extraction resistance force can be improved. Further, based on that the expansion coefficient of the root consolidation portion is enlarged, reverse taper becomes large and height of the reverse taper shape is elongated, thereby there is an effect that pushing out effect can be raised and the pile tip support force, the circumferential surface frictional force and the extraction resistance force can be improved.

As mentioned in the above, although some of embodiments according to the present invention are explained in detail based on the drawings, these are only examples and it can be carried out in the following methods in which the cement milk or the mortar to which the blowing agent of the present invention having expanding action is added is injected, the soil cement of the produced cement composition or the cement milk or the mortar is expanded while restraining in the underground soil. For example, in the rotating pile construction method, the steel pipe soil cement piling method, the micro pile construction method, the anchor method, the earth reinforced soil construction method, the underground continuous construction method, the landslide prevention pile construction method, the vibrohammer method combined with water•cement milk jet and the like, the cement milk or the mortar to which the blowing agent is added is injected in the root consolidation portion, the produced soil cement or the cement milk or the mortar is expanded and hardened in the underground, thereby these are firmly integrated by receiving reaction force from the surrounding ground by pressure due to expansion and the tip support force, the circumferential surface frictional force and the extraction resistance force can be improved.

Further, the present method can be carried out in the ground improvement method, in the ground improvement pile (for example, cylindrical shape, rectangular shape, grid shape and the like) method, in the ground improvement wall pile and ground improvement underground continuous wall, or in the machine stirring method, in the injection stirring method (combining machine and injection). That is, the cement milk or the mortar to which blowing agent is added is injected, the produced soil cement is expanded in the ground, reaction force is given from the surrounding ground, thereby the expanded soil cement and the surrounding ground can be firmly integrated and improvement of the circumferential frictional force and enhancement of ground tolerance can be conducted. Further, based on that steel material and the like is mixed in the expanding soil cement, horizontal resistance force can be performed.

Further, in the chemical liquid injection method (here, chemical liquid includes non-chemical liquid type mainly composed of cement milk or mortar to which blowing agent is added, and chemical liquid type of solution type grout such as water glass in which cement milk or mortar is mixed), the present method can be carried out in the method that after boring the borehole by boring machine, injection material (cement milk or mortar to which blowing agent is added) is injected and water stop or strengthening of the ground is conducted by expanding pressure.

Further, the present method can be carried out in the place piling method in which the cement milk or the mortar to which the blowing agent is added and concrete are injected or casted and expanded.

Further, as well embodiments described in disclosure field of the invention, the present invention can be carried out in the other embodiments in which various modifications and improvements are done based on knowledge of a persons skilled in the art.

REFERENCE SIGNS LIST

A underground, B drilled soil, C pile surrounding consolidation solution, 11 borehole, 12 drill bit, 13 mortar, 14 soil cement, 15 precast pile, 16 top root consolidation portion

The invention claimed is:

1. A method for burying a precast pile, comprising:

injecting cement milk or mortar in a borehole drilled in ground;

producing soil cement by stirring and mixing the cement milk or the mortar with a drilled soil; and inserting the precast pile in the soil cement within the borehole, wherein a blowing agent having expanding action is added beforehand to the cement milk or the mortar, and thereby the soil cement formed around a base portion of the precast pile in the borehole is expanded so as to form the soil cement in a reverse taper shape that has a diameter reducing from a top of the reverse taper shape toward a bottom of the reverse taper shape based on a difference between a lower pressure at a top of the soil cement and a higher pressure at a bottom of the soil cement, and on Boyle's law under which a volume of a gas generated by the blowing agent is inversely proportional to a pressure of the gas under a constant temperature, and the reverse taper shape is formed without a formwork.

2. The method for burying a precast pile according to claim 1, wherein the blowing agent having expanding action foams the gas by chemical reaction in the soil cement and is composed of at least one compound selected at least from the group consisting of aluminum powder, powder of amphoteric metal, carbon material, peroxide material, sulphonyl hydrazide compound, azo compound, nitroso compound, and hydrazine derivatives.

3. The method for burying a precast pile according to claim 2, wherein the blowing agent is added so that an expansion coefficient of the cement milk or the mortar becomes in a range of 3% to 16%.

4. The method for burying a precast pile according to claim 3, wherein the aluminum powder is selected as the blowing agent, and the aluminum powder is added in an amount within a range of 0.002% to 0.02% against the cement mass so that the expansion coefficient of the cement milk becomes in a range of 3% to 16%, or the aluminum powder is added in an amount within a range of 0.007% to 0.04% against the cement mass so that the expansion coefficient of the mortar becomes in a range of 3% to 16%.

5. The method for burying a precast pile according to claim 3, wherein when a drilling depth is deep, the aluminum powder is selected as the blowing agent, and the aluminum powder is added in an amount within a range of 0.002% to 0.4% against the cement mass so that the expansion coefficient of the cement milk becomes in a range of 3% to 16%, or the aluminum powder is added in an amount within a range of 0.007% to 0.8% against the cement mass so that the expansion coefficient of the mortar becomes in a range of 3% to 16%.

6. The method for burying a precast pile according to claim 1, wherein the soil cement includes a fiber material.

7. A method for burying a precast pile, comprising:

injecting cement milk or mortar in a borehole drilled in ground;

producing soil cement by stirring and mixing the cement milk or the mortar with drilled soil; and inserting the precast pile in the soil cement within the borehole, wherein a blowing agent having expanding action is added beforehand to the cement milk or the mortar, and thereby the soil cement formed around a base portion of the precast pile in the borehole has an expanding pressure that is gradually reduced with an increasing depth of the borehole so that the expanding pressure corresponds to a reverse taper shape that has a diameter reducing from a top of the reverse taper shape toward a bottom of the reverse taper shape based on a difference between a lower pressure at a top of the soil cement and a higher pressure at a bottom of the soil cement, and on Boyle's law under which a volume of a gas generated by the blowing agent is inversely proportional to a pressure of the gas under a constant temperature.

8. The method for burying a precast pile according to claim 7, wherein the blowing agent having expanding action foams the gas by chemical reaction in the soil cement and is composed of at least one compound selected at least from the group consisting of aluminum powder, powder of amphoteric metal, carbon material, peroxide material, sulphonyl hydrazide compound, azo compound, nitroso compound, and hydrazine derivatives.

9. The method for burying a precast pile according to claim 8, wherein the blowing agent is added so that an expansion coefficient of the cement milk or the mortar becomes in a range of 3% to 16%.

10. The method for burying a precast pile according to claim 9, wherein the aluminum powder is selected as the blowing agent, and the aluminum powder is added in an amount within a range of 0.002% to 0.02% against the cement mass so that the expansion coefficient of the cement milk becomes in a range of 3% to 16%, or the aluminum powder is added in an amount within a range of 0.007% to 0.04% against the cement mass so that the expansion coefficient of the mortar becomes in a range of 3% to 16%.

11. The method for burying a precast pile according to claim 9, wherein when a drilling depth is deep, the aluminum powder is selected as the blowing agent, and the aluminum powder is added in an amount within a range of 0.002% to 0.4% against the cement mass so that the expansion coefficient of the cement milk becomes in a range of 3% to 16%, or the aluminum powder is added in an amount within a range of 0.007% to 0.8% against the cement mass so that the expansion coefficient of the mortar becomes in a range of 3% to 16%.

12. The method for burying a precast pile according to claim 7, wherein the soil cement includes a fiber material.

* * * * *